US010442183B2

(12) United States Patent
Franz et al.

(10) Patent No.: US 10,442,183 B2
(45) Date of Patent: Oct. 15, 2019

(54) METHOD FOR CONFIGURING A DRYER DEVICE IN A SECURITY PRINTING PRESS, AND A SECURITY PRINTING PRESS

(71) Applicant: KOENIG & BAUER AG, Würzburg (DE)

(72) Inventors: Sebastian Franz, Leinach (DE); Michael Scheller, Unterpleichfeld (DE)

(73) Assignee: Koenig & Bauer AG, Wurzburg (DE)

( * ) Notice: Subject to any disclaimer, the term of this patent is extended or adjusted under 35 U.S.C. 154(b) by 0 days.

(21) Appl. No.: 16/084,662

(22) PCT Filed: Feb. 21, 2017

(86) PCT No.: PCT/EP2017/053839

§ 371 (c)(1),
(2) Date: Sep. 13, 2018

(87) PCT Pub. No.: WO2017/157619

PCT Pub. Date: Sep. 21, 2017

(65) Prior Publication Data

US 2019/0084291 A1 Mar. 21, 2019

(30) Foreign Application Priority Data

Mar. 18, 2016 (DE) ..... 10 2016 204 547

(51) Int. Cl.
*B41F 11/02* (2006.01)
*B41F 23/04* (2006.01)
(Continued)

(52) U.S. Cl.
CPC ..... *B41F 11/02* (2013.01); *B41F 23/0409* (2013.01); *B41F 23/0426* (2013.01);
(Continued)

(58) Field of Classification Search
CPC ..... B41F 11/02
(Continued)

(56) References Cited

U.S. PATENT DOCUMENTS 4,991,506 A 2/1991 Rodi
5,115,741 A 5/1992 Rodi
(Continued)

FOREIGN PATENT DOCUMENTS

DE 102004021141 B3 8/2005
DE 102006013173 A1 10/2006
(Continued)

OTHER PUBLICATIONS

International Search Report of PCT/EP2017/053839 dated Aug. 10, 2017.

*Primary Examiner* — Anthony H Nguyen
(74) *Attorney, Agent, or Firm* — Mattingly & Malur, PC

(57) ABSTRACT

A method is provided for configuring a drying device in a printing machine, in particular in a value document printing machine. The printing machine has at least one printing unit which comprises an imaging cylinder having a plurality of imaging printing elements or groups of imaging printing elements which are arranged in rows and columns on its circumference. A drying device has a dryer, by which print material, passing through the dryer, is subject to radiation. The drying device is configured for ongoing or upcoming production in such a way that the print material passing through the dryer, in order to be dried, is subjected to radiation in a plurality of tracks spaced from each other by non-irradiated tracks according to the same switch-on and switch-off sequence extending over cycle length. The configuration takes place with regard to one of a lateral position and a width of the tracks to be subject to two radiation by the dryer using product-related data or information regarding one of the number and the size and the position of value
(Continued)

items to be printed next to each other on the print material portion and one of using data which comes from a device for image capture and an evaluation comprised by the printing machine or provided in parallel to such a device.

16 Claims, 23 Drawing Sheets

(51) Int. Cl.
*B41F 33/00* (2006.01)
*B41F 33/02* (2006.01)

(52) U.S. Cl.
CPC ..... *B41F 23/0453* (2013.01); *B41F 23/0466* (2013.01); *B41F 23/0479* (2013.01); *B41F 33/0009* (2013.01); *B41F 33/0036* (2013.01); *B41F 33/02* (2013.01); *B41P 2233/10* (2013.01)

(58) Field of Classification Search
USPC ..... 101/424.1
See application file for complete search history.

(56) References Cited

U.S. PATENT DOCUMENTS

| | | | | |
|---|---|---|---|---|
| 6,101,939 | A | 8/2000 | Giori et al. | |
| 8,220,391 | B2 | 7/2012 | Hirokawa et al. | |
| 8,256,345 | B2 * | 9/2012 | Denninger | B41F 7/12 101/424.1 |
| 8,326,183 | B2 | 12/2012 | Petermann | |
| 8,699,921 | B2 | 4/2014 | Petermann | |
| 9,440,459 | B1 * | 9/2016 | Fromm | B41J 11/002 |
| 9,840,073 | B2 | 12/2017 | Ihme et al. | |
| 2004/0145642 | A1 | 7/2004 | Noshing et al. | |
| 2004/0189769 | A1 * | 9/2004 | Wilbur | B41J 11/002 347/102 |
| 2004/0206260 | A1 * | 10/2004 | Pitz | B41F 23/0413 101/424.1 |
| 2004/0226462 | A1 | 11/2004 | Demoore et al. | |
| 2004/0237824 | A1 * | 12/2004 | Kimura | B41F 23/0409 101/488 |
| 2005/0235851 | A1 * | 10/2005 | Beier | B41F 23/0406 101/424.1 |
| 2006/0219107 | A1 | 10/2006 | Gygi | |
| 2007/0206083 | A1 | 9/2007 | Noshing | |
| 2007/0283827 | A1 * | 12/2007 | Jung | B41F 23/00 101/424.1 |
| 2008/0282974 | A1 | 11/2008 | Takemata | |
| 2009/0145318 | A1 * | 6/2009 | Hoynant | C09D 11/02 101/424.1 |
| 2009/0148620 | A1 | 6/2009 | Petermann | |
| 2009/0158946 | A1 * | 6/2009 | Roth | B41F 11/02 101/219 |
| 2009/0195627 | A1 | 8/2009 | Hirokawa et al. | |
| 2010/0242753 | A1 | 9/2010 | Gygi | |
| 2013/0021420 | A1 | 1/2013 | Petermann | |
| 2015/0367625 | A1 | 12/2015 | Ihme et al. | |
| 2018/0079199 | A1 | 3/2018 | Takemata | |

FOREIGN PATENT DOCUMENTS

| | | | |
|---|---|---|---|
| DE | 102007040139 | A1 | 4/2008 |
| DE | 202008005106 | U1 | 10/2008 |
| DE | 102009007873 | A1 | 8/2009 |
| DE | 102009027142 | A1 | 12/2010 |
| DE | 102010003862 | A1 | 10/2011 |
| DE | 102012215491 | A1 | 3/2013 |
| DE | 102015107168 | A1 | 11/2016 |
| EP | 0355473 | A2 | 2/1990 |
| EP | 949069 | B1 | 10/1999 |
| EP | 1142711 | A | 10/2001 |
| EP | 1439071 | B1 | 9/2007 |
| EP | 1599340 | B1 | 9/2007 |
| EP | 1992486 | A1 | 11/2008 |
| EP | 2025515 | A1 | 2/2009 |
| EP | 1648702 | B1 | 3/2010 |
| EP | 2067620 | B1 | 7/2013 |
| GB | 2399162 | A | 9/2004 |
| JP | 2011-031486 | A | 2/2011 |
| WO | 2014124711 | A1 | 8/2014 |
| WO | 2015118447 | A2 | 8/2015 |

* cited by examiner b)

a)

a)

b)

METHOD FOR CONFIGURING A DRYER DEVICE IN A SECURITY PRINTING PRESS, AND A SECURITY PRINTING PRESS

CROSS REFERENCE TO RELATED APPLICATIONS

This application is the U.S. National Phase, under 35 U.S.C. section 371, of PCT/EP2017/053839, filed Feb. 21, 2017; published as WO 2017/157619A1 on Sep. 21, 2017 and claiming priority to DE 102016204547.4, filed Mar. 18, 2016, the disclosures of which are expressly incorporated herein in their entirties by reference.

FIELD OF THE INVENTION

The present invention relates to a method for configuring a dryer device in a security printing press and to a security printing press. The security printing press is configured having at least one printing unit, which comprises an image-producing cylinder having a multiplicity of image-producing printing elements or groups of image-producing printing elements arranged in rows and columns on the cylinder periphery. At the print position of the security printing press, sections of a printing substrate passing through the print position are imprinted, in a cycle that has a fixed cycle length based upon the forward feed of printing substrate at the print position, with one print element per section of one print image length, having image elements or groups of image elements arranged side by side and one behind the other in a grid of multiple copies. The dryer device in the security printing press is configured having a dryer which is located downstream of the print position in the printing substrate path and comprising one of an integral or a multi-part drying assembly, which dryer device is used to irradiate printing substrate passing through the dryer for the purpose of drying the printing substrate along at least one track extending in the direction of transport of the printing substrate.

BACKGROUND OF THE INVENTION

Known from EP 2025515 A1 is a screen printing press having a printing assembly that comprises two print positions. Each print position is formed by a screen cylinder thrown onto an impression cylinder. A drying unit that uses UV radiation is provided in the printing substrate path between the two print positions and can be used for at least superficially drying the ink pattern that is applied at the first print position. An ink pattern having printed areas that directly adjoin or even overlap with the areas first printed can then be applied at the second print position. A plurality of image elements arranged in rows and columns and comprising these two areas are thereby printed onto one printing substrate sheet, for example.

EP 1648702 B1 discloses a printing press having a printing unit that operates according to the screen printing method, in which one printing cylinder or cylinder of a conveyor line has at least one magnetic element for aligning pigments contained in the ink, and the printing substrate path comprises a dryer located downstream.

EP 2067620 B1 concerns a method for drying printed material in multicolor printing, in which drying is performed by means of a one-dimensional or two-dimensional array of radiation sources, depending on the image content. In said method, data from the prepress stage are used for controlling the light sources individually or in groups.

DE 10 2009 007873 A1 discloses a sheet-fed printing press in which a sheet imprinted with UV-curable inks is acted on by exposing a predetermined area thereof to UV light. For this purpose, the apparatus comprises a plurality of LEDs, which are arranged in predetermined zones in the transverse direction of the sheet and are switched in accordance with the location and size of predetermined areas. Individual zones can be switched on in the transverse direction based upon the width of the area of the sheet that is passing through or based upon whether an image is contained in the zone in question. In the direction of transport, zones can be switched on based upon the leading and trailing ends of an image or based upon the spacing of a plurality of partial images spaced from one another in the longitudinal direction. The area of exposure is calculated by a corresponding calculating unit, based on data that are provided prior to the printing process.

From DE 10 2012 215491 A1 a processing machine and a method for operating the same are known, in which data relating to the subject of a job are fed to a control console, and, taking these data into account, a control system for a dryer is supplied with signals, by means of which the dryer can be activated and deactivated zonally across the format width of the printing substrate, taking the subject into account.

EP 1599340 B1 concerns the ultraviolet curing of coating compositions, in which, by way of example, in an inkjet head oscillating laterally over a printing substrate, LEDs that are moved along with the head irradiate only printed target areas for the purpose of selective drying. Control is implemented, e.g. by means of software, for example using a raster image or some other system used in the production of the printed image. In a modified variant, control of the LEDs is transferred to intermediate dryers or a final dryer of an offset printing press. Alternatively, this can also be applied to a screen printing technique, to enable the controlled drying of a printed substrate prior to a subsequent printing step.

EP 1439071 B1 concerns an inkjet printer which has a dryer that is controlled based upon a temperature or a humidity measured by a sensor.

US 2007/0206083 A1 also concerns an inkjet printer, in which the ink is cured by irradiation or some other application of energy. LEDs that are moved along with the inkjet head are used for the purpose of irradiation, with the quantity of radiation and the profile in the direction of paper transport being adjusted differently based upon the paper that is used.

DE 10 2007 040139 A1 discloses a printing press in which a dryer is positioned in a sheet-guiding drum, co-rotating therewith. The dryer can be controllable zonally in the circumferential direction and/or in the axial direction, independently of adjacent zones, and can thus be adaptable to the printed image. The zones, in a checkerboard pattern, for example, can be actuated based upon the printed image. The data for this can be taken from the prepress stage. Actuation can also be based upon operating parameters, including printed sheet parameters such as the printed sheet format.

EP 1142711 A1 discloses a system for controlling the dryer device of a printing press, in which the dryer device is controlled based upon variables that characterize the printing process. As one such variable, the radiation output of a UV or IR dryer can be controllable based upon the ink coverage of a printing unit upstream. In cases in which dryer devices are arranged distributed in blocks over the format width, the individual blocks can also be actuated in accordance with the ink coverage of the subject. The data concerning ink coverage to be used for this purpose can be obtained by scanning the printing plate, or preferably in the form of a data set from the digital prepress stage.

EP 2025515 A1 discloses a security printing press having two screen printing units, with one UV dryer positioned therebetween. The screen printing units can be used for applying image elements for each copy, according to a grid composed of multiple columns and rows of copies.

WO 2015/118447 A2 discloses a security printing press having a printing unit that operates according to the letterset process, and an additional screen printing unit. The printing unit that operates according to the letterset printing process can be used in its embodiment as a numbering printing unit, for example, for applying serial numbers to the copies.

EP 0949069 B1 discloses a security printing press with which, at a first print position, a first side can be imprinted in two colors, and at a second print position, both sides can be imprinted simultaneously in multiple colors. A UV dryer is located between the two print positions and is directed toward the side that has just been imprinted.

DE 198 35 046 A1 relates to a device for drying printing ink or ink, in which a print image-dependent drying process can be carried out using a heat source, e.g. an IR radiation source, positioned downstream of the printing unit. In this case, a print head of a printing unit not shown in detail creates a print image on the paper substrate in accordance with electronic control signals from a computer, e.g. a PC. In one embodiment, the print image-dependent drying process can be carried out using data from a scanning or sensor unit located downstream of the printing device, and in another embodiment, said drying process can be carried out by analyzing the print image to be printed by the print head.

DE 100 38 897 A1 discloses a method and a device for drying inkjet printing by means of infrared radiation. This method and device are based on the premise that ink printing devices that operate using non-penetrating ink will produce significantly clearer text on the type of printer paper that is used in offices than printing units that operate using penetrating ink. To accelerate drying, IR radiation is applied to the imprinted substrate. This application is preferably carried out based upon the contour of the printed image, for example by means of a control system which is actuated via a print image detection device.

JP 2011-31485 A discloses a sheet-fed printing press having a UV dryer, the active width of which can be adapted to the sheet width by means of lateral shutters.

In EP 1992486 A1, a sheet width is read from a "setting unit" and this width is then used in configuring the dryer with respect to the sheet width.

DE 10 2015 107 168 A1 relates to an improved folding of printing substrates that have been varnished and then dried using a hot air or radiation dryer, wherein little or no varnish is applied along a line that will be folded downstream. Alternatively, the different condition of the layer of varnish in the fold region may be achieved by means of mechanical and/or chemical and/or radiation processing. In a further alternative, if a radiation dryer having multiple LED's arranged side by side is provided, drying or curing with one LED may be left incomplete at the line along which folding is to take place.

DE 10 2010 003 862 A1 discloses a drying unit which is located in the sheet transport path and which is rotatable such that the effective drying width can be adapted to the sheet or the subject width.

In DE 20 2008 055 106 U1, movable dryer units are provided in the web path between two printing units of a printing tower.

US 2004/0226462 A1 discloses a UV dryer system having a plurality of UV lamps arranged transversely to the transport direction, the output of each of which can be varied.

In EP 0355473 A2, light is transmitted from a radiation source provided outside of the printing press onto printed articles via a fiber-optic cable, the cable being split at the end over the entire width of the article.

DE 10 2006 013 173 A1 relates to an interface adapter for transmitting data for actuating a ventilating component in a machine for the graphics industry.

DE 10 2009 027 142 A1 discloses a device for controlling a metering device of an inking unit.

DE 10 2004 021 141 B3 discloses a device for curing printing inks with UV radiation units and with reflectors that reflect the scattered radiation onto the surface to be irradiated.

SUMMARY OF THE INVENTION

The object of the present invention is to provide a method for configuring a dryer device in a security printing press, and a security printing press.

The object is achieved according to the invention by the configuring of the dryer device for one of an ongoing or a pending production process in such a way that the printing substrate passing through the dryer is irradiated for the purpose of drying that substrate along the plurality of tracks that are spaced from one another by tracks which are not irradiated, according to the same on/off switching sequence that extends over one cycle lengths. The configuration, with respect to one of the lateral position and the width of the tracks to be irradiated by the dryer, is carried out using production-related data or information regarding one of the number and the size and the position of copies to be printing side by side on one printing substrate section, and by one of using data that are provided by a device for image detection and analysis which is part of the printing press, or are supplied in parallel to such a device. A control system for controlling the operation of the dryer is connected for signals communication to one of a user interface and to a device for image detection and analysis, from which the dryer can be configured with respect to one of the lateral position and the number of drying elements operated by the control system according to the same on/off switching sequence.

The advantages to be achieved with the present invention consist, in particular, in that variable-length and/or selective drying can be accomplished with a particularly rapid and efficient configuration solution.

In a preferred embodiment of a security printing press, in particular a security printing press having a least one printing unit, at the print position of which sections of a printing substrate passing through said print position can be imprinted with one print image of one print image length per section, in a cycle, the cycle length of which is fixed based upon the forward feed of the printing substrate at the print position, and having a dryer device that has a dryer, which is located downstream of the print position in the printing substrate path and which comprises an integral or multi-part drying means, which dryer can apply radiation to printing substrate passing through the dryer for the purpose of drying said substrate along at least one track extending in the transport direction of the printing substrate, a control system for controlling the operation of the dryer is connected for signals transmission to a user interface and/or to a device (89) for image detection and/or analysis, from which the dryer can be configured with respect to the lateral positioning and/or the number of drying elements operated by the control system according to the same on/off switching sequence.

In one advantageous embodiment, a user interface connected directly or indirectly to the control system is provided with control elements which may be used by operating technicians to configure the dryer device with respect to the lateral positioning and/or the width of multiple tracks to be acted on by the dryer.

In another advantageous embodiment, a device for image detection and/or analysis, connected for signals transmission to the control system, is provided in the printing substrate path and can be used to provide data regarding the positioning and/or dimensions of image elements or groups of image elements applied upstream to the printing substrate, i.e. data specifying and/or representing the positioning and/or dimensions or information containing these data, to the control system.

In the configuration of the dryer device in a security printing press, in particular a security printing press having at least one printing unit, at the print position of which sections of a printing substrate, in particular printing substrate sheets, passing through said print position can be imprinted with one print image, in particular with precisely one print image, of one print image length per section, in a cycle, the cycle length of which is fixed based upon the forward feed of the printing substrate at the print position, wherein the dryer device has a dryer, which is located downstream of the print position in the printing substrate path and comprises an integral or multi-part drying means, which dryer applies radiation to printing substrate passing through the dryer for the purpose of drying said substrate along at least one track extending in the transport direction of the printing substrate, the tracks to be irradiated by the dryer are configured with respect to their lateral positioning and/or width using production-related data or information regarding the number and/or size and/or positioning of copies to be printed side by side on a section of printing substrate and/or using data from a device for image detection and/or analysis which is part of the printing press or provided in parallel to such a device.

A further security printing press which is advantageous in conjunction with a preferred embodiment for configuration comprises at least one first print position, in which printing substrate passing through this print position, in particular sections of a printing substrate web or preferably printing substrate sheets, can be imprinted in sections on at least a first of its two sides over a printing length and printing width, in a cycle, the cycle length of which is fixed based upon the forward feed of the printing substrate at the print position, with print images, the print image length of which is shorter than the cycle length, a second print position immediately following the first downstream, in which the printing substrate passing through this print position can be printed likewise on at least its second side with print images, and at least one dryer device having a dryer which is located between the first and second print positions in the printing substrate path and/or in the printing substrate path downstream of the second print position and which comprises an integral or multi-part drying means, which dryer can be used to apply radiation to the printing substrate passing through the dryer along its transport path for the purpose of drying said substrate. Further provided is a control system for controlling the activation and deactivation of the drying means of the dryer, which is connected for signals transmission to a transmitter that supplies signals representing the press phase and/or the forward feed of the substrate, and which, during operation, switches the radiation source or at least a part thereof on and off one time per cycle, with at least one active and at least one inactive phase correlated to the press and/or printing substrate phase position.

In conjunction with a preferred configuration embodiment, during the production of security products or security intermediates in a security printing press, at a first print position provided in the printing substrate path, printing substrate passing through this print position, in particular sections of a printing substrate web or preferably printing substrate sheets, are imprinted on at least a first of its two sides over a printing length and printing width, in a cycle, the cycle length of which is fixed based upon the forward feed of the printing substrate at the print position, with print images, the print image length of which is shorter than the cycle length, and at a second print position immediately following the first downstream, the printing substrate passing through this print position is imprinted on at least the second of its sides, for example in the same cycle, with print images, the print image length of which is shorter than the cycle length. A dryer of a dryer device, comprising an integral or multi-part radiation means and arranged in the printing substrate path between the first and second print positions and/or in the printing substrate path downstream of the second print position, applies radiation to the printing substrate passing on its transport path through the dryer for the purpose of drying said substrate. Preferably, the printing substrate is irradiated in a clocked manner, in which the radiation source or at least a part thereof is switched on and off with at least one active and one inactive phase correlated to the press and/or printing substrate phase position.

Features that refine the aforementioned preferred embodiments and methods, as described in the following and/or in reference to embodiment examples and/or in the features of the dependent claims, may be applied individually or in multiples to form an advantageous refinement.

In one possible refinement of the aforementioned solution, the position and/or length of the repeating on/off switching sequence can be synchronized overall with a master axis encoder or preferably directly with signals of a sensor system that detects the press phase and/or the forward feed of the printing substrate.

BRIEF DESCRIPTION OF THE DRAWINGS

Exemplary embodiments of the invention are illustrated in the set of drawings and will be detailed in the following.

The drawings show.

DESCRIPTION OF PREFERRED EMBODIMENTS

Figure 1A:
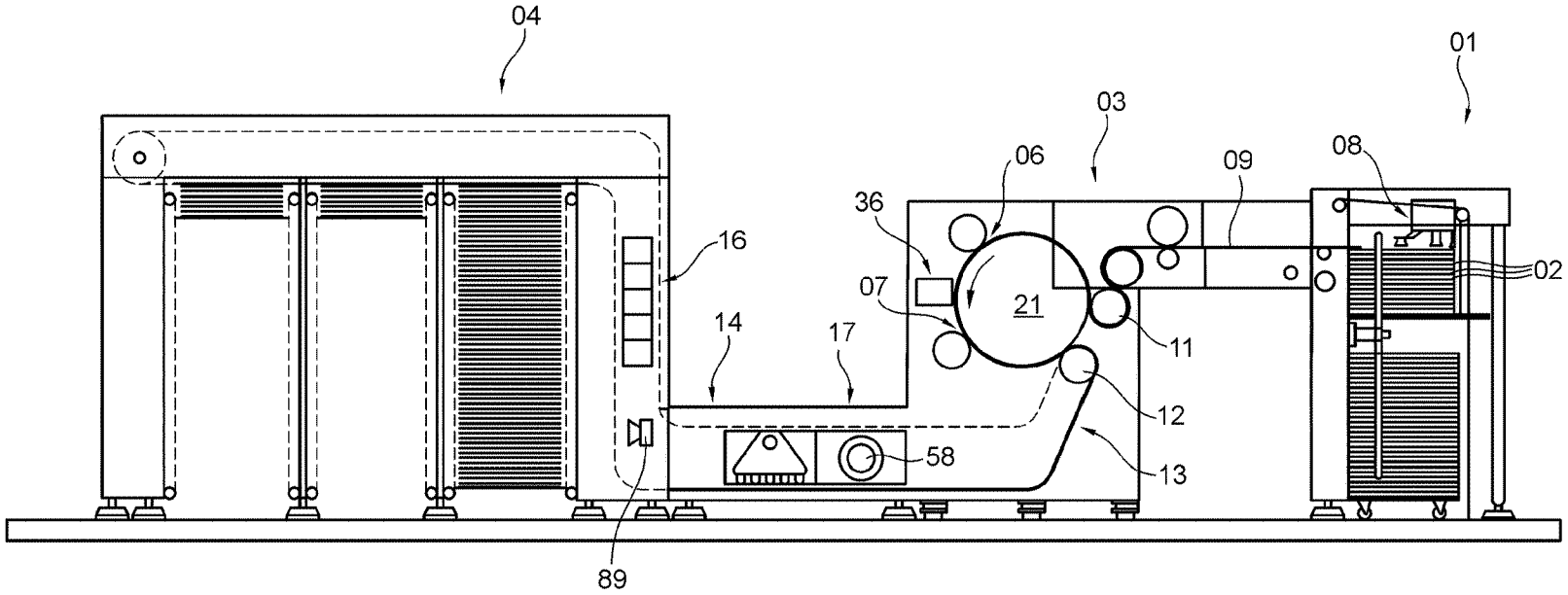
FIG. 1 an exemplary embodiment of a printing press, in particular a security printing press, comprising a printing assembly, a) in a first embodiment b) in a second embodiment and c) in a third embodiment.
Figure 1B:
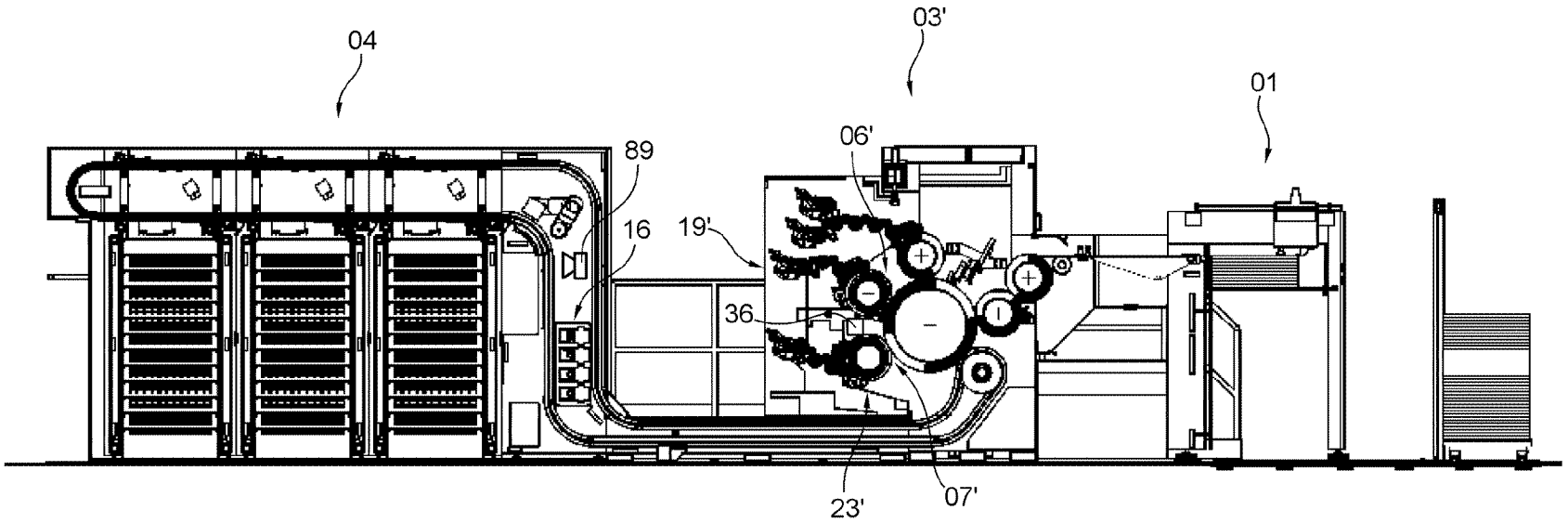
Figure 1C:
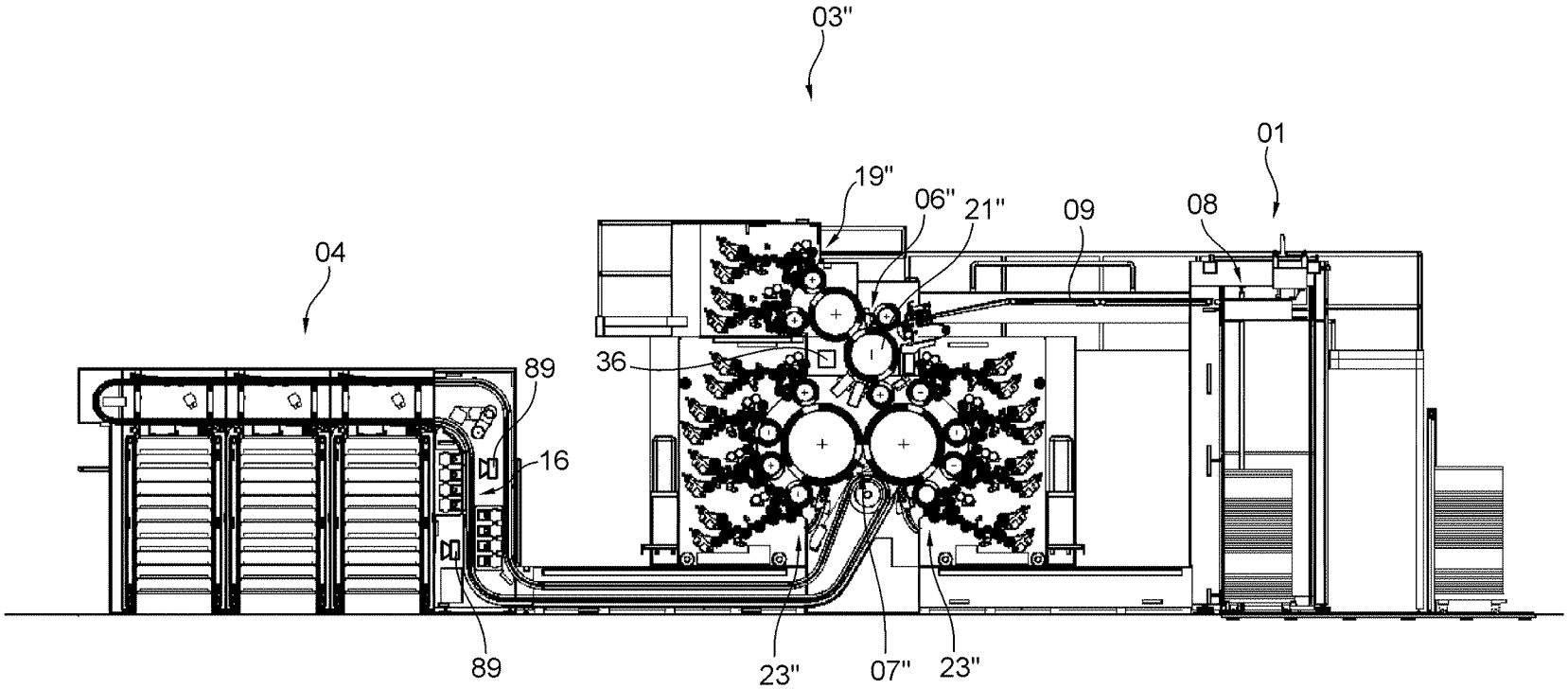

A printing press preferably embodied, e.g. as a sheet-fed printing press or optionally as a web-fed printing press comprises on the intake side an infeed device 01 that supplies the printing press with a sheet-type or web-type printing substrate 02, at least one printing assembly 03 that prints on the printing substrate 02 one or more times on one side or on both sides, and a product delivery unit 04 where printed products or intermediate products are delivered in stacks or continuously, or are wound onto a roll (see, e.g. FIG. 1*a*, FIG. 1*b* and FIG. 1*c*).

In a preferred embodiment shown in the figures, the printing press is embodied as a printing press for printing securities, for example for printing onto web-type printing substrate 02, e.g. a printing substrate web, or preferably for printing onto sheet-type printing substrate 02, e.g. printing substrate sheets 02. Infeed device 01 for the latter embodiment is configured, e.g. as a sheet feeder 01, in which a stack of printing substrate sheets 02 to be fed in and printed can be held. The term "security printing" is intended in particular to mean the printing of, e.g. banknotes or other security-relevant documents that are equipped with one or more security features and/or are produced on security paper.

The printing press is embodied as a web-fed, or preferably as a sheet-fed printing press, preferably for the printing of securities, and is configured, e.g. for producing, in one embodiment from as yet unprinted printing substrate 02, or in another embodiment from already printed printing substrate, e.g. printing substrate sheets 02, in particular security webs or more particularly, security sheets, e.g. webs or more particularly, sheets containing banknotes or other security-relevant documents as products or as intermediate products to be further processed.

In a first embodiment, which is advantageous in particular for security printing, said press is embodied as a printing press that operates—at least i.a.—according to a silkscreen and/or letterpress printing process, but in particular as a postpress machine, with which a printing substrate 02 that has already been imprinted with a grid of copies—upstream inline, or more particularly offline—is and/or can be imprinted with at least one security feature per copy and/or with an identifier that individualizes the copy in question, in a silkscreen or letterpress process.

In another described embodiment which is likewise advantageous for security printing, said press is embodied for printing, particularly in a multicolor process, onto a printing substrate 02, in particular a security paper, at a plurality of print positions, one behind the other in the printing substrate path, at least at one print position on each of the two sides.

In principle, printing assembly 03 of the printing press embodied, e.g. as a security printing press, can be configured as a printing assembly 03 that is based on any printing process and has at least one print position 06; 07; 06'; 07', e.g. as based on a letterpress process, a gravure printing process, an offset process, a screen printing process, or a plurality of the aforementioned processes in succession. In a first described embodiment, however, printing assembly 03 is embodied for printing on the printing substrate in a silkscreen or a letterpress printing process. In a described and preferred example, printing assembly 03 is configured to print onto printing substrate 02 in the area of at least one print position 06; 07 onto at least one side of the printing substrate in a screen printing process, in particular rotary screen printing. In another example, e.g. depicted schematically in FIG. 1*b*, but alternatively or, as the case may be, additionally preferred, the or optionally an additional printing assembly 03' is configured for printing onto printing substrate 02, on at least one side of the printing substrate in the area of at least one print position 06'; 07', in a letterpress printing process, in particular in what is known as the letterset process, for example using a numbering printing unit.

In a third embodiment, print images having a print image length which is shorter than the cycle length can be printed onto printing substrate 02 on at least a first of its two sides at a first print position 06" and on at least the second of its sides at a second print position 07", which is the next closest downstream, in the same cycle. An additional print position can be located upstream of said first and second print positions.

Printing substrate 02, to be printed on, e.g. in the screen printing or letterset process, is preferably embodied as printing substrate sheets 02 and/or as printing substrate 02 that has already been printed on in another printing process, and/or as security paper comprising, e.g. textile, linen, hemp and/or synthetic fibers, e.g. plastic substrates (polymer substrates) or hybrid substrates.

In the embodiment of the printing press as a sheet-fed printing press, printing substrate sheets 02 are held in reserve, e.g. as layers of a printing substrate stack, in the infeed device 01 embodied as a sheet feeder 01, from which they are picked up individually, e.g. by means of a gripper device 08 comprising suction cups, which is not shown in detail, and are conveyed separately along a conveyor line 09, e.g. along a conveyor system 09, preferably configured as a belt system 09, and, where appropriate, an infeed drum up to an intake area of printing assembly 03. At the intake into printing assembly 03, for example at a transfer drum 11, printing substrate sheet 02 is transferred to a conveyor line assigned to printing assembly 03, e.g. to a conveyor system assigned to printing assembly 03, along the transport path of which printing substrate sheet 02 passes through one or more print positions 06; 07, before entering a third, integral or multi-part conveyor line 13—for example, via a receiving drum 12—from the conveyor line assigned to printing assembly 03, or before being transferred to a third conveyor line 13, e.g. a belt system 13, and transported by said conveyor line to product delivery unit 04, e.g. a product delivery unit 04 comprising one or more sheet delivery units for pile formation.

In the case of a web-processing embodiment of the printing press, in the area of printing assembly 03 the web-type printing substrate 02 passes along a conveyor line that comprises one or more rollers and/or cylinders wrapped by the web.

In the preferred embodiment of the printing press as a sheet-processing printing press, the conveyor line assigned to printing assembly 03 is preferably configured as a gripper system, in which printing substrate sheet 02 is conveyed by successive transfers between a plurality of drums and/or cylinders, one after the other in the direction of transport along the transport path through printing assembly 03. At the end of the conveyor line configured, e.g. as a gripper system, printing substrate sheet 02 is delivered to the third conveyor line 13.

In the first embodiment, on at least one side of the conveyor line, printing assembly 03; 03' comprises at least one print position 06; 06', with which one of the sides of printing substrate 02 is or can be printed. Print position 06' can be formed by a nip point 06; 06' between two rotary bodies 18; 21, e.g. a nip point 06; 06' between a cylinder 18 of a first printing unit 19; 19' and a cylinder 21 that serves as the counter bearing for said cylinder 18, e.g. an impression cylinder and/or transport cylinder 21.

Downstream of said at least one first print position 06; 06' in the printing substrate path of printing substrate 02, more particularly in the conveyor line that follows downstream of print position 06; 06' through printing assembly 03; 03', a first rotary body 22 can be positioned downstream of print position 06; 06' in the printing substrate path, in physical contact with the printing substrate side that has been imprinted at the at least one print position 06; 06'. This rotary body 22, which cooperates with the freshly printed side of the printing substrate, can be embodied, e.g. as a guide roller and/or transport roller in the conveyor system, as a conditioning roller for cooling or heating the printing substrate, or as a cylinder 22 of a printing unit 23; 23' that follows the former printing unit 19; 19', in particular forming an additional print position 07; 07'.

A second print position 07; 07' of this type can be formed by a nip point 07' between cylinder 22 of the second printing unit 23; 23' and a cylinder that acts as a counter bearing, which is formed, e.g. by the cylinder 21 that serves first printing unit 19; 19' as an impression cylinder and/or transport cylinder 21, or by an additional cylinder, different therefrom, that acts as an impression cylinder and/or transport cylinder. One or more additional printing units of this type that act on this same side of the printing substrate, and/or one or more additional printing units that act on the other side of the printing substrate can also be provided upstream or downstream in the printing substrate path of the printing press and/or of printing assembly 03.

In the printing substrate path, downstream of the at least one print position 06; 07; 06'; 07', at least one dryer device comprising a dryer 14; 16; 36 is provided, by means of which printing fluid applied to printing substrate 02, e.g. printing ink, varnish or other coating media, is or can be at least superficially dried. Such a dryer device may be provided between a printing unit 19 and a downstream rotary body 22 that cooperates with the freshly printed printing substrate side, e.g. as an intermediate drying device between printing unit 19; 19' and printing unit 23; 23' downstream, and may comprise a dryer 36 directed toward the printing substrate path. In place of or preferably in addition to this, at least one dryer device may be located in the printing substrate path downstream of the sole or last printing unit 19; 19'; 23; 23', i.e. printing assembly 03; 03', and may comprise a dryer 14; 16 directed toward the printing substrate path.

In the printing substrate path between two printing units 19; 19'; 23; 23' or in the printing substrate path downstream of the last printing unit 19; 19'; 23; 23' of printing assembly 03; 03', a conditioning device 17 that varies the optical impression of the applied printing fluid—particularly in the incompletely dried state—can be provided. Said device can be embodied, for example, as a device 17 that acts on printing substrate 02 in a directed fashion with magnetic field lines, and the printing fluid can comprise particles that can be aligned using magnetic field lines, for example magnetizable or magnetically active pigments.

Figure 2:
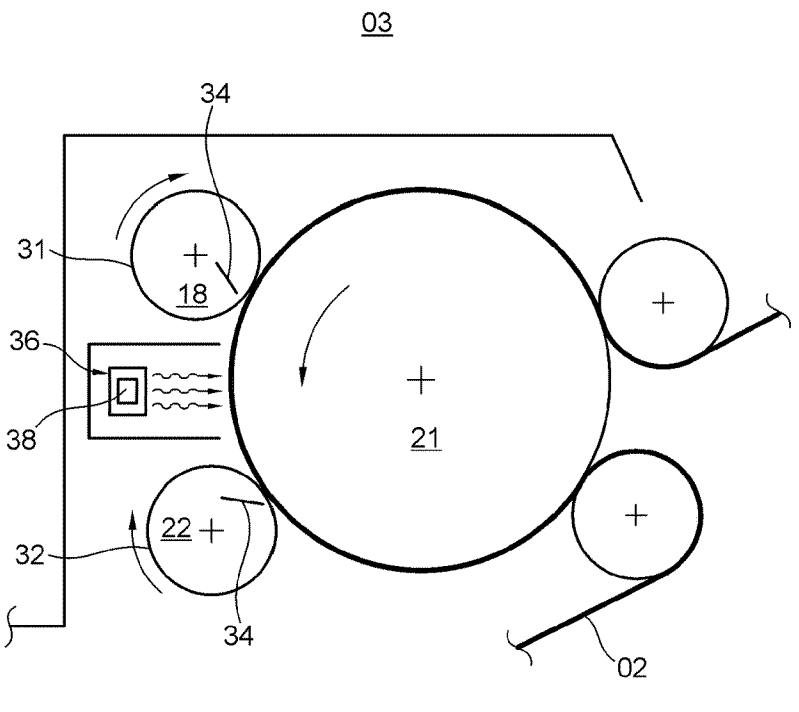
FIG. 2 an enlarged, more detailed depiction of the exemplary embodiment, by way of example, of a printing assembly of FIG. 1 in a) a sheet processing embodiment and b) a web processing embodiment.
Figure 2:
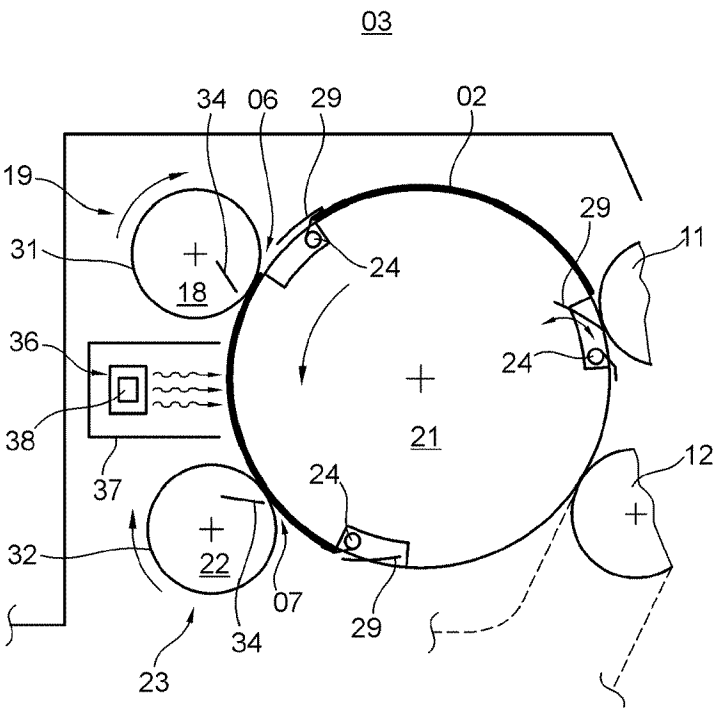

In one advantageous embodiment, explicitly shown here (e.g. FIG. 1*a*, FIG. 2), the at least one printing unit 19, and more particularly also the at least one additional printing unit 23 that cooperates with the same side of the printing substrate, is embodied as a printing unit 19; 23 that operates according to the screen printing method, or as screen printing unit 19; 23 for short, and the imaging cylinder 18; 22 that is assigned to printing unit 19; 23 is embodied as a forme cylinder 18; 22, more particularly what is known as a screen cylinder 18; 22.

Screen cylinder 18; 22 rolls along the lateral surface of impression cylinder and/or transport cylinder 21, and in the area of its aforementioned nip point 06; 07 with impression cylinder and/or transport cylinder 21, forms print position 06, 07. In the region of its lateral surface, screen cylinder 18; 22 comprises a screen printing stencil 31; 32 as a printing forme 31; 32, arranged concentrically to the real or imaginary cylinder axis. In the mounted state, said stencil is releasably fastened at the end face, for example, to ring flanges, not shown in detail. Screen printing stencil 31; 32 can be embodied, in principle, as a continuous screen printing stencil in the shape of a cylindrical shell or sleeve, or as a finite screen printing stencil 31; 32 which, in the mounted state, is nevertheless circumferentially closed, forming a small butt joint.

Inside forme cylinder 18; 22, a squeegee 34 of a squeegee device 33 is provided, which in the thrown-on state is set against screen printing stencil 31; 32 from the inside, in a circumferential region of screen cylinder 18; 22 in which said stencil forms print position 06; 07 with the impression and/or transport cylinder 21. This point can be provided, for example, a maximum of 5° in front of or behind the nip point 06; 07 with impression cylinder and/or transport cylinder 21—with respect to the operational direction of rotation. The squeegee 34 thrown on in this manner accumulates a bead of printing ink, which it rolls in front of it and forces through the permeable areas of screen printing stencil 31; 32 toward the outside.

In order to enable the quickest possible resumption of printing in the subsequent circumferential section $U_D$, e.g. circumferential section $U_D$, once an interruption 28, e.g. an opening 28, in impression cylinder and/or transport cylinder 21 has passed through nip point 06; 07, for the temporary and at least partial covering of opening 28 an aforementioned inking aid 29, e.g. a cover element 29 configured as a flap 29, can be provided, by means of which the opening 28 can be temporarily covered, at least in the leading area of opening 28. This allows the squeegee 34, which is lifted off during the passage of the open region of opening 28 through the nip point, for example, to be thrown on in advance. Cover element 29 can overlap slightly with the uninterrupted section of the cylindrical lateral surface, for example, and in that case shortens the length of the maximum circumferential section $U_D$ that is usable for printing. This geometric shortening is more than compensated for by throwing the squeegee on in advance, for example. By throwing the squeegee on in advance, a beginning of a printing area on the leading side—with respect to rolling during operation—can ideally be immediately adjacent to cover element 29, but optionally also with a slight stand-off distance. A lengthening of the circumferential section $U_N$ that is not usable for printing beyond the leading edge of the opening, which lengthening results from the slight overlap, for example, and optionally from a slight stand-off distance following cover element 29, and/or the distance between the earliest possible beginning of the printing area and the trailing edge of the opening can be between 10 mm and 50 mm, for example, preferably no more than 30 mm.

Figure 3:
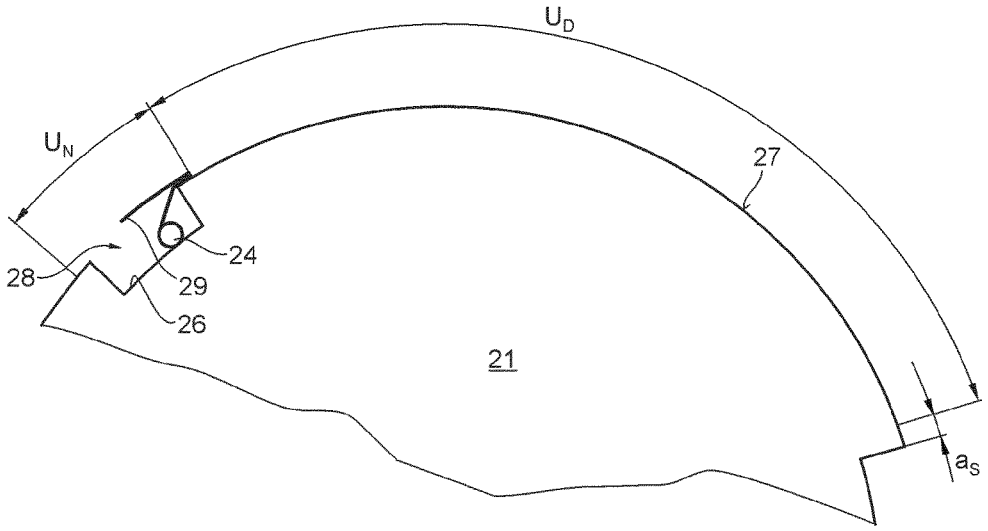
FIG. 3 a schematic cross-sectional diagram of an impression cylinder segment and/or transport cylinder segment.
Figure 4:
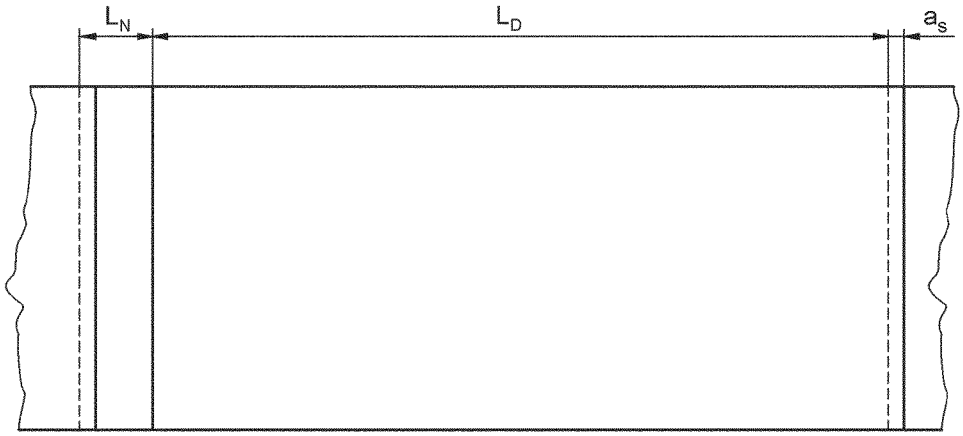
FIG. 4 a schematic diagram of an unrolled lateral surface segment of the impression cylinder and/or transport cylinder.

The maximum length $L_D$ that is usable for printing is limited by the earliest possible beginning of the printing area, determined by the press and/or by safety considerations, and the latest possible end of the printing area on the trailing side, determined by the press and/or by safety considerations. In principle, the latest possible end of the printing area can coincide with the leading end of the subsequent opening 28, e.g. the leading opening edge of the subsequent opening 28, or—e.g. for reasons of safety and/or the risk of contamination and/or based upon function—can be spaced by a distance $a_S$ to be maintained from the trailing edge of the following pit opening (see e.g. as schematically illustrated in FIG. 3 and FIG. 4). The maximum length $L_D$ that is usable for printing can be limited, for example, by the length of the undisrupted circumference on the counter bearing, e.g. the impression cylinder and/or transport cylinder 21, or by other press elements that are involved in printing and/or transport, or by the maximum length that is usable for printing, as viewed in the transport direction and/or circumferential direction, of the printing formes 31; 32 provided for the printing unit 19; 23; 19'; 23'; 19"; 23", in the following also referred to as the printing length. These sizes are usually synchronized with one another and correspond substantially to one another.

In a single-sized embodiment of impression cylinder and/or transport cylinder 21, the succeeding pit opening is understood as the same single pit opening.

In the embodiment of the printing press as a printing press for processing sheets, the at least one impression cylinder and/or transport cylinder 21 comprises at least one retaining device 24 on its circumferential surface, e.g. a gripper device 24 comprising one gripper or a group of multiple grippers, by means of which the leading end of a printing substrate sheet 02 can be picked up on the intake side and can be delivered to the conveyor line downstream on the output side. Gripper device 24 in this case is located, e.g. in a pit 26 provided in the otherwise cylindrical lateral surface 27 of cylinder 21, with the radially outwardly directed opening 28 of said pit, e.g. pit opening 28, interrupting and disrupting the cylindrical shell-shaped lateral surface 27.

In an embodiment of impression cylinder and/or transport cylinder 21 that is configured to receive, e.g. a number n ($n \in \mathbb{N}$) of printing substrate sheets 02, in this case, for example, n=3, one behind the other in the circumferential direction, said cylinder comprises multiple retaining devices 24 of this type, i.e. n devices, in this case, e.g. three, one behind the other in the circumferential direction, and a cylindrical shell-shaped circumferential section lying between each of these (see, e.g. FIG. 2*a*). In the case of a web-processing embodiment of the printing press, such retaining devices can be dispensed with (see, e.g. FIG. 2*b*). In more colloquial terms, the n-sized cylinder 21 comprises n circumferential sections Up that can each be used without interruption for printing.

Regardless of the type and the number n of retaining devices 24 that are provided in the circumferential direction in the case of sheet printing, an interruption of the otherwise uninterrupted, cylindrically shaped lateral surface 27 is caused by the respective pit opening 28 on the circumferential surface of the impression cylinder and/or transport cylinder 21.

In an n-sized, i.e. a single-sized or multiple-sized embodiment, impression cylinder and/or transport cylinder 21, as viewed in the circumferential direction, comprises n, i.e. one or more circumferential sections $U_D$, in particular cylindrical circumferential sections $U_D$, that can be used as a counter bearing during printing, and n, i.e. one or more circumferential sections $U_N$ that have an interrupted lateral surface 27, which comprise retaining devices 24 and cannot be used as a counter bearing during printing. The circumferential sections $U_D$ that can be used as a counter bearing during printing are also colloquially referred to as "saddles".

The circumferential section $U_N$ that comprises opening 28 and is not suitable and/or intended for printing has an effective length $L_N$ when rolled along the continued circumferential line which is equivalent to the length of the arc that extends over the opening. The circumferential section $U_N$ that is usable for printing therefore has a length $L_N$ that at the same time limits the maximum possible length L44 of the print image.

The circumferential section $U_N$ that cannot be used as a printing counter bearing can, in principle, be constituted solely by opening 28 of pit 26 that accommodates retaining device 24, or if applicable, by said opening 28 and—if provided—a functional section that adjoins said opening on the leading and/or the trailing side, for example an overlap area of an inking aid 29 (see below), optionally provided on the leading side, and/or a distance from the trailing edge of the pit opening that follows it, to be maintained by fixation. Conversely, the circumferential section $U_D$ that is usable for printing can be constituted, in principle, by the cylindrical outer surface section between a leading end of interruption 28, for example, the leading end of opening 28, and the trailing end of the same opening or the next opening 28 that follows in the circumferential direction. If the contour that delimits the disruption on lateral surface 27 on the leading and/or the trailing side is irregular in configuration, the length $L_N$ of the circumferential section $U_N$ that cannot be used during printing is understood, for example, as the arc length, as viewed in the circumferential direction, between the first point on the leading side and the last point on the trailing side of interruption 28 in the uninterrupted lateral surface 27, determined by the same retaining device 24.

Screen printing unit 19; 23 can be used for imprinting printing substrate 02, for example, which has been imprinted with a grid of copies in a plurality of rows and columns, with print image elements 56, or image elements 56 for short, or groups having a structure comparable to that of image elements 56, for each copy.

Figure 5:
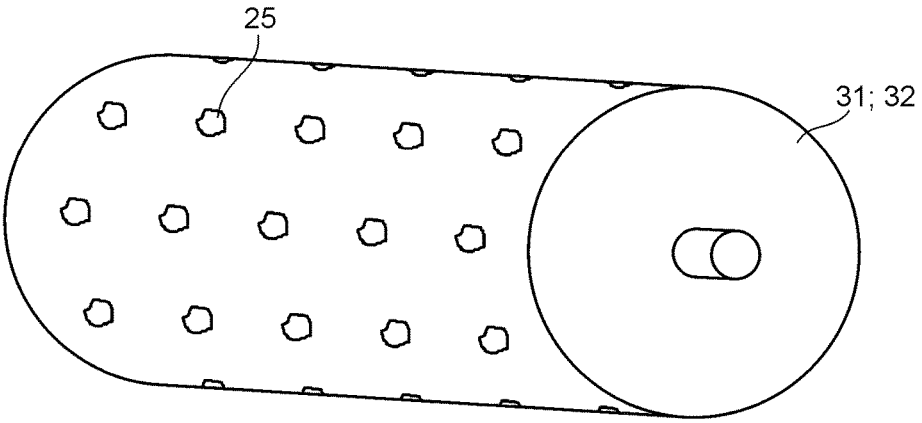
FIG. 5 a schematic oblique view of an imaging cylinder with image-producing printing elements, by way of example, as subjects on a) a screen cylinder, and b) a numbering cylinder.
Figure 5:
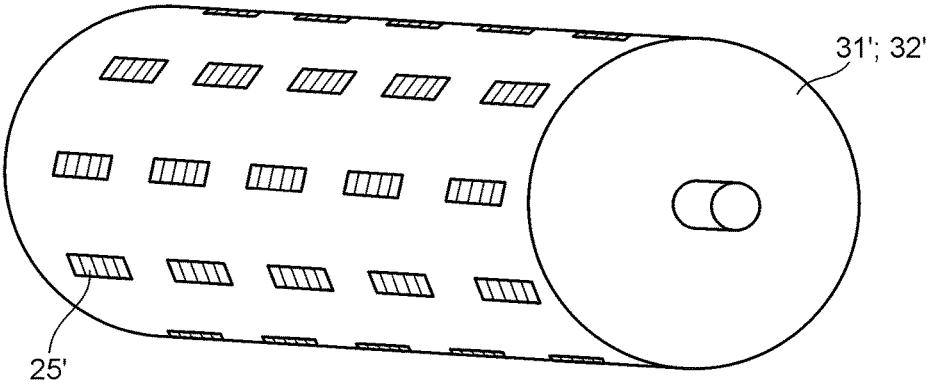

For screen printing, imaging cylinder 18; 22 carries, e.g. a plurality of image-producing printing elements 25 or groups of image-producing printing elements 25 on its periphery (e.g. FIG. 5*a*), which are arranged in a plurality of columns spaced equidistant from one another transversely to the direction of transport and in a plurality of rows spaced equidistant from one another across a cylinder width that corresponds to the print image width. In the case of screen printing, these printing elements are constituted, for example, by subjects 25, which are formed by ink-permeable areas. These printing elements 25 or groups, which repeat in the circumferential direction and in the longitudinal direction of the cylinder, can all be constituted, for example, by the same integral or multi-part motif.

In a likewise advantageous embodiment (shown, e.g. in FIG. 1*b*, FIG. 5*b*), the at least one printing unit 19' and, in particular, also the at least one additional printing unit 23' that cooperates with the same side of the printing substrate is embodied as a printing unit 19'; 23', e.g. a numbering printing unit 19'; 23', that operates according to a letterpress printing process, in particular the letterset process, and the imaging cylinder 18'; 22' assigned to printing unit 19'; 23' is embodied as a forme cylinder 18'; 22', in particular as what is known as a letterpress cylinder 18'; 22', e.g. as a numbering cylinder. In the arrangement described above, said cylinder has on its periphery printing elements 25' embodied as letterpress subjects 25', in particular printing elements 25' embodied as a numbering device 25', or groups of such image-producing printing elements 25', e.g. numbering modules 25'. In the embodiment as a numbering printing unit, the printing unit comprises a number of numbering devices 25', arranged offset from one another transversely to the direction of transport, that corresponds, for example, to at least the number of columns of copies 57, e.g. banknotes, provided side by side on printing substrate 02. The above statements relating to the circumferential sections $U_D$; $U_N$ that are suitable and unsuitable for printing can also be applied accordingly to this embodiment.

The at least one dryer device comprises a dryer 14; 16; 36, preferably embodied as a radiation dryer 14; 16; 36. Said dryer comprises a drying means 38 for the purpose of drying, e.g. a radiation source 38, by means of which a drying medium can be applied to printing substrate 02 for the purpose of drying the same. In principle, drying means 38 or radiation source 38 can be embodied as integral and, when activated, can form an active zone A that extends continuously across an entire active width $b_A$. The entire active width $b_A$ corresponds, for example, to at least a maximum printing width—in the transverse direction (e.g. indicated in the figures by a direction x).

As active drying means 38, the dryer device preferably comprises a plurality I of dryer elements $\mathbf{38}_k$ ($k=\{1, 2, \ldots I\}$, $I \in \mathbb{N} \geq 2$), by means of which, as viewed in plane $E_{02}$ of the printing substrate path at the site of cooperation, a plurality of active zones $a_j$ ($j=\{1, 2, \ldots n\}$, $n \in \mathbb{N} \geq 2$), e.g. drying zones $a_j$ ($j=\{1, 2, \ldots n\}$, $n \in \mathbb{N} \geq 2$), offset from one another transversely to the direction of transport of the printing substrate, i.e. in the transverse direction, more particularly spaced, over an active width $b_j$ in each case, e.g. drying or track width can be acted upon by drying medium, for example radiation, and/or comprises a plurality of dryer elements $\mathbf{38}_k$ arranged offset from one another transversely to the direction of transport of the printing substrate.

Through the active or drying zones $a_j$ of dryer elements $\mathbf{38}_k$, which are spaced from one another in the transverse direction, printing substrate 02 passing through the dryer 14; 16; 36 is acted on by the drying medium, preferably radiation, more particularly UV radiation, in a plurality of tracks $t_i$ ($i=\{1, 2, \ldots m\}$, $m \in \mathbb{N} \geq 2$, in which preferably i=j and m=n) that are spaced from one another transversely to the direction of transport with respect to the printing substrate path, without interruption or preferably clocked one or more times in the manner described here for each cycle Z, as described in detail below.

Active width $b_j$ is understood as the width in the transverse direction across which the radiation profile extending through the maximum beam packet proceeding from the dryer element $\mathbf{38}_k$ in question has dropped to 50% of the maximum value on both sides with respect to area-based radiant output. For cases that do not involve a sharply defined boundary with an infinitely steep slope, this is understood here as the lateral boundary of the corresponding active zone $a_j$.

Dryer elements $\mathbf{38}_k$ are preferably embodied as radiation sources $\mathbf{38}_k$ ($k=\{1, 2, \ldots I\}$, $I \in \mathbb{N} \geq 2$) of electromagnetic radiation, e.g. light, in particular UV light, i.e. light for which at least the largest proportion of emitted radiant output lies in the UV spectral range, e.g. between 100 nm and 380 nm. In principle, dryer elements $\mathbf{38}_k$ could also be embodied differently, e.g. as individual blowing elements, comprising one or more nozzle openings, of a dryer 14, 16; 36 embodied as a convection dryer and/or hot-air dryer, by means of which the printing substrate can be acted on, for example, by fluid, e.g. air, as a drying medium.

Figure 6:
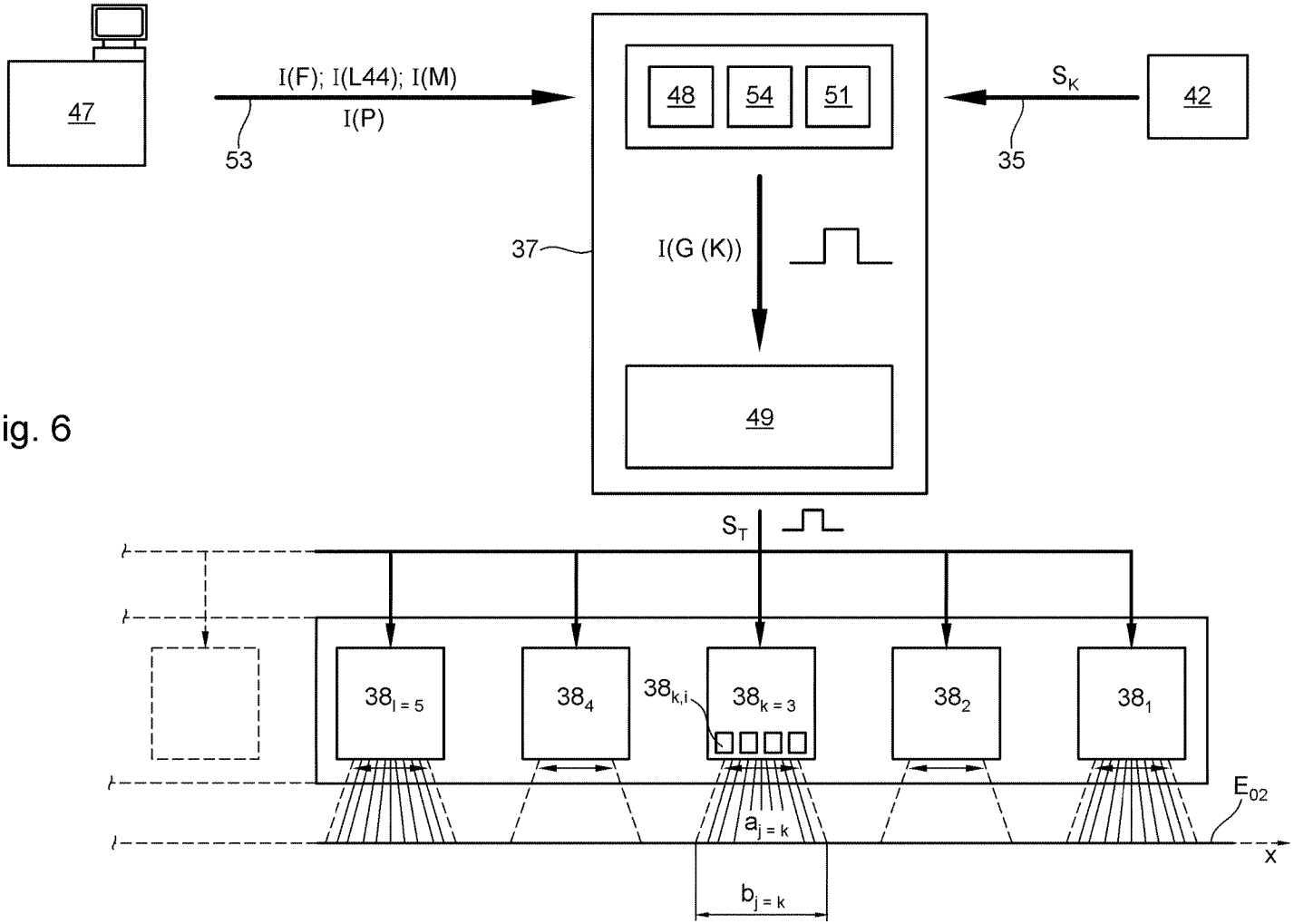
FIG. 6 a schematic diagram of a first embodiment of a dryer device comprising a control system and a dryer.

In a first embodiment, dryer elements $\mathbf{38}_k$ can each be formed, in principle, by individual drying medium sources $\mathbf{38}_{k,i}$, e.g. by beam sources $\mathbf{38}_{k,i}$, in particular radiation sources $\mathbf{38}_{k,i}$ themselves, or preferably by groups $\mathbf{38}_k$ of such beam or radiation sources $\mathbf{38}_{k,i}$ associated with one another, e.g. to be switched on and off collectively and/or simultaneously. In a first embodiment, these groups $\mathbf{38}_k$ can be already permanently formed and can be switched on and off only as an entire group, but can be displaceable, e.g. as group $38_k$, e.g. on a component configured as a type of dryer head, in the transverse direction—preferably by a motorized mechanism (see, e.g. FIG. 6). In that case, one, multiple, or all of dryer elements $38_k$ can be displaceable transversely to the designated direction of transport for printing substrate 02.

Figure 7:
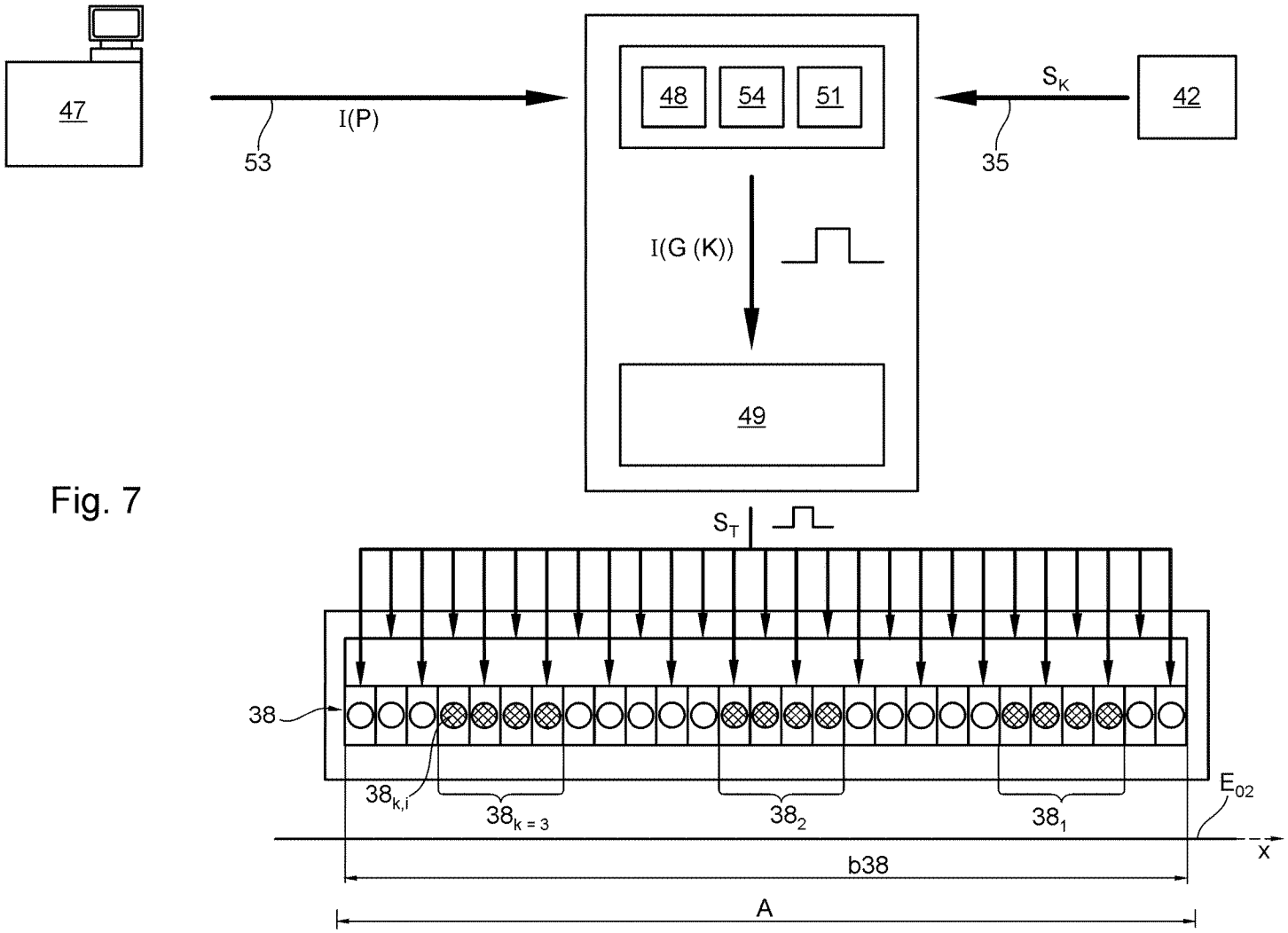
FIG. 7 a schematic diagram of a second embodiment of a dryer device comprising a control system and a dryer.

In an advantageous second embodiment, groups $38_k$ can be variably formed and/or formable for different production runs from a plurality of individual beam or radiation sources $38_{k,i}$ of drying means 38, in which case during operation, the individual beam or radiation sources $38_{k,i}$ to be allocated to a group $38_k$ preferably nevertheless always are and/or always can be activated and deactivated simultaneously, more particularly collectively, during the same production run (see, e.g. FIG. 7). In a variant which is advantageous particularly in conjunction with the first embodiment of the printing press, all of the individual beam or radiation sources $38_{k,i}$, arranged side by side, of the groups $38_k$ spaced from one another are activated and deactivated simultaneously, more particularly collectively. In at least the second multi-part embodiment of drying means 38, a plurality of beam or radiation sources $38_{k,i}$, e.g. at least 50, are preferably arranged offset from one another. In particular, as viewed in the transverse direction, a large number in proportion to length, for example at least 50/m, more particularly at least 70/m based on the length of one meter, of beam or radiation sources $38_{k,i}$ that are offset relative to one another in the transverse direction are provided. The activation and deactivation of individual beam or radiation sources $38_{k,i}$ or of beam or radiation sources that are fixedly or variably combined into groups is preferably carried out by means of a control system 37 assigned to dryer 14; 16; 36.

The beam or radiation sources $38_{k,i}$ that individually or in groups form dryer elements $38_k$ are preferably embodied as UV light sources as described above, in particular as UV diodes, or UV LEDs for short.

Figure 8:
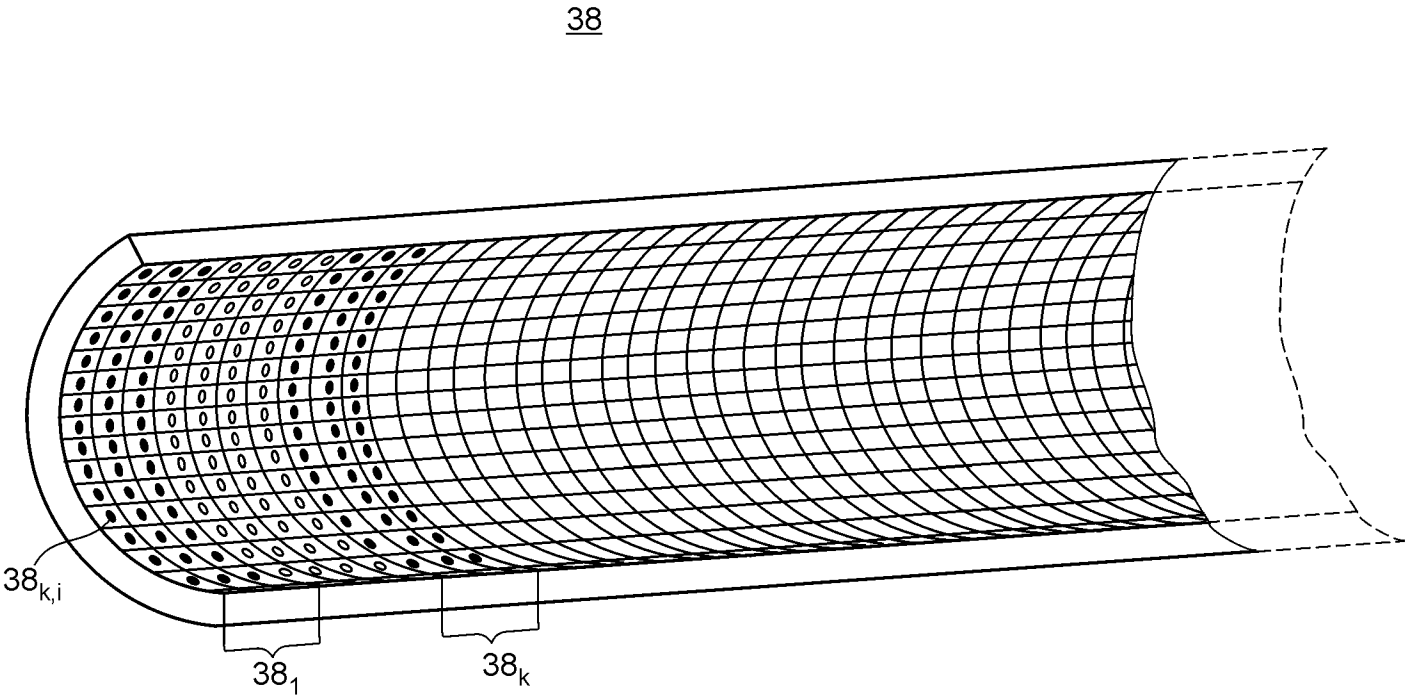
FIG. 8 an oblique view of the embodiment of a drying means having a plurality of rows, arranged one behind the other, each containing a multiplicity of radiation sources arranged side by side.

In an advantageous refinement of drying means 38, the latter is embodied as a—structurally integral or multi-part—radiation source array, in particular an LED array, having a plurality of rows, extending one behind the other as viewed along the transport path, i.e. the printing substrate travel path, and extending across at least the maximum printing substrate width $B02_{max}$, each row having a plurality of radiation sources $38_{k,i}$, in particular UV LEDs (see, e.g. FIG. 8). Groups $38_k$ that are formed therefrom each comprise one or more longitudinal rows side by side, each having a plurality of radiation sources $38_{k,i}$, in particular UV LEDs, arranged one behind the other as viewed along the transport path. In a simple embodiment, a simultaneous and/or collective switching on and off of the radiation sources $38_{k,i}$ related to the groups can be carried out and/or embodied as an actually simultaneous and/or collective switching on and off of all of the radiation sources $38_{k,i}$ of groups $38_k$, including those arranged one behind the other. In an advantageous embodiment of the case involving the multi-dimensional arrangement of radiation sources $38_{k,i}$, the simultaneous and/or collective switching on and off is based on the passage of the printing substrate 02 for the row in question. In that case, the radiation sources $38_{k,i}$ included in the involved groups are switched "simultaneously and/or collectively" in such a way that the radiation sources $38_{k,i}$ to be switched are switched on and off simultaneously and/or collectively by rows, in correlation with the printing substrate feed rate. The rows are thereby switched on and off in succession, in synchronism with the forward feed of the printing substrate.

In a refinement that is less complex in terms of circuitry, a plurality of radiation sources $38_{k,i}$ as viewed in the transverse direction, e.g. LEDs $38_{k,i}$, in particular UV LEDs $38_{k,i}$, or a plurality of longitudinal rows of radiation sources $38_{k,i}$, in particular longitudinal rows of LEDs $38_{k,i}$, can be operatively connected to the same switching element, via which they can be switched on and off only collectively as a fixed subgroup, and which are in turn to be combined to form the group $38_k$ of radiation sources $38_{k,i}$ to activated and deactivated collectively and/or simultaneously. The resolution of the irradiation is thereby decreased in the transverse direction; however, this is acceptable for some applications.

The smallest switchable unit, e.g. as viewed in the transverse direction, can be referred to here as a radiation segment—irrespective of whether this comprises merely a single radiation source $38_{k,i}$ widthwise or a longitudinal row of radiation sources $38_{k,i}$, or even a plurality of individual radiation sources $38_{k,i}$ or a plurality of longitudinal rows of radiation sources $38_{k,i}$.

In principle, the drying device that comprises dryer elements $38_k$ and control system 37 can be configured as having an arrangement of dryer elements $38_k$ that is fixed in the transverse direction and is displaceable laterally only for the purpose of aligning the dryer, and/or can be configured as having an integral or multi-part drying means 38, with which an active zone A extending continuously across an entire active width $b_A$ is or can be formed.

However, the drying device that comprises dryer elements $38_k$ and control system 37 is preferably configured such that, in at least one operating situation, as viewed in the transverse direction, radiation that effectuates or at least supports drying can be applied by one or more of dryer elements $38_k$ to a plurality of section widths, e.g. tracks $t_i$, that are spaced from one another, the irradiated section widths or tracks $t_i$ being interrupted by sections or tracks that are not irradiated. In this case, each of the irradiated section widths or tracks $t_i$ can be formed by just one or by a plurality of mutually adjacent drying zones $a_j$. The radiation profile that varies in this manner in the transverse direction with irradiated and non-irradiated sections or tracks $t_i$ can be achieved, for example, by positioning displaceable dryer elements $38_k$ with appropriate spacing and/or preferably by activating dryer elements $38_k$ in sections. In that case, dryer elements $38_k$ can be in the form of radiation sources $38_k$ or groups $38_k$ of individual radiation sources $38_{k,i}$, as described above, which can be fixedly defined or can be variably defined, depending on the production run.

In the first embodiment comprising displaceable dryer elements $38_k$, a plurality or all of dryer elements $38_k$ are preferably displaceable in such a way that positions of the active or activatable dryer elements $38_k$ and/or spacings between the section widths that are irradiated by dryer elements $38_k$—preferably up to a spacing of zero or even a slight overlap—can be varied according to the characteristics of the printed product. For this purpose, dryer elements $38_k$ can be movable and/or moved manually or in a motorized fashion in the transverse direction. In a more highly automated embodiment, dryer elements $38_k$ can be or are positioned in the transverse direction automatically by means of control system 37.

This printed product-based configuration of the dryer device in the second embodiment, here a selecting and/or selection and/or positioning of dryer elements $38_k$ by means of control system 37, can be carried out here on the basis of production-related data P, e.g. regarding the number and/or size and/or lateral position of copies on the printing substrate 02, that are input or selected manually—e.g. by press operators at a user interface 55—or based on production-related data that are obtained from a production plan or from an inspection. For this purpose, these data P that characterize the production run in terms of the positioning and/or formation of dryer elements $\mathbf{38}_k$ are supplied in the form of appropriately prepared information I(P) to control system 37, where they are processed, for example, in control means 48 configured for this purpose, e.g. computing and/or data processing means 48, to produce signals relating to the respective positioning. The data P and/or information I(P) can be obtained, in a manner explained in greater detail below, from data supplied by press operators at user interface 55, from data imported from the production plan, or from data that come from an inspection system or are supplied in parallel to the inspection system. The signals relating to positioning can then be sent, for example, to one or more drives provided for positioning. If not all of dryer elements $\mathbf{38}_k$ are required in each case, information (I(G(k)) about the dryer elements $\mathbf{38}_k$ to be activated, obtained from printed product-based characteristics, can be considered in actuating the beam or radiation sources $\mathbf{38}_{k,i}$ in that, for the production run in question, for example, only the selection G(k) of groups $\mathbf{38}_k$ or dryer elements $\mathbf{38}_k$ designated in this manner can be switched to an activatable status and/or activated.

In the second embodiment of drying means 38 with dryer elements $\mathbf{38}_k$, which are provided in the form of groups $\mathbf{38}_k$ of beam or radiation sources $\mathbf{38}_{k,i}$, formed or to be formed based on the printed product, the position and/or size of irradiated section widths and/or distances between section widths that are irradiated by dryer elements $\mathbf{38}_k$ can be varied due to the fact that, for example, from the totality of beam or radiation sources $\mathbf{38}_{k,i}$ arranged across the width b38, specific groups $\mathbf{38}_k$ of beam or radiation sources $\mathbf{38}_{k,i}$ that will be activated or are activated, between which groups of beam or radiation sources $\mathbf{38}_{k,i}$ that will not be activated or are inactive are arranged, are formed based upon the product-based characteristics. This also includes an embodiment in which smaller groups of beam or radiation sources $\mathbf{38}_{k,i}$ are combined in accordance with the printed product-based characteristics to form a plurality of overlapping groups $\mathbf{38}_k$.

The printed product-based configuration of the dryer device in the second embodiment, in this case a designation of the sections to be exposed or to be acted on, i.e. the selection or definition of beam or radiation sources $\mathbf{38}_{k,i}$ that will be or are activated, for the formation of groups $\mathbf{38}_k$ to be activated, can also be carried out manually in this case—e.g. by press operators at a user interface 55—, e.g. by manual selection, or with computer assistance based upon data that are entered or selected manually. Examples of this will be set out in detail below.

Additionally or alternatively, the designation may be made based upon production-related data P. The production-related data P or information I(P) can be obtained, in a manner to be described in greater detail below, from data supplied by press operators at user interface 55, from data imported from the production plan, or from data that come from an inspection system or are supplied in parallel to the inspection system. The data P from the production plan or the inspection system are supplied to the control system, e.g. via a data interface 59, and comprise data regarding product-based characteristics, e.g. the number and/or size and/or position of copies on printing substrate 02. In a more highly automated embodiment, such data are supplied—for example via a data interface—in the form of information I(P) concerning product-based characteristics to control system 37, where said data are used, for example, by appropriately configured control means 48, e.g. computing and/or data processing means 48, to form the groups $\mathbf{38}_k$ of beam or radiation sources $\mathbf{38}_{k,i}$ that can or will be activated for the production run in question. For instance, information I(G(x)) obtained from printed product-based characteristics can be considered in the actuation of the beam or radiation sources $\mathbf{38}_{k,i}$ via the groups $\mathbf{38}_k$ or dryer elements $\mathbf{38}_k$ that are formed and are to be activated from subgroups of the beam or radiation sources $\mathbf{38}_{k,i}$ in that only the selection G(x) of beam or radiation sources $\mathbf{38}_{k,i}$ that is designated in this manner can be activated for the production run in question, for example.

The selective activation of dryer elements $\mathbf{38}_k$ or of the beam or radiation sources $\mathbf{38}_{k,i}$ themselves that are combined into groups $\mathbf{38}_k$ is implemented, in accordance with the selection that is made, for example, in a dryer controller 49, which switches the dryer elements $\mathbf{38}_k$ or beam or radiation sources $\mathbf{38}_{k,i}$ and is optionally spatially included in the dryer 14; 16; 36. The product-relevant selection or the information I(G(k); I(G(x)) concerning this selection and/or formation of groups $\mathbf{38}_k$ can also form the basis for an overlapping in this regard, in the case of a switching that varies and/or is clocked in the direction of transport described below (e.g. indicated in the figures by a direction y), so that an activation and deactivation that is varied or clocked in terms of length and/or position is carried out in each case only for the dryer elements $\mathbf{38}_k$ that have been selected and, if applicable, positioned based on the product, and/or dryer elements that are combined to form groups $\mathbf{38}_k$ of beam or radiation sources $\mathbf{38}_{k,i}$ to be activated.

Figure 9:
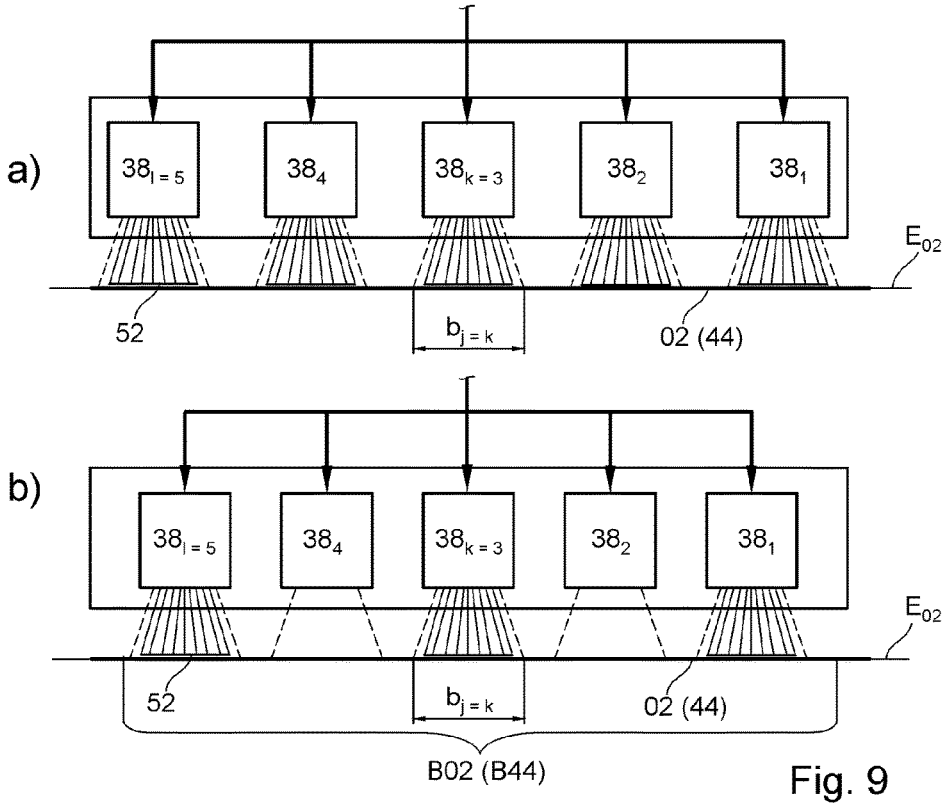
FIG. 9 a schematic diagram showing the positioning and/or selection of drying elements in the first embodiment.

In the case of the first embodiment of drying means 38, for example, in a first operating situation (e.g. FIG. 9*a*) involving, for example, a first printing substrate width or printing area width B02; B44 and/or a first profile of transversely extending printing nips 52 of a printing area 44, which is interrupted by strips not to be imprinted, a first selection and/or positioning of dryer elements $\mathbf{38}_k$ can be activatable or activated, and in a second, second operating situation, which differs from the first operating situation in terms of the printing substrate width and/or the printing area width B02; B44 and/or in terms of the profile (e.g. FIG. 9*b*), dryer elements $\mathbf{38}_k$ that differ from the first operating situation in terms of selection and/or positioning can be activatable or activated.

Figure 10:
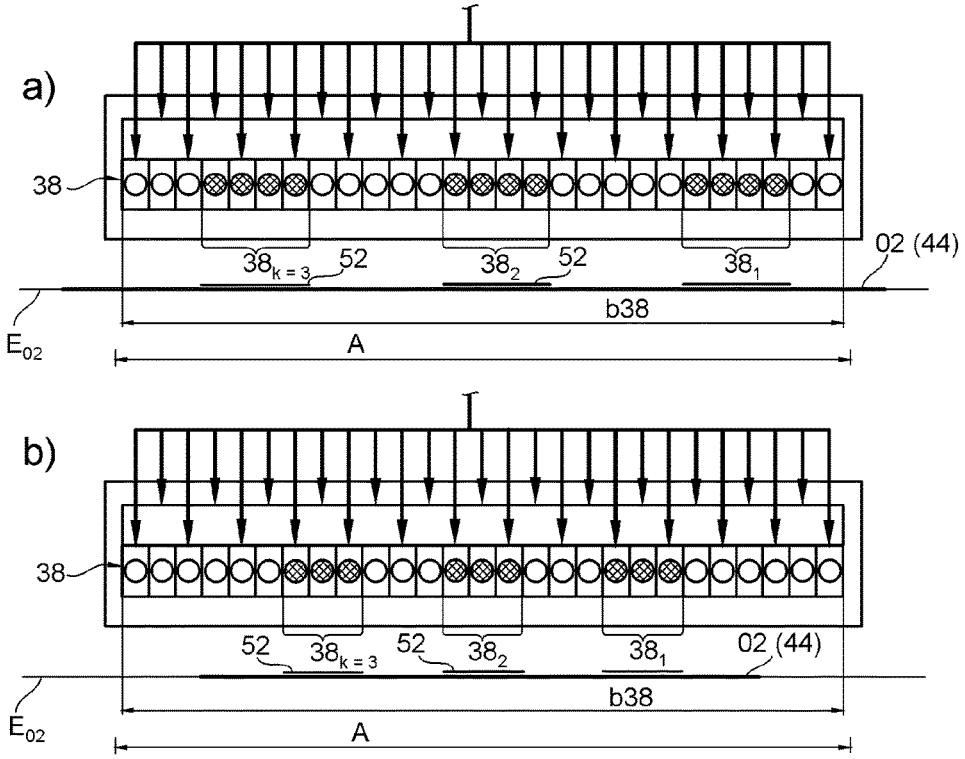
FIG. 10 a schematic diagram showing the formation of drying elements in the second embodiment, implemented by the formation of groups.

In the case of the second embodiment, in a first operating situation (e.g. FIG. 10*a*) involving, for example, a first printing substrate width B02 and/or a first profile of printing nips 52, extending in the transverse direction, of a printing area 44, which is interrupted by columns not to be imprinted, a first selection of beam or radiation sources $\mathbf{38}_{k,i}$ that are combined to form groups $\mathbf{38}_k$ can be activatable and/or activated, and in a second, second operating situation that differs from the first operating situation in terms of the printing substrate width B02 and/or the profile (e.g. FIG. 10*b*), beam or radiation sources $\mathbf{38}_{k,i}$ that differ from the first operating situation in terms of the selection can be activatable or activated.

A printing nip 52 is understood as printing strips that extend in the direction of transport and are limited on both sides by strips that extend in the direction of transport and are not imprinted in the printing assembly 03 or the printing unit 19; 23 in question, and that have a strip width that exceeds, e.g. the dimension of individual pixels or color points, e.g. a width of more than 5 mm, in particular more than 10 mm. However, printed strips that are interrupted by, e.g. such non-imprinted narrow strips of at least 5 mm are or can be combined, despite their discontinuity in the above sense, to form larger printing nips 52.

In an embodiment that is preferred here, the dryer elements $\mathbf{38}_k$ or groups $\mathbf{38}_k$ of beam or radiation sources $\mathbf{38}_{k,i}$ that are positioned and/or selected for activation are spaced from one another in the transverse direction, more particularly, at least three or more such dryer elements $\mathbf{38}_k$ or groups $\mathbf{38}_k$ are and/or can be arranged side by side, approximately or substantially equidistant from one another. The equidistant spacing of more than two dryer elements or tracks is to be understood as the respective distances between dryer elements or tracks that are adjacent to one another in pairs.

In one advantageous embodiment, the dryer device comprising dryer 14; 16; 36 and control system 37 is thus embodied and configured to switch on and switch off, simultaneously and/or collectively according to a specified sequence, only a portion of the radiation sources $\mathbf{38}_{k,i}$ in sections, in a plurality of predefinable groups $\mathbf{38}_k$ of radiation sources $\mathbf{38}_{k,i}$, in particular at least four, which are spaced from one another transversely to the direction of transport, equidistantly, i.e. deviating by no more than 20% from the average distance. In a preferred refinement, it is embodied and configured to switch on and switch off, simultaneously and/or collectively, and once per cycle Z, to be specified in detail below, only a portion of the radiation sources $\mathbf{38}_{k,i}$ in sections, in a plurality of predefinable groups $\mathbf{38}_k$ of radiation sources $\mathbf{38}_{k,i}$, in particular at least four, which are spaced equidistant from one another in this manner transversely to the direction of transport, according to a sequence that comprises a plurality of and/or at least three active phases $P_{ON}$ of the same first phase length, spaced equidistant from one another.

Groups $\mathbf{38}_k$ are preferably spaced substantially equidistant from one another, i.e. deviating no more than 10% from the average distance. For example, the distances between groups $\mathbf{38}_k$ to be switched on and off differ from one another by a maximum of twice the smallest possible increment, as viewed transversely to the direction of transport, in the definition of groups $\mathbf{38}_k$, i.e. the smallest possible increment in the transverse direction, e.g. the width of an aforementioned multi-track or preferably single-track LED row.

The configuration, i.e. the positioning and/or selection of dryer elements $\mathbf{38}_k$ or groups $\mathbf{38}_k$ to be activated, is particularly advantageously carried out based on the aforementioned product-based data P or information I(P). More particularly, this is carried out on the basis of specifications contained in the product-based information I(P), by means of which the number and position of at least three, preferably at least four print image elements 56, in particular the same print image element 56, that are or will be printed, spaced, in particular equidistant, from one another in the transverse direction, onto printing substrate 02, can be and/or is defined. Using these specifications, and factoring in the relative position between printing substrate 02 and dryer 14; 16; 36 at the site of action of the dryer 14; 16; 36, the positioning of dryer elements $\mathbf{38}_k$ and/or the formation of groups $\mathbf{38}_k$ are carried out or are undertaken accordingly.

In principle, the specifications regarding the number and distribution of the image elements 56 in the transverse direction can be obtained in any way and can be available or made available in the information I(P). For instance, these specifications could, in principle, be obtained from image data concerning the entire width and length of the print image, e.g. from data that are available in the prepress stage, concerning the ink pattern relating to the entire print image, by the analysis of said pattern. However, this involves substantial effort; moreover, it is more likely to result in errors due to the large number of exposure areas to be designated individually.

In a particularly advantageous solution, however, these specifications to be used for positioning and/or selection are generated from specifications regarding the number $n_X$, with $n_X \in \mathbb{N} \geq 3$, in particular ≥4, preferably ≥6, and/or regarding the position and/or regarding the size of integral or multipart image elements 56 that will be or have been applied, side by side in the transverse direction and, e.g. individually or in groups, and spaced, preferably equidistant, from one another, to printing substrate 02. Image elements 56 have, e.g. at least the same or substantially the same width, i.e. with a maximum deviation of ±2 mm, and/or even a similar ink pattern or motif. For instance, when numbers are printed as an image element 56, a number field having substantially the same dimensions, or when image elements 56 are applied by screen printing, the same motif can repeat $n_X$ times in the transverse direction. Dryer elements $\mathbf{38}_k$ or groups $\mathbf{38}_k$ then are and/or can be arranged according to this pattern of image elements 56 that are interrupted by non-printed areas. In that case, dryer elements $\mathbf{38}_k$ or groups $\mathbf{38}_k$ can be arranged in such a way, for example, and/or can be embodied as having such a width that each of the image elements 56 is fully included width-wise in the active width $b_A$ of the dryer elements $\mathbf{38}_k$ or groups $\mathbf{38}_k$ in question. In a variant of this or in another operating situation, in particular in conjunction with a conditioning device 17 that influences physical appearance and is assigned to or arranged upstream of dryer 16 in the printing substrate path, dryer elements $\mathbf{38}_k$ or groups $\mathbf{38}_k$ are or will be arranged and/or configured as having a width, for example, that is such that only a predefinable portion of the width of image elements 56 is included in and/or irradiated by the active width $b_A$ of the dryer elements $\mathbf{38}_k$ or groups $\mathbf{38}_k$ in question.

Said preferred embodiment is particularly advantageous in conjunction with an operating mode and/or embodiment of the printing press in which the print image applied by printing assembly 03 comprises a plurality, e.g. a number $N_X$, with $N_X \in \mathbb{N} \geq 3$, in particular ≥4, preferably ≥6, of copies 57 side by side across the print image width or printing area width B44, and/or a plurality, e.g. a number $N_Y$, with $N_Y \in \mathbb{N} \geq 3$, in particular ≥5, of copies 57 one behind the other over the entire print image length or printing area length L44, which copies bear image elements 56 or image element groups that do not differ, at least in terms of their position in each of the copies 57 and/or even in the ink pattern. One or more of the aforementioned image elements 56 or image element groups may be provided per copy 57.

The sequence on which the control of radiation source 38 is based in this case preferably comprises a number, corresponding to the number $n_x$ of rows of Image-producing print image elements 56 or groups of such print image elements 56 lying one behind the other in one print image length in the circumferential direction, of active phases $P_{ON}$ having the same first phase length, spaced equidistantly by respective inactive phases $P_{OFF}$, and one inactive phase $P_{OFF}$ having a phase length that is significantly greater than the first phase length, i.e. at least twice as long. If a plurality of image elements, e.g. two, are provided per copy 57, spaced from one another in the direction of transport, a number of active phases $P_{ON}$ having the same first phase length, said number corresponding precisely to the number of copies $N_y$, with each active phase covering a plurality of image elements 56, can be provided, with equidistant spacing. In a finer resolution, a plurality of such series, e.g. two, can be provided, offset from one another, each having a number Ny of phases $P_{ON}$ with equidistant spacing.

Figure 17:
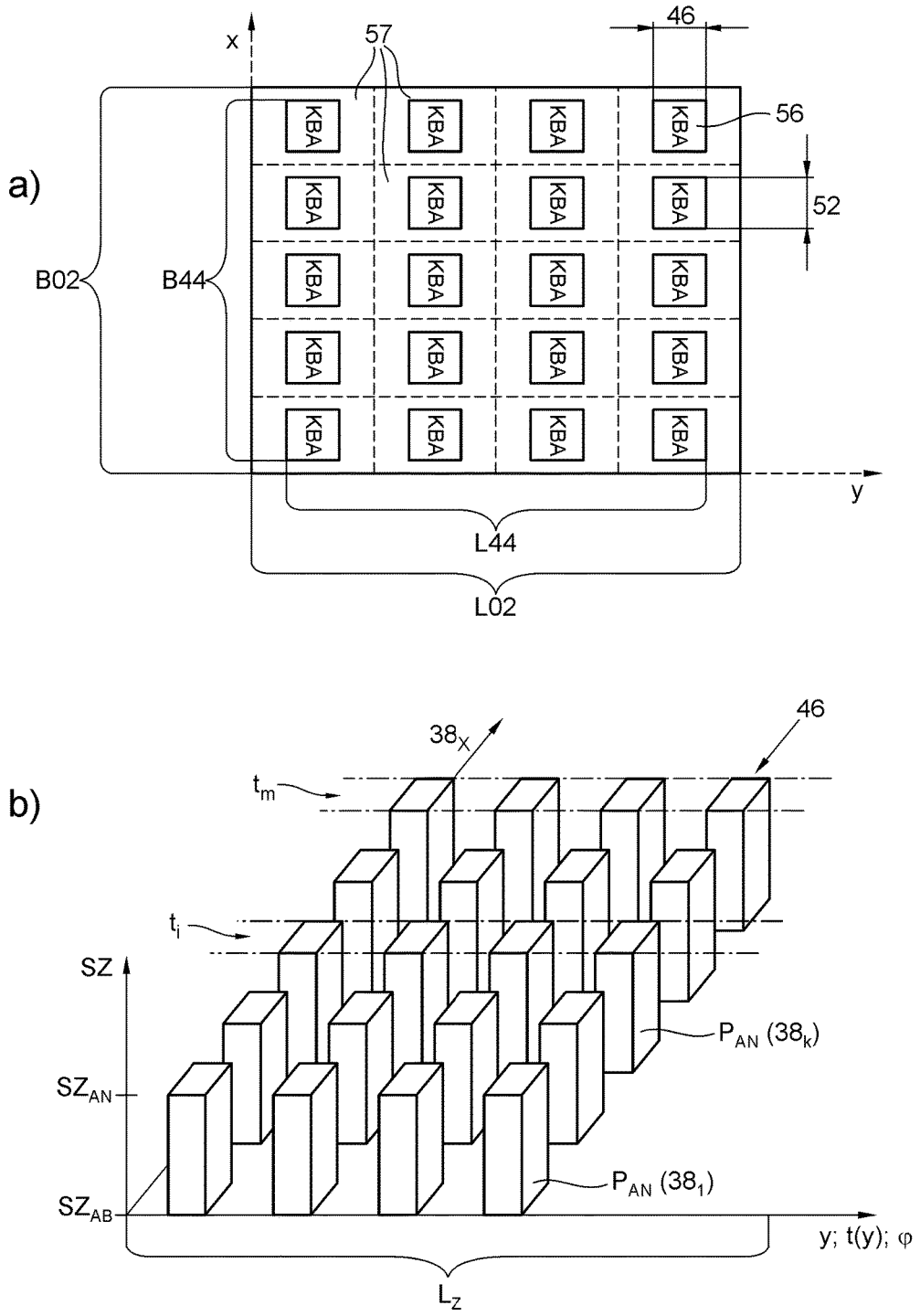
FIG. 17 a schematic diagram a) of a pattern of image elements in a plurality of copies arranged in columns and rows, and b) a possible associated switching profile viewed transversely to and along the direction of transport.

The image elements 56 arranged side by side can each be included, as viewed in the direction of transport, in the aforementioned printing nips 52, wherein, in the direction of transport, for example, in each case a plurality of these image elements 56 or image element groups, e.g. a number $n_Y$, with $n_Y \in \mathbb{N} \geq 2$, can be arranged spaced from one another (see, e.g. FIG. 17*a*).

A "copy" 57 in this case refers to a part of the entire print image of a print section, which repeats in size and structure multiple times and preferably in a regular arrangement, and which—after at least a longitudinal and/or cross-cutting of printing substrate 02—represents a product unit, e.g. that can be used individually by intermediate or end consumers. In security printing, which is preferred in this case, for example, the individual copies 57 are formed on the printing substrate 02, which is imprinted with a print image in a printing area 44, for example, with partial print images that correspond to individual banknotes or security documents, which are first separated into the individual banknotes by cutting in the further processing path—optionally after further processing, e.g. a second printing and/or embossing and/or coating. Independently, in principle, of the aforementioned embodiment of the dryer 14; 16, 36 having selectable and/or positionable and/or formable dryer elements $\mathbf{38}_k$ or groups, but preferably in conjunction therewith, drying means 38, in particular the dryer controller 49 that switches the beam or radiation sources $\mathbf{38}_{k,i}$ on and off, is connected in terms of signal transmission to a control means 51 that is part of control system 37, for example, which activates and deactivates the integral or multi-part drying means 38, which is present as a whole or preferably as selected and/or formed groups $\mathbf{38}_k$, correlated in the manner indicated above, in particular synchronized with or clocked with respect to the press phase position and/or printing substrate phase position, i.e., for example, the position and/or movement of a press phase, in particular a phase position relating to the print position 06; 07, and/or the position and/or the forward feed of the printing substrate 02 in the printing press, or by means of which said drying means can be and/or is activated and deactivated as a complete unit or in parts. In particular, a correlation, more particularly a correlation of switching states SZ; SZON; $SZ_{OFF}$ of the dryer elements $\mathbf{38}_k$ or groups that are involved, is carried out with respect to the length and/or position of a repeating sequence of activation and deactivation, i.e. of a switching-on and switching-off sequence that extends over a cycle length $L_Z$ and has at least one phase $P_{ON}$ relating to the active state "ON", e.g. switched-on state "ON", and at least one phase $P_{OFF}$ relating to an inactive state "OFF", e.g. switched-off state "OFF". The press phase can be formed from the directly or indirectly derived angular position of a cylinder 18; 21; 22 of a print position 06; 07 or of another press element to be rotated true-to-register. The variable that relates to the forward feed of printing substrate 02 can be by an angular position signal of a press element that transports printing substrate 02 in a manner true to register or by a passage signal from a sensor system provided along the transport path.

Cycle length $L_Z$ is preferably constituted by the repeat length between two successive printed sections, i.e. the shortest possible distance between the leading ends of two successive print lengths. Depending on the physical variable in question, said variable may relate spatially to a path length between two sites y or to an angle φ, or temporally to the interval of time between two points in time t. Factoring in the geometry and the transport speed profile, these variables can then be converted to one another and related, for example, to a position relative to the press phase. Cycle length $L_Z$ is equal to the sum of the length $L_D$ of a maximum section $U_D$, e.g. circumferential section $U_D$, that is usable for printing, as viewed along the transport path, and the length $L_N$ of a section $U_N$ that lies between two such sections $U_D$ and is not usable for printing. In the case of sheet-fed printing, the latter may be dependent, i.a. on the means for transporting sheets, and in the case of web-fed printing, it may be dependent, i.a. on interruptions caused by butt joints or even gaps between the ends of clamped printing formes. If an impression cylinder and/or transport cylinder 21 is provided, cycle length $L_Z$ is equal overall, for example, to the sum of the length $L_D$ of a circumferential section $U_D$ that is usable for printing and the length $L_N$ of a circumferential section $U_N$ that is not usable for printing and/or the nth fraction of the circumference of the n-sized or n-saddle-comprising impression cylinder and/or transport cylinder 21.

Cycle length $L_Z$ or the on/off sequence associated with it now comprises a switching-on/switching-off sequence having at least one phase $P_{ON}$ in which drying means 38 or drying element $\mathbf{38}_k$ is activated, and at least one phase $P_{OFF}$ in which drying means 38 or drying element $\mathbf{38}_k$ is deactivated. Here again, the term phases $P_{ON}$; $P_{ON}$ can refer to a spatial variable or to an appropriately correlated temporal variable. Such a cycle-based sequence may comprise only a single activated phase $P_{ON}$ and one deactivated phase $P_{OFF}$ or, in a refinement, may also comprise a plurality of activated phases $P_{ON}$ separated in each case by a deactivated phase $P_{OFF}$. The length of a deactivated phase $P_{OFF}$ corresponds here, for example, to at least the width or the time required for passage of opening 28 plus the length or the time required for the passage of any functional sections that are present, which is determined, for example, by a distance $a_S$ upstream of the trailing pit edge and/or by the length of the aforementioned overlap of an optionally provided cover element 29.

Figure 11:
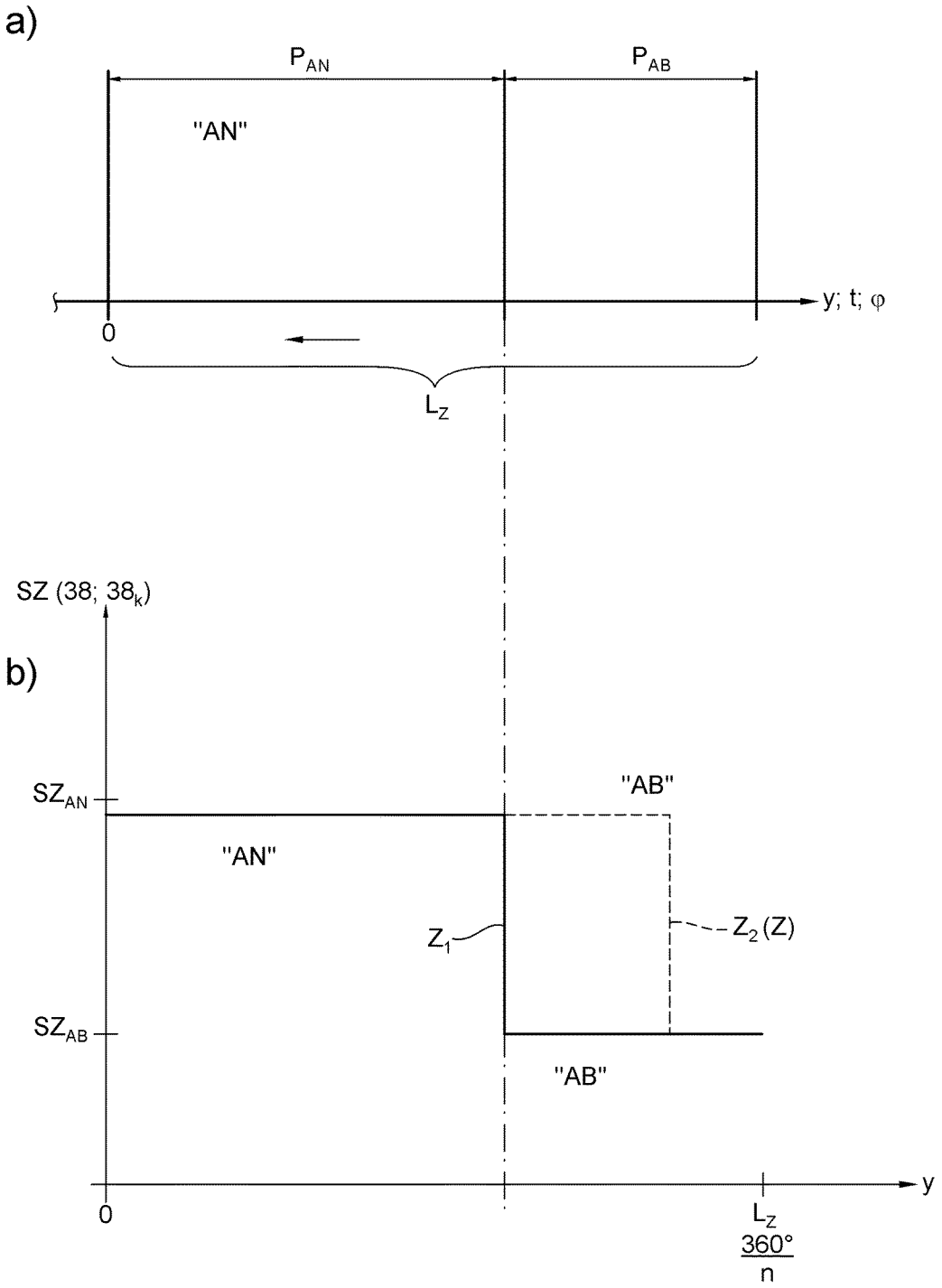
FIG. 11 a diagram illustrating the principle of a) the sequence of phases within an on/off switching sequence, and b) a switching profile with the associated switching states relating to the status of one or more drying elements.

The drying device thus comprises, in addition to dryer 14, 16; 36, a control system 37 having control means 51, by means of which the drying means 38, embodied, e.g. as drying elements $\mathbf{38}_k$ that are continuous across width b38 or as individual drying elements, can be or is switched on and off, as a whole or in part, in the aforementioned correlation with the press phase of the printing press and/or in correlation with the forward feed of printing substrate 02. In particular, control system 37 comprising control means 51 can be used to move drying means 38 or at least one of drying elements $\mathbf{38}_k$ alternatingly to an activated or active or switched-on state "ON" for a period of time corresponding to the length of the activated phase $P_{ON}$, and to a deactivated or inactive or switched-off state "OFF" for a period of time corresponding to the length of the deactivated phase $P_{OFF}$. In so doing, switching means that are part, e.g. of dryer controller 49 and are used for switching drying means 38 and/or drying elements $\mathbf{38}_k$ are alternatingly brought to corresponding switching states $SZ_{ON}$; $SZ_{OFF}$ that effectuate the active or switched-on state "ON" and the inactive or switched-off state "ON"; "OFF" (see, e.g. as schematically illustrated in FIG. 11).

Control system 37, which comprises data processing and/or control means 48; 51 and/or dryer controller 49, can be formed by a cohesive or distributed control circuit 37 or by cohesive or distributed data processing means 37 that are interconnected in terms of signal transmission, and comprises switching and/or data processing means for carrying out an aforementioned synchronization of a switching-on and switching-off sequence with the press phase and/or with the forward feed of the printing substrate. Control system 37 can be fully or partially integrated into a press control system that is connected to other actuating means and/or drive means of the printing press, or can be fully or partially provided expressly for controlling dryer 14, 16; 36.

Said synchronization with the press phase and/or correlation to the forward feed of the printing substrate of the sequence, which is based on a cycle length $L_Z$, is accomplished, e.g. by transmitting signals $S_K$ that represent the press phase and/or the forward feed of the printing substrate, e.g. a trigger signal $S_K$, via a signal connection 35 from a clock generator 42 that represents the press phase of the printing press and/or the forward feed of printing substrate 02 and serves the dryer controller, e.g. as master 42, to control system 37. Said clock generator can be constituted, for example, by a sensor system 42 that detects the relevant press phase of the printing press and/or the forward feed of printing substrate 02, and/or by a master axis 42 of the drive controller that controls the indirect or direct driving of cylinder 21. In an embodiment that is particularly suitable for retrofitting purposes, this can be a sensor system 42 which is already provided in the press and is assigned to a component to be driven true-to-register, e.g. the infeed drum. For presses in which multiple components or component groups that relate to transport and/or printing are rotationally driven by mechanically independent drive motors 41 via a common electronic master axis, the master axis encoder 42 that serves as master 42 for the dryer controller can be formed by such an electronic master axis 42, which serves as master for a plurality of additional drive motors of the printing press. Said master axis 42 in the form of an actual electronic master axis 42 can follow the rotational movement of an actual angle signal, and said master axis in the form of a virtual master axis can be generated by data processing means and can be specified for all follow-on drives that are coupled thereto. In this embodiment, signal connection 35 is formed by the coupling to electronic master axis 42 and is embodied, for example, as a bus system or network system.

However, since the clocking of the dryer element or elements $\mathbf{38}_k$ of drying means 38 should preferably take place in real time, in an advantageous embodiment the signal connection 35 between clock generator 42, which is preferably embodied as a sensor system 42, and control system 37 is constituted by an analog line connection—as opposed to a bus system or a network—and/or the trigger signal $S_k$ is transmitted in the form of a "rapid triggering", e.g. via hardware signals, to control system 37 and/or to the process that will process the signals, and not via a clocked network system or bus system or a PLC that will process and/or relay the signals.

The sequence comprising one or more switching-on and switching-off processes is correlated—depending on the embodiment of the dryer controller and/or the relevant operation in one of the variants specified below—by means of a control logic, which is implemented in control means 51 and which is controlled, for example, by a mechanical switching arrangement, a purely electronic control circuit, a software routine, or a combination thereof. The recurring implementation of the sequence is correlated, in particular synchronized, with the signal $S_K$, which represents the press phase and/or the forward feed of the printing substrate. During a run through the sequence, within cycle length $L_Z$, the position and duration of one or more active phases $P_{ON}$ and one or more inactive phases $P_{OFF}$ are considered, according to the circuit profile that is relevant for the operation. For this purpose, in a particularly advantageous embodiment, control means 51 comprises an electronic cam control mechanism, the virtual movement of which is synchronized with the press phase and/or the forward feed of the printing substrate, and the profile of which forms the one or more active and inactive phases $P_{ON}$; $P_{OFF}$.

In principle, each switching-on and switching-off sequence, based on a cycle length $L_Z$, for a plurality or all of the drying elements $\mathbf{38}_k$ or groups $\mathbf{38}_k$ to be activated can be correlated via dedicated control means 51 with a respective control logic each or with dedicated control logics implemented in collective control means 51, e.g. electronic cam control mechanisms. This can be advantageous preferably in conjunction with an operating mode and/or embodiment of the printing press in which the print image applied by printing assembly 03 comprises, for example, only one copy that extends across print image width B44 or a plurality of copies side by side that differ from one another within the ink pattern.

In the case of a drying means 38 that comprises a plurality of drying elements $\mathbf{38}_k$ or groups $\mathbf{38}_k$ as described above, the switching-on and switching-off sequence relating to the cycle length $L_Z$ is preferably correlated for a plurality or all of the provided and/or formed drying elements $\mathbf{38}_k$ or groups $\mathbf{38}_k$ synchronously with one another. In that case, the drying elements $\mathbf{38}_k$ or groups $\mathbf{38}k$ to be activated for the production run in question can preferably be correlated collectively via common control means 51 using the same control logic and/or the same switching profile, or individually or in multiples via a plurality of synchronously operated control logics. Synchronous switching can be advantageous preferably in conjunction with an operating mode and/or embodiment of the printing press in which the print image applied by printing assembly 03 comprises a plurality, e.g. a number $N_X$, of copies 57 side by side across the print image width B44, in which, e.g. $NX \in \mathbb{N} \geq 2$, in particular $N_X \in \mathbb{N} \geq 3$, more particularly ≥4, preferably ≥6, and/or a plurality, e.g. a number $N_Y$, of copies 57 one behind the other over the print image length L44, in which e.g. $N_Y \in \mathbb{N} \geq 2$, in particular $N_Y \in \mathbb{N} \geq 3$, preferably ≥5, each copy bearing image elements 56 that do not differ or barely differ from one another in terms of their position on the copy 57 and/or in terms of the ink pattern.

Figure 18:
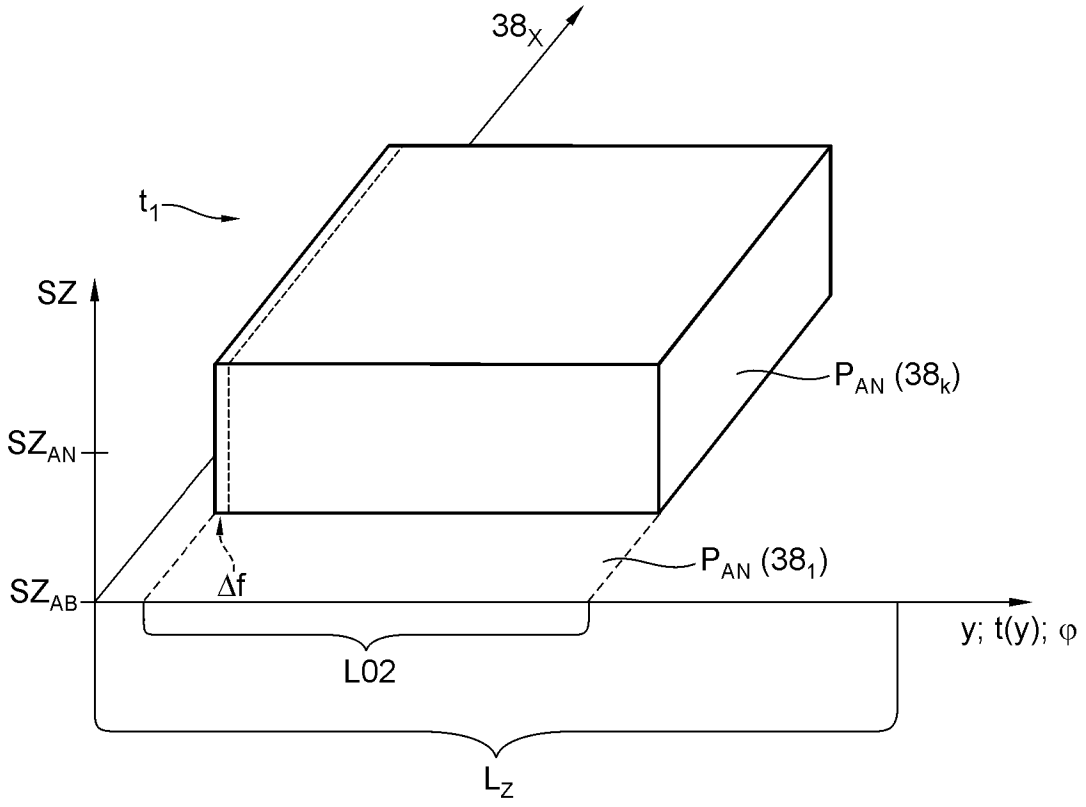
FIG. 18 a schematic diagram of a variant of the switching profile of FIG. 11 with exposure along only one track.

The dryer device—in particular the aforementioned control system 37 that switches drying means 38 and/or drying element $\mathbf{38}_k$ or groups $\mathbf{38}_k$ on and off in correlation with the press phase of the printing press and/or with the forward feed of printing substrate 02—comprises control means 54, by means of which the length and/or position of at least one phase $P_{ON}$ relating to the switched-on state "ON" for drying means 38 or one or more drying elements $\mathbf{38}_k$ or groups $\mathbf{38}_k$ within a repeating cycle for switching on and off can be and/or are varied on the basis of information I(P) relating to the production run, e.g. information I(F); l(L44); I(M) relating to or representing the print image or the printing substrate format F. More particularly, the information I(F); $I(L_B)$; I(M) relating to or representing the printing substrate format and/or the print image can be information I(F); I(L44); I(M) concerning the length L02, as viewed in the direction of transport, of the printing substrate sections, e.g. the printing substrate length L02, or concerning the print image length L44 relating to one printed section, or concerning the ink pattern to be printed by printing unit 19; 23. The information I(F) relating to the "printing substrate format" and/or the "printing substrate length L02" may relate directly to the actual format width and/or length, in which case, if necessary, a deduction Δf—fixedly definable, for example—(indicated by way of example for all embodiments in question in FIG. 13 and FIG. 18 for the profile of the first drying element $\mathbf{38}_1$) for one or more edge areas that may not be printable, such as, e.g. for the leading edge, which is gripped by grippers, for example, can be taken into account by the control system, or said information may involve specifications from which the necessary deductions have already been taken. In the following, information I(F) relating to "the printing substrate format" or the "printing substrate length L02" is intended to include information that reflects the actual format dimensions as well as information that represents the format dimensions corrected by deductions.

Information I(M) relating to the print image or the ink pattern as information I(P) relating to the production run may involve geometric specifications for a grid of image elements. In that case, the length and/or position of the phase $P_{ON}$ may be based, in the above-described manner, on the spatial or angular position thereof or the temporal correspondence thereof relative to the press phase position and/or the printing substrate position.

In a first variant, for the format-dependent or print image-dependent control of the phase length and/or phase position, for two or more discrete values or value ranges for the relevant information I(F); $I(L_D)$; I(M), a corresponding number of discrete phase lengths and/or phase positions for the one or more activated phases $P_{ON}$ and/or a corresponding number of phase positions—e.g. at least partially spaced from one another—for the end of the activated phase $P_{ON}$ may be provided or assigned in an assignment rule.

In an alternative, however, it can be provided that, on the basis of values that are derived from a continuous range of values for the relevant information I(F); $I(L_B)$; I(M), the control means 54 provides or supplies, via an assignment rule, a value for the phase length and/or phase position of the active phase $P_{ON}$ or for the phase position of the end of the active phase $P_{ON}$ from a continuous value range which is also restricted, e.g. in terms of maximum and minimum. "Continuous" is also understood as a sequence of equidistant, discrete increments, conditioned, for example, by restriction or by rounding to the smallest increments to be considered and/or managed in the variable in question.

Control system 37 processes signals $S_K$ relating to the aforementioned correlation and/or synchronization into signals $S_T$, e.g. clocking signals $S_T$, for controlling the switching on and switching off of drying means 38 or of a plurality of drying elements $\mathbf{38}_k$ or groups $\mathbf{38}_k$, in particular those designated for switching-on and switching-off, taking into account a specific switching-on/switching-off profile, which is provided by control means 54 and is based on a cycle length $L_Z$, and which has at least one phase $P_{ON}$ relating to the active state "ON" and at least one phase $P_{OFF}$ relating to the inactive state "OFF". The profile supplied via control means 54 defines the phase length and/or phase position in each case for the at least one phase $P_{ON}$ or phases $P_{ON}$ relating to the active state "ON" in the cycle or within the cycle length $L_Z$—preferably synchronized with the press phase position and/or the printing substrate phase position. The production-specific profile, i.e. of the at least one specific phase length and/or phase position, is obtained and supplied by control means 54 on the basis of information I(F); $I(L_B)$; I(M) that characterizes and/or relates to the printing substrate format and/or the print image (see, e.g. FIG. 6 and FIG. 7). This information I(F); $I(L_B)$; I(M), which is to be processed in control system 37, more particularly in control means 54, based on an allocation rule stored there, comprises or is based on manually defined or automatically obtained specifications regarding the printing substrate format F and/or regarding the print image.

Control means 54, included, e.g. in control system 37 for the correlated switching-on and off, the purpose of which is to supply the format-dependent and/or print image-dependent phase length and/or phase position, can be formed by one or more cohesive or dispersed circuitry and/or data processing means, which comprise circuitry and/or data processing means for determining a phase length and/or phase position relating to the switched-on position "ON", based on the aforementioned received information I(F); $I(L_B)$; I(M) concerning the format and/or print image.

Control means 54, which is contained in control system 37, can be fully or partially integrated—according to control system 37 itself—into a press control system that is connected in terms of control engineering to other actuating and/or drive means of the printing press, e.g. a planning and/or control level 47, or can be provided peripherally and in close proximity to the dryer 14; 16; 36 to be controlled.

The length and/or position of the at least one active phase $P_{ON}$ or the switching profile that extends over a cycle length $L_Z$ is determined and/or provided based on an assignment rule which is contained in control means 54, on the basis of the information I; I(F); $I(L_B)$; I(M) to be considered. The assignment rule can be provided, e.g. purely as an assignment rule in tabular form, or as a functional correlation in a computing and/or storage means that is contained in control means 54. This is also understood as a complex rule by which, on the basis of the information I(F); $I(L_B)$; I(M) to be factored in, a switching profile, which factors the specific length and/or position into a sequence that comprises one or more phases $P_{ON}$ relating to the active state "ON", is determined and/or created.

The information I(F); $I(L_B)$; I(M) to be considered on the input side of the assignment rule when determining the profile, i.e. the phase lengths and/or the phase ends or the phase positions, can be made available to control means 54 by the planning and/or control level 47 via a signal connection 53, for example. This can be carried out, for example—particularly in the case of information I(F); $I(L_B)$ that relates to or represents the printing substrate format F and/or the print image—from a control console assigned to the planning and/or control level 47. At said control console, the corresponding information I(F); $I(L_B)$ itself or specifications relating to this information I(F); $I(L_B)$ to be processed can be manually selected or input via a user interface 55. Manual designation is also understood to refer to a selection of areas in a correspondingly configured control screen or a selection via keys, as well as a combination of input and selection.

In a more highly automated variant, the information I(F); $I(L_B)$ or the specifications relating to said information I(F); $I(L_B)$ to be processed can be or are obtained from data relating to the product plan and/or the production plan, which are already available electronically at the planning and/or control level 47 or in a prepress stage, e.g. data concerning the number and/or size and/or position of the copies on a printing substrate sheet 02, and concerning the relative position of areas to be acted on, or in another embodiment, concerning the size and/or position of the printing substrate sheet 02.

Figure 12:
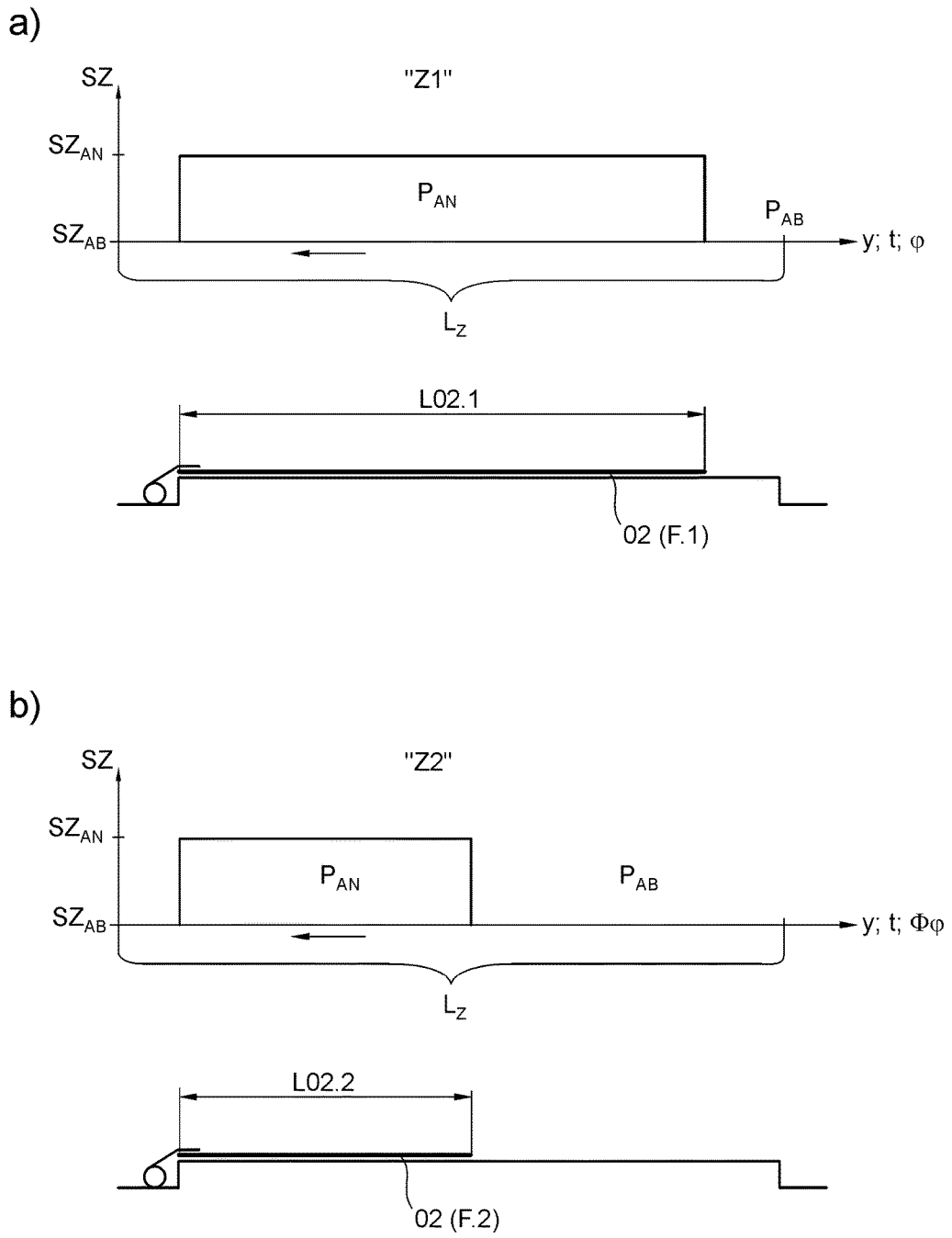
FIG. 12 a diagram illustrating the principle of the switching profile, i.e. the sequence of phases within an on/off switching sequence for a) a larger and b) a smaller printing substrate format.

In a first embodiment for the configuration of control means 54 or for dryer control, e.g. depicted schematically in FIG. 12 based on a cycle length $L_Z$—corresponding, for example, to the length of one circumferential section $U_D$ that is usable for printing and one circumferential section $U_N$ that is not usable for printing—, in a first operating situation, for example, printing substrate sections 02 of a first format F.1, i.e. having a first printing substrate length L02.1, can be or are imprinted, and in a second operating situation, printing substrate sections 02 of a second format F.2, i.e., a second printing substrate length L02.1, can be or are printed. Depending on the format length or printing substrate length L02.1; L02.2, respectively, or on information I(F) representing said length, the phase length and, where appropriate, the phase position of the active phase $P_{ON}$ or—as is preferred in this case—one end of the active phase $P_{ON}$ is determined by control system 37 or by control means 54, and/or based on the respective printing substrate length L02.1; L02.2 or on information I(F) representing said length, drying means 38 or positioned and/or selected or formed drying elements $\mathbf{38}_k$ or groups $\mathbf{38}_k$ are switched on and off in a respective cycle Z1; Z2, in which phase lengths that differ from one another for the respective active phase $P_{ON}$ or—as is preferred in this case—phase positions that differ from one another for the end of the respective active phase $P_{ON}$ are or will be assigned to the different printing substrate lengths L02.1; L02.2. In that case, the phase position for the start of the active phase $P_{ON}$ in each case can be the same predefined position, which is fixed, e.g. with respect to the cycle length $L_Z$, but may be variable. In addition, the aforementioned deductions can be factored in for the region that is printable overall, e.g. at the leading end. In the schematic diagrams of FIG. 12 a) and b), the latter have not been factored in.

Figure 13:
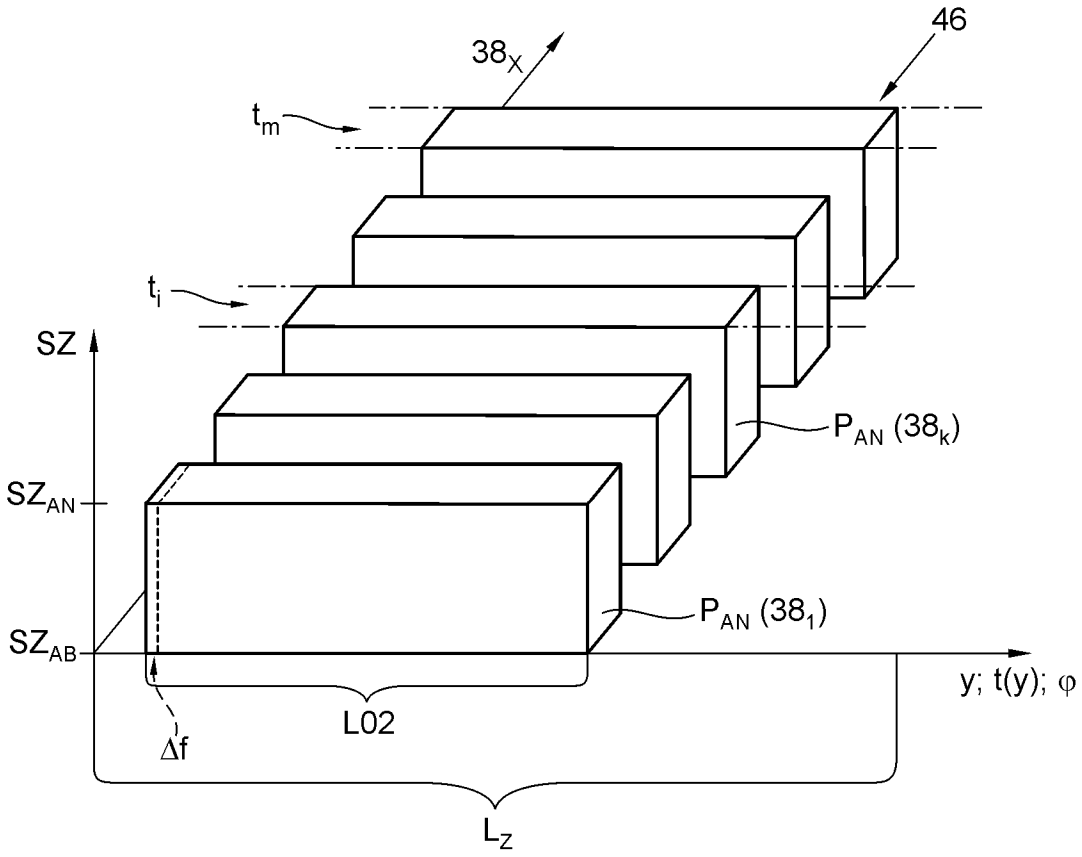
FIG. 13 a schematic diagram of a possible switching profile for FIG. 11 as viewed transversely to and along the direction of transport.

In the embodiment described above, in which printing substrate 02 is acted on by respective drying elements $\mathbf{38}_k$ or groups $\mathbf{38}_k$ in a plurality of tracks $t_i$ that are spaced from one another transversely to the direction of transport, the drying elements $\mathbf{38}_k$ or groups $\mathbf{38}_k$ involved are each preferably to be switched on and off once, simultaneously and/or collectively, per cycle (see FIG. 13). Here, the phase profile of the sequence on which cycle Z is based, i.e. in this case the distribution between active phase $P_{ON}$ and inactive phase $P_{OFF}$, is format-dependent in the manner described above.

The specifications relating to the print format F or the length thereof for the case of the first embodiment, which is directed toward format-based clocking, will be or are supplied, in an advantageous solution, from the aforementioned data, which are available in electronic form from the product plan for the production run in question or from the inspection, or are supplied by means of manual input and/or a selection of such specifications, for example at the control console. The manually selected or input data regarding format F can be entered directly for the purpose in question or can be entered previously for a different purpose and then imported.

Figure 14:
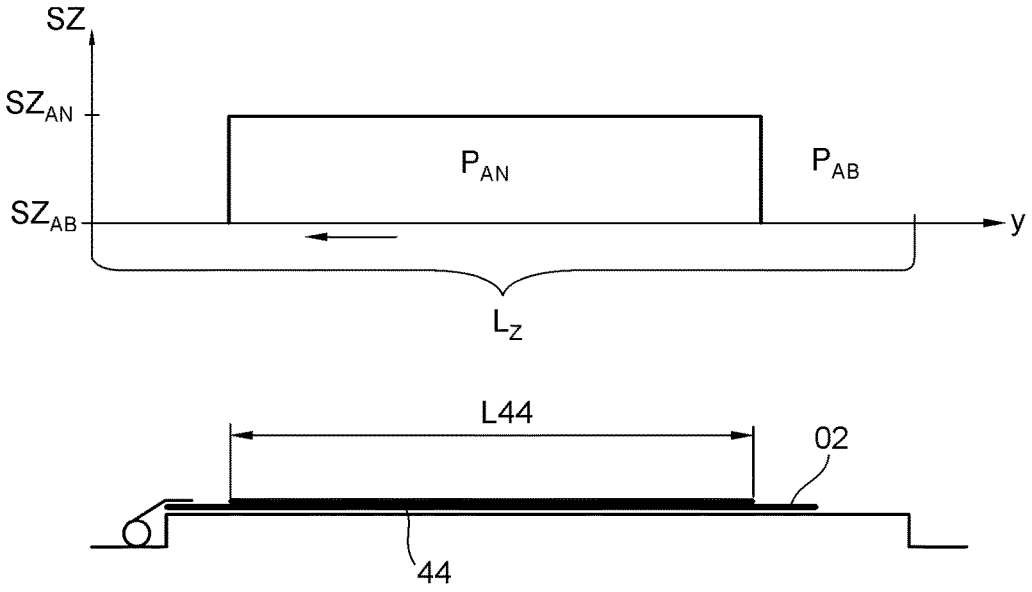
FIG. 14 a diagram illustrating the principle of the switching profile, i.e. the sequence of phases within an on/off switching sequence, based upon the existing print image length.

In a second embodiment that can be implemented or provided in place of or as an alternative to the first embodiment, as the case may be, and which is indicated schematically, e.g. in FIG. 14 based on a cycle length $L_Z$—corresponding, for example, to the length of one circumferential section $U_D$ that is usable for printing and one circumferential section $U_N$ that is not usable for printing—the phase length of the active phase $P_{ON}$ or at least one end of the active phase $P_{ON}$ is determined by control system 37 or control means 54 on the basis of the respective print image length L44 or on the basis of information I(L44) that represents said length. The print image length L44 is understood in this case, e.g. as the length that is limited on the leading side by the first, and on the trailing side by the last ink application to be produced by print position 06; 07 over a printing length. The printing area 44 lying therebetween can have continuous or discontinuous ink patterns. For operating situations that involve different print image lengths L44, based on the respective print image length L44 or on information I(L44) that represents said length, drying means 38 or positioned and/or selected and/or formed drying elements $\mathbf{38}_k$ or groups $\mathbf{38}_k$ are switched on and off in a respective cycle, in which different phase lengths for the respective activated phase $P_{ON}$ or different phase positions for the end of the respective active phase $P_{ON}$ are or will be assigned to the different print image lengths L44. In that case, the phase position for the start of each active phase $P_{ON}$ can be predefined as the same, e.g. fixed position, but optionally as a variable position.

Figure 15:
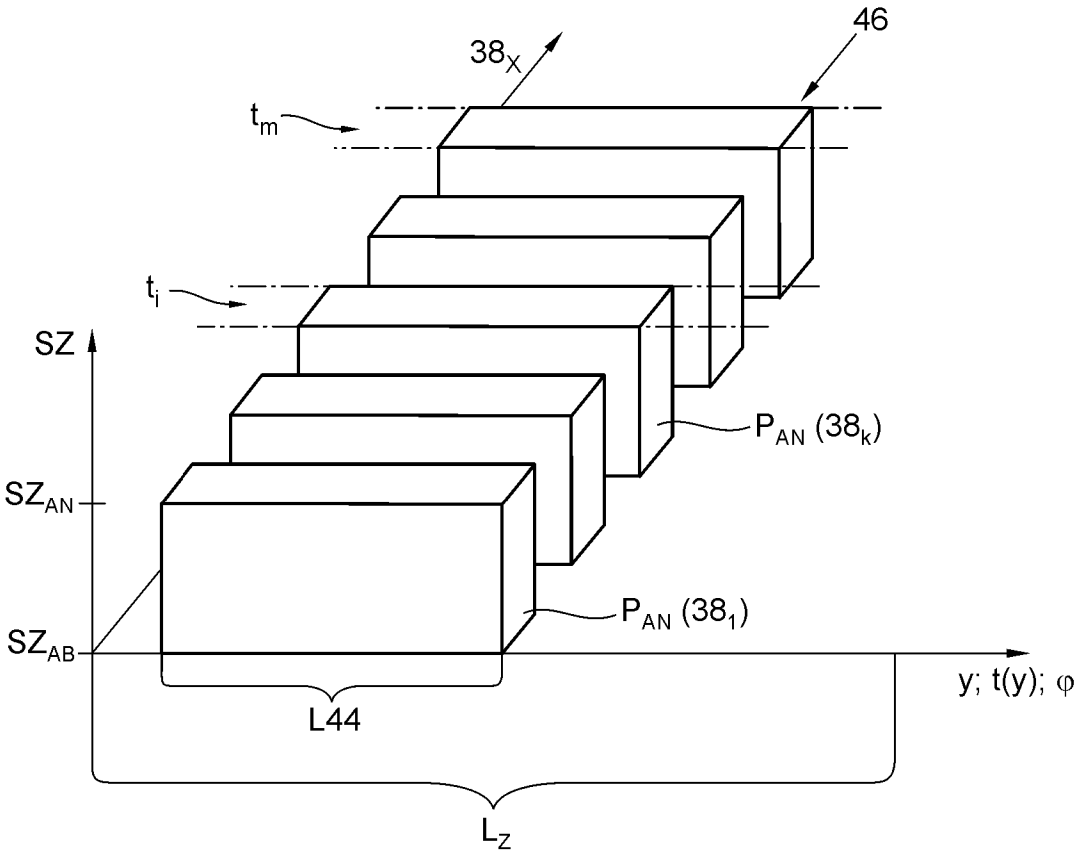
FIG. 15 a schematic diagram of a possible switching profile for FIG. 13 as viewed transversely to and along the direction of transport.

In the embodiment described above, in which printing substrate 02 is acted on by respective drying elements $\mathbf{38}_k$ or groups $\mathbf{38}_k$ in a plurality of tracks $t_i$ that are spaced from one another transversely to the direction of transport, the drying elements $\mathbf{38}_k$ or groups $\mathbf{38}_k$ involved are each preferably to be switched on and off once, simultaneously and/or collectively, per cycle (see FIG. 15). The phase profile of the sequence on which cycle Z is based, i.e. here the distribution between active phase $P_{ON}$ and inactive phase $P_{OFF}$, is dependent on the printing length in the manner described above.

Although in the case of the second embodiment, which is directed toward print image length-based clocking, the specifications relating to the print image length L44 are or can be obtained, in principle, based on the aforementioned image data from the prepress stage, in a solution which is advantageous due to its decreased complexity, these specifications preferably will be or are supplied from data that are available in the product plan or by manual input and/or selection.

Figure 16:
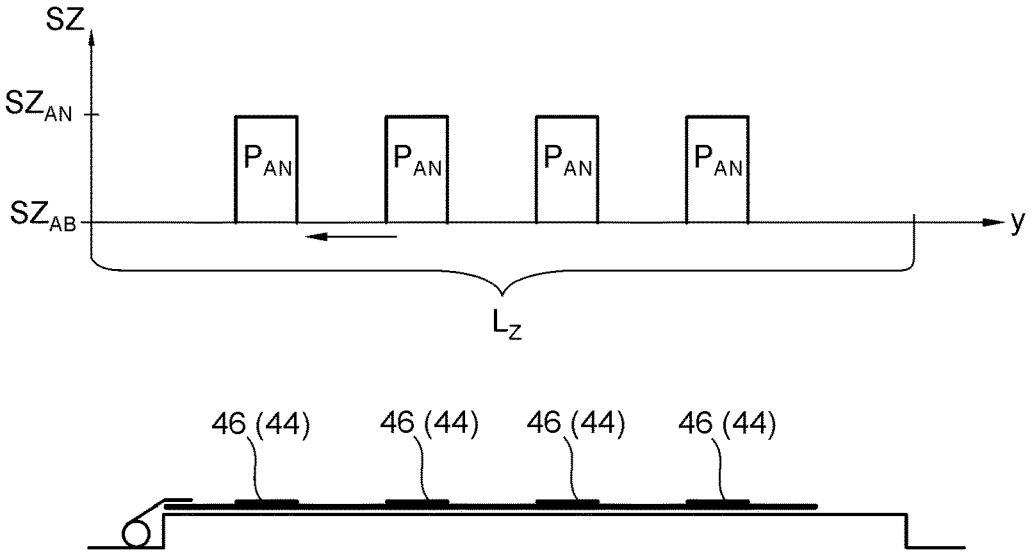
FIG. 16 a diagram illustrating the principle of the switching profile, i.e. the sequence of phases within an on/off switching sequence, based upon the position, length and number of printing strips along a print image length.

In a third embodiment that can be implemented or provided in place of or as an alternative to the first and/or second embodiment, as the case may be, and which is indicated schematically, e.g. in FIG. 16 based on a cycle length $L_Z$—corresponding, for example, to the length of one circumferential section $U_D$ that is usable for printing and one circumferential section $U_N$ that is not usable for printing—a plurality of active phases $P_{ON}$ and a plurality of inactive phases $P_{OFF}$ can be provided for each cycle length $L_Z$. The active phases $P_{ON}$ are spaced equidistant from one another along print image length L44, for example. In that case, the beginning and the end of each of the active phases $P_{ON}$ is determined by control system 37 and/or control means 54 based on information I(M) that represents the phase position, as viewed in the direction of transport, of printing strips 46 of a printing area 44, which are interrupted by printing strips that will not be printed. For operating situations that involve different patterns of strips to be printed and strips that will not be printed, drying means 38 or the selected and/or formed drying elements $\mathbf{38}_k$ or groups $\mathbf{38}_k$ are switched on and off individually, multiple times in each cycle, based on the distribution of printing strips 46 in each case or based on information I(M) that represents said distribution, wherein different patterns for the phase positions and/or phase lengths, i.e. the position of the beginning and the end in each case of the respective activated phase $P_{ON}$, are or will be assigned to the printing areas 44 that differ from one another in terms of the distribution of printing strips 46.

For configuring the dryer device, the print image-based information I(L44); I(M) concerning the print image length L44 can be supplied to the second embodiment directed to the print image length-based clocking, or such information concerning the number and/or position of the printing strips 46 can be supplied to the third embodiment directed to the printing strip-based clocking, and/or the specifications on which said information l(L44); I(M) is based can be supplied, for example, from the aforementioned data that are available in electronic form for product planning for the production run in question or for the inspection, or by the manual input and/or selection of such specifications, for example at the control console. The manually selected or input data regarding format F can be entered directly for the purpose in question or can be entered previously for a different purpose and then imported.

In principle, specifications on which this information I(L44); I(M) is based could also be based on data and/or specifications that will be or are obtained by analyzing the print image to be printed in print position 06; 07, more particularly by analyzing the ink pattern, which is present, e.g. in the form of data in the prepress stage, i.e. directly from data that are used for producing printing forme 31; 32, or from data obtained therefrom by means of analysis. For this purpose In the case of the third embodiment, irrespective of the way in which the underlying data are supplied, a plurality of fine strips to be printed, which are interrupted, e.g. by narrower strips that are not to be printed, can be or are combined to form larger printing strips 46, despite this discontinuity.

In the case of the third embodiment, which is directed toward printing strip-based clocking, the switching profile is preferably provided, i.e. the cycle-based n phase lengths and/or phase positions are preferably designated, based upon specifications, or based upon information I(M) that contains these specifications and describes a pattern, extending over the print image length L44 in the direction of transport, of a plurality of print image elements 56 that are or will be printed according to the plan, spaced from one another, onto printing substrate 02. These are specifications, for example, that can be and/or are used for defining the number and position of three or more print image elements 56, in particular the same print image element 56, which are or will be printed, spaced, in particular equidistant, from one another in the direction of transport, onto printing substrate 02. Using these data, and factoring in the aforementioned synchronization of the respective cycle with the press phase and/or the printing substrate phase, during production operation, drying means 38 or drying element $\mathbf{38}_k$ or the formed groups $\mathbf{38}_k$, which is/are positioned and/or selected in the above-described manner, expose the printing substrate 02 that is transported past it to the drying medium, in particular the radiation, in a clocked manner, in accordance with the profile.

Although in principle, these specifications relating to the number and distribution of the image elements 56 in the direction of transport are all, or all can be obtained on the basis of the aforementioned data from the prepress stage, they are preferably generated from specifications regarding the position and size of an image element or a subset of a plurality of image elements 56, e.g. a number $n_Y$, with $n_Y \in \mathbb{N} \geq 3$, and from specifications regarding the number $n_X$ thereof, which are to be or have been applied one behind the other and spaced from one another—preferably equidistant—in the direction of transport, onto the printing substrate 02 according to plan. The specifications regarding the position and/or size of the image element or the subset of image elements 56 can be and/or are supplied directly from data from the product plan or inspection, or by means of manual input. From this position and/or extension of the at least one of a plurality of image elements 56 and from specifications that can be used to deduce the position of the remaining image elements 56, the cycle-based profile of the switching on and off of drying means 38, or of the positioned and/or selected dryer elements $\mathbf{38}_k$ and/or formed groups $\mathbf{38}_k$, multiple times is provided via an appropriately established routine.

Image elements 56 have, e.g. at least the same or substantially the same length, i.e. ±2 mm, in the direction of transport and/or even, e.g. a similar ink pattern or motif. Dryer elements $\mathbf{38}_k$ or groups $\mathbf{38}_k$ then are or can be activated during a cycle in a plurality of active phases $P_{ON}$ that are interrupted by inactive phases $P_{OFF}$, according to this pattern of image elements 56 in the direction of transport.

In a particularly advantageous embodiment, the dryer device comprising dryer 14; 16; 36 and control system 37 is embodied and configured to switch all of radiation sources $\mathbf{38}_{k,i}$, or preferably only some of radiation sources $\mathbf{38}_{k,i}$, on and off in sections, simultaneously and/or collectively, per repeating cycle Z, according to a sequence that comprises a plurality of and/or at least three active phases $P_{ON}$ of the same first phase length, spaced equidistant from one another. In a preferred refinement, the subgroup of radiation sources $\mathbf{38}_{k,i}$ is to be switched on and off simultaneously and/or collectively in at least four predefinable groups $\mathbf{38}_k$ of radiation sources $\mathbf{38}_{k,i}$, which are spaced from one another transversely to the direction of transport, approximately equidistant, i.e. deviating no more than 20% from the average distance.

In an advantageous solution for configuring a clocking that will be described below, configuration is accomplished using specifications regarding the number $n_Y$, with $n_Y \in \mathbb{N} \geq 3$, in particular ≥5, and/or regarding the position and/or the size of integral or multi-part image elements 56 that will be or have been applied to printing substrate 02, one behind the other and spaced from one another—preferably equidistant, individually or in groups—in the direction of transport.

In a particularly advantageous embodiment, the dryer device comprising dryer 14; 16; 36 and control system 37 is embodied and configured to switch all of radiation sources $\mathbf{38}_{k,i}$, or preferably only some of radiation sources $\mathbf{38}_{k,i}$, on and off in sections, simultaneously and/or collectively, in each repeating cycle Z, according to a sequence that comprises a plurality of and/or at least three active phases $P_{ON}$ of the same first phase length, spaced equidistant from one another. In a preferred refinement, the subgroup of radiation sources $\mathbf{38}_{k,i}$ is to be switched on and off simultaneously and/or collectively in at least four predefinable groups $\mathbf{38}_k$ of radiation sources $\mathbf{38}_{k,i}$, which are spaced from one another transversely to the direction of transport, approximately equidistant, i.e. deviating no more than 20% from the average distance.

Said preferred embodiment is particularly advantageous in conjunction with an operating mode and/or embodiment of the printing press in which the print image applied by printing assembly 03 has a plurality of copies 57, e.g. a number $N_Y$, with $N_Y \in \mathbb{N} \geq 3$, in the direction of transport, one behind the other in the same alignment over at least print image length L44, which copies bear image elements 56 that do not differ from one another, at least in terms of their position in the respective copy 57 and/or in terms of their dimensions and/or even in terms of the ink pattern.

The $n_Y$ image elements 56 arranged one behind the other in the direction of transport are contained, e.g. in the aforementioned printing nips 52, wherein in the transverse direction, for example, in each case the number $n_x$ of these image elements 56 can be arranged spaced from one another (see, e.g. FIG. 13*a*).

In the above, the terms "phase length" and "phase position" or the respective shortened forms "length" and "position", unless otherwise clearly specified, can be or are used to refer to the size and the position, respectively, of the phase in question in a spatial sense—e.g. as a position or angle—and to the temporal correspondence thereof as a duration and as a temporal relative position within the synchronized cycle length $L_Z$. These spatial and temporal dimensions are directly correlated with one another over the speed profile. Location, time, and angle are indicated as such for the abscissae in FIG. 10 to FIG. 12, by way of example. The points in time for the phase change in each case, and thus the phase length and the phase position, are determined, e.g. relative to the press phase position and/or relative to the printing substrate phase position.

As has already been stated, the above-described dryer device is located in the printing substrate path downstream of at least a first print position 06; 07 such that in the activated or active state "ON", it is arranged with drying means 38 or with dryer elements $\mathbf{38}_k$, which are positioned and/or selected or formed by groupings, directed toward the printing substrate path. In a first particularly advantageous embodiment, dryer 36 is provided as an intermediate dryer 36 between two print positions 06; 07 arranged one behind the other in the printing substrate path.

In another particularly advantageous embodiment of the printing press, dryer 14 is provided in the printing substrate path in the region of or downstream of an aforementioned conditioning device 17 that influences the physical appearance of the printing ink—e.g. by aligning particles that are contained in the printing ink. Said dryer can be directed, for example, toward a transport path in the region of a means 58 that effectuates said influence, for example toward the surface of a rotary body 58, e.g. magnetizing cylinder 58, which comprises magnetized or magnetic material and, for example, transports the printing substrate 02.

In more general terms, the preceding teaching explained in the context of an example of a security printing press embodied as a rotary screen printing press can also be applied, in principle, unless obviously contradicted, to a printing unit that operates according to flat screen printing or letterset printing, and/or to a method that operates according to flat screen printing or letterset printing. For said purposes, the term printing substrate 02 can also be understood to include other types of substrates, for example molded articles and/or hollow bodies, in addition to planar articles. The drying means 38 or all selected and/or formed dryer elements $\mathbf{38}_k$ can also be switched on and off in this case on the basis of information I(F); I(L44); I(M) relating to the printing substrate format and/or the print image, with phase lengths and/or phase positions that vary based on the format and/or the print image, in order to avoid the undesirable passage of ink, for example through non-printing sections of a printing forme.

However, the arrangement and/or the operation of the above-described dryer device having dryer 14, 16; 36 and the associated control system 37 is not limited to printing presses, in particular security printing presses, which have a printing assembly 03; 03' that operates according to the screen printing method or the aforementioned letterset method, and can instead optionally be extended to printing presses, in particular security printing presses, that operate according to a printing method other than the screen printing method. Preferably, however, these are printing presses, the printing assembly 03 of which applies or can apply the ink pattern of a plurality of individual image elements 56 over a printing length, at least as viewed in the direction of transport of printing substrate 02, e.g. spaced regularly, i.e. spaced by areas that are not to be printed in the printing unit 19, 19'; 23; 23' or printing assembly 03 in question. A printing forme 31; 32 of a printing assembly 03; 03' embodied and/or operated in this way carries over its length—as viewed in the direction of transport and/or in the circumferential direction—e.g. with regular spacing, the subjects of individual image elements 56 to be printed in the printing unit 19; 19'; 23; 23' or printing assembly 03 in question, which are spaced by non-printing areas.

In an alternative embodiment of a printing press which is particularly advantageous for the use of an aforementioned dryer device, more particularly a security printing press (e.g. FIG. 1*c*), the at least one printing unit 19" of a printing assembly 03" is embodied as a first printing unit 19" which is arranged in the printing substrate path and operates according to the offset method, or an offset printing unit 19" for short, and the second printing unit 23" is likewise embodied as a printing unit 23" which operates according to the offset method, or an offset printing unit 23" for short, the drying means 38 being arranged in the printing substrate path between the print positions 06"; 07" that are formed by the first and second printing units 19"; 23". The cylinder that cooperates with the printing substrate is embodied in this case as a transfer cylinder, which receives the printing ink from the forme cylinder 18"; 22", embodied, e.g. as a stencil cylinder or plate cylinder. In a particularly advantageous embodiment, first printing unit 19" is embodied as an indirect printing unit 19", the transfer cylinder of which cooperates with at least one or preferably two forme cylinders 18", and/or the second printing unit 23" is embodied as an indirect printing unit 23", the transfer cylinder of which cooperates with a plurality of forme cylinders 22", in particular at least four. The second print position 07' in this case is preferably embodied as a blanket-to-blanket print position 07", in which a second printing unit 23" of this type is provided on each of the two sides of the printing substrate path. These printing units cooperate in the area of their transfer cylinders, which serve alternately as impression cylinders. The second printing units 23" form, e.g. a blanket-to-blanket printing unit for simultaneous, double-sided multi-color printing. The ink pattern that is applied in the first print position 06', for example, can be dried or at least superficially dried by the dryer device in the above-described manner, based on the print image and/or the format, before being imprinted again in the second print position 07'.

In this embodiment, the security printing press thus comprises at least a first print position 06" in the printing substrate path, at which printing substrate 02 passing through this print position 06" can be imprinted in sections, i.e. onto web sections or, more particularly, onto successive printing substrate sheets 02, on at least a first of its two sides, in a cycle Z having a cycle length $L_Z$ that is fixed based on the printing substrate feed rate at print position 06", with print images having a certain print image width B44 and a print image length L44 that is shorter in relation to the cycle length $L_Z$, and a second print position 07" that is the next closest downstream, at which the printing substrate 02 passing through this print position 07" can likewise be imprinted with print images on at least the second of its sides. The sections are constituted as sections of a web-type printing substrate 02, or in this case preferably as printing substrate sheets 02.

In principle, the first side, and downstream the second side, can be imprinted in succession by means of printing units 19"; 23" of any printing method and/or configuration. Preferably, however, printing substrate 02 can be imprinted at the first print position 06" according to an offset printing method and/or according to a heliographic printing method. At the second print position 07", it can then advantageously be imprinted at least on its second side, but preferably on both sides, by means of a printing unit 23", according to an indirect printing method and/or in multiple colors simultaneously. At the second print position 07", it can be imprinted, preferably on both sides, according to an offset printing method and/or according to a heliographic printing method.

The dryer device comprises a dryer 14; 16; 36 having an above-described integral or multi-part drying means 38 and is located in the printing substrate path between the first and the second print position 06"; 07" and/or in the printing substrate path downstream of the second print position 07'. Said drying means is able to expose the printing substrate 02 to radiation for the purpose of drying the same as it passes along its transport path through dryer 14; 16; 36. Drying means 38 of dryer 14; 16; 36 is preferably formed in the manner described above by an arrangement, extending at least across the maximum printing substrate width B$\mathbf{02}_{max}$, of a plurality of radiation sources $\mathbf{38}_{k,i}$, in particular UV LEDs, arranged side by side, i.e. a number of at least 50 across the maximum printing substrate width B$\mathbf{02}_{max}$ and/or a length-based number of at least 50, preferably at least 70 radiation sources $\mathbf{38}_{k,i}$ per meter.

In a preferred embodiment, control system 37, which controls drying means 38 of dryer 14; 16; 36 with respect to activation and deactivation, is connected in terms of signal transmission to an encoder 42, which transmits signals $S_K$ that represent the press phase and/or the forward feed of the printing substrate, and effectuates, for each cycle Z, a switching on and off of drying means 38 or of at least a portion thereof, according to a sequence comprising at least one active phase $P_{ON}$ and at least one inactive phase $P_{OFF}$, in correlation with the press phase position and/or printing substrate phase position. For each cycle Z, one switching on and off is carried out, more particularly, precisely one switching on and off, of radiation source 38 or at least a portion thereof, with at least one, preferably precisely one active phase $P_{ON}$ and one inactive phase $P_{OFF}$ per cycle Z (see, e.g. FIG. 12 and FIG. 18).

Printing substrate 02 is preferably acted on in a track, more particularly in a single track, as viewed transversely to the direction of transport, with the width of said track being selected based on printing substrate width B02 and/or corresponding substantially to said width, i.e. for example with a maximum deviation of at most +1/−10 mm, in particular +0/−5 mm per lateral edge. (See, e.g. FIG. 18). The width of the track can then be adjusted based upon printing substrate width B02.

For all the described embodiments and variants of the printing presses, in particular security printing presses, and/or dryer devices, the radiation output Φ to be emitted by the radiation sources $\mathbf{38}_{k,i}$ or groups $\mathbf{38}_k$ in the activated state, which are switched on according to the sequence, can be varied based upon a variable that represents the press feed rate or printing substrate feed rate V, or speed V for short. For this purpose, a corresponding correlation Φ (V) between a measurement of the press feed rate or printing substrate feed rate V and a measurement of the radiation output is made available, e.g. in tabular form or in the form of a function defined continuously or by section, and an algorithm for converting this dependency defined by the correlation Φ (V) is provided. The output preferably increases stepwise or continuously with the press feed rate or printing substrate feed rate V. In principle, the correlation between output and press feed rate or printing substrate feed rate V can be permanently stored in the control system. Information I(V) relating to the current speed V can be supplied to control system 38 from, e.g. the press controller or from an encoder that supplies a measurement of speed V.

Figure 19:
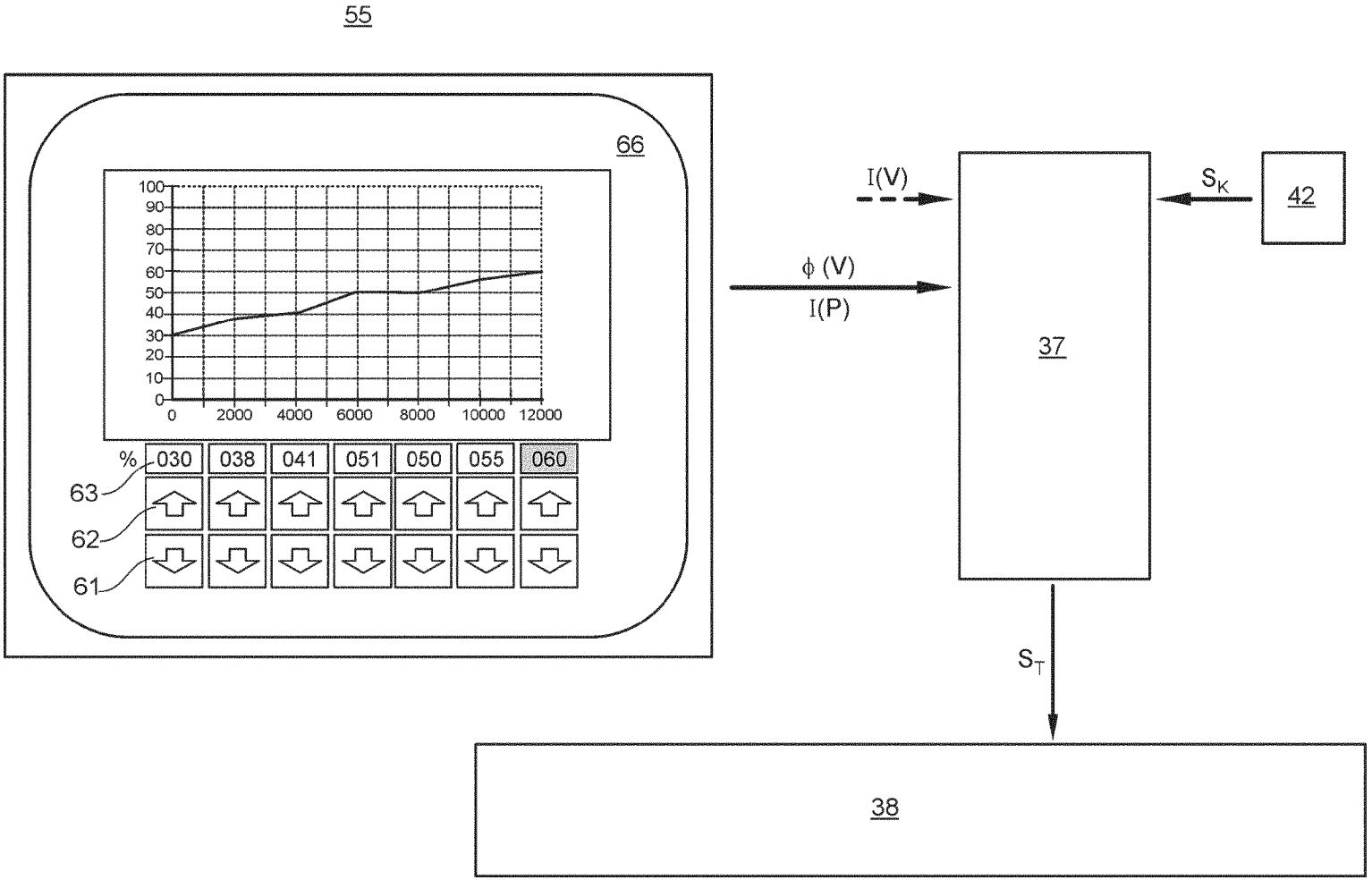
FIG. 19 a schematic diagram showing the actuation of the dryer or drying means, taking the current press speed into account.

However, the profile of the correlation can preferably be varied via a user interface 55 (see, e.g. FIG. 19). In principle, said variation can be achieved manually in a wide variety of ways via one or more operating elements 61; 62; 63 that are included in the user interface 55. For example, said profile can be influenced using keys 61, 62, 63 of a keypad 55, for example, provided on the control console and, where appropriate, a display field 64.

"Control elements" are understood here and in the following—unless otherwise explicitly specified—as any type of elements that are suitable for operation by press operators, e.g. buttons, keys, switches, input fields, control means for screen cursors or mouse pointers, and optionally other elements that are suitable for interaction with the system to be controlled and/or configured.

In an embodiment that is preferred here, user interface 55 is embodied as a touch-sensitive screen 55, for example what is known as a touch screen 55, or what is known as a touch panel 55, with the required actuation, or at least comprises such a touch-sensitive screen 55. The or at least some of the stated control elements 61; 62; 63 that relate to the parameterization of the aforementioned correlation are embodied, e.g. as touch-sensitive fields 61; 62; 63 of a control panel 66 configured for this purpose, e.g. an input mask 66 or screen mask 66, with programming related to the positioning function, thus in this case for influencing the profile of the correlation between a measurement of radiation output and a measurement of press feed rate or printing substrate feed rate V. In the present case, the correlation is constituted by an assignment of values for the measurement relating to the radiation output to grid points, spaced from one another, for the measurement relating to the press feed rate or the printing substrate feed rate V. The grid point to be changed can be activated, for example, via a field 63 that is assigned to said grid point, and the value thereof can be adjusted by means of fields 61; 63 that represent plus and minus buttons. In principle, however, a touch-sensitive block of numbers could be provided as an alternative for adjusting the values. The current profile of the correlation can be visualized, for example, via a display field 64 likewise represented in the screen mask 66.

The correlation to be factored in by control system 37 is made available to it, for example, via an existing or additional signal connection, and is implemented by said control system in the control of dryer 14, 16; 36, based upon the data relating to the press feed rate or printing substrate feed rate V, which are likewise available.

As has been stated at various points above, the configuration of the dryer device with respect to the positioning and/or selection of dryer elements $\mathbf{38}_k$ or groups $\mathbf{38}_k$ of radiation sources $\mathbf{38}_{k,i}$ to be activated and/or with respect to the phase profile on which the cycle Z or the sequence is based can be carried out in a first advantageous embodiment on the basis of data provided manually via a user interface, and in an alternative advantageous embodiment using data that already exist in the product plan or the printing press and that characterize the printed product or intermediate printed product to be produced.

In the first embodiment of a device for configuring the dryer device for a specific production run, a user interface 55 that is connected in terms of signal transmission to control system 37 is provided, which can be used by press operators to perform a configuration in the transverse direction. In particular, on this user interface 55, the number and/or lateral position and/or width of dryer elements $\mathbf{38}_k$ or groups $38_k$, which are spaced from one another transversely to the direction of transport and are to be activated, and/or the number and/or lateral position and/or width of provided tracks $t_i$ to be acted on by dryer elements $38_k$ or groups $38_k$, and/or the number and/or lateral position and/or width of copies to be printed side by side onto printing substrate 02 in the production run in question can be defined and/or modified. For this purpose, user interface 55 comprises control elements 71; 72; 73; 74; 76; 77; 78, which are connected in terms of signal transmission to control system 37, in particular functionally connected, and by the actuation of which, specifications regarding parameters such as, in particular, the number and/or lateral position and/or width of the required groups $38_k$ and/or the required tracks $t_i$ and/or the copies 57 provided side by side on printing substrate 02 can be manually defined and/or modified. These specifications are also understood to include specifications that are or will be processed further into the corresponding specific parameters.

In that case, keys 67 of a control field embodied as an alphanumeric keypad can be provided as control elements 67, via which specifications regarding the number and/or lateral position and/or width of groups $38_k$ and/or regarding the tracks $t_i$ and/or the copies 57 provided side by side on printing substrate 02 can be input and, e.g. should be confirmed. Alternatively or additionally, control elements 68; 69 that function as plus and minus buttons and/or as left or right buttons can be provided, the actuation of which allows a value and/or a position of a permanently assigned parameter or a parameter that can be selected in advance, for example the number and/or position of a group $38_k$ and/or of a track $t_i$ and/or of a number of copies, and/or the width of a group $38_k$ and/or of a track $t_i$ and/or of a copy 57 and/or of printing substrate 02 to be modified. Finally, alternatively or in addition to one or more of the aforementioned variants, control elements—not explicitly illustrated here—can be provided, which are embodied as selection means, and which, when actuated, enable specifications regarding the number and/or lateral position and/or width of groups $38_k$ and/or of tracks $t_i$ to be selected from predefined and, e.g. listed values.

For the aforementioned variants for configuration in the transverse direction, control elements 71; 72; 73; 74; 76; 77; 78 that are used for selecting and/or adjusting a parameter that is to be modified or adjusted are provided, the actuation of which allows the parameters that are to be adjusted, for example, via the aforementioned control elements 67; 68; 69, to be selected. Such control elements 71; 72; 73; 74; 76; 77; 78 can be used, for example, for selecting and/or, for example, setting parameters that relate to the number of groups $38_k$ or tracks $t_i$ or copies 57 provided side by side, and/or to the lateral position of a group $38_k$ or a track $t_i$ or a copy 57 and/or of the printing substrate 02, and/or to the width of a group $38_k$ or a track $t_i$ or a copy 57, and/or to the lateral position of a group $38_k$ or a track $t_i$ in relation to a copy 57 and/or the width of the printing substrate 02. In the case of the lateral position of a group $38_k$ to be activated or of a track $t_i$, although in principle the specification can be based on the position of printing substrate 02, it is preferably carried out via corresponding control elements 77; 78 relative to the position of a copy 57 or of a column that comprises a plurality of copies 57 one behind the other.

In a preferred refinement of the first embodiment of the device for configuring the dryer device for a specific production run, press operators can configure the dryer device, in particular the operating behavior thereof, in the longitudinal direction, i.e. with respect to the direction of transport of the printing substrate, via the stated or via an additional user interface 55 that is connected in terms of signal transmission to control system 37. In particular, the sequence of action can be configured, or the number and/or phase length and/or phase position of active phases $P_{ON}$ in cycle Z and/or of the copies 57 provided one behind the other on printing substrate 02 can be defined and/or modified via said user interface 55. For this purpose, the user interface comprises control elements 81; 82; 83, which are connected in terms of signal transmission to control system 37, and the actuation of which enables specifications regarding parameters such as, in particular, the number and/or position and/or length of the active phase $P_{ON}$ or phases $P_{ON}$ in a cycle Z, and/or the number and/or position and/or length of the copies 57 provided one behind the other on printing substrate 02 to be defined and/or modified manually. These specifications are also understood as specifications that will be or are further processed to obtain the corresponding specific parameters.

In that case, additional control elements 67, embodied as keys, of the control pad or of an additional control field configured as an alphanumeric keypad can be provided, which can be used for inputting specifications regarding the number and/or position and/or length of the active phases $P_{ON}$ and/or the number and/or position and/or length of the copies 57 provided one behind the other on printing substrate 02. Alternatively or additionally, the aforementioned or additional control elements 68; 69 that act as plus and minus buttons and/or as left or right buttons can be provided, the actuation of which enables a value and/or a position of a fixedly assigned parameter or a parameter that can be selected in advance, i.e. the number and/or position and/or length of the active phases $P_{ON}$ and/or of the copies 57 provided one behind the other on printing substrate 02, to be modified. Finally, alternatively or in addition to one or more of the aforementioned variants, control elements—not explicitly shown here—can be provided, which are embodied as selection means and the actuation of which enables specifications regarding the number and/or lateral position and/or width of the active phases $P_{ON}$ and/or of the copies 57 provided one behind the other on printing substrate 02 to be selected from predefined and, e.g. listed values.

For the aforementioned variants for configuration in the longitudinal direction, control elements 81; 82; 83 that are used for selection and/or adjustment can be provided, the actuation of which enables the parameter currently to be adjusted via the aforementioned control elements to be selected. Using such control elements 81; 82; 83, the number of active phases $P_{ON}$ provided, or the number of copies 57 provided one behind the other on the printing substrate section or sheet 02, and/or the position and/or length of at least one active phase $P_{ON}$ or of at least one copy 57 on printing substrate 02, in particular printing substrate sheet 02, can be selected and/or set, for example. For the number and position of a plurality of active phases $P_{ON}$ provided one behind the other on the printing substrate section or printing substrate sheet 02, the specification can refer, in principle, to the position of printing substrate 02. Preferably, however, the position of the active phases $P_{ON}$ is specified—e.g. via control elements not shown here—in relation to the position of a copy 57 or a row of copies 57 comprising a plurality of copies 57 side by side.

In principle, the control elements 71; 72; 73; 74; 76; 77; 78; 81; 82; 83 of the common or of each user interface 55, which relate to the configuration, in particular the parameterization, of the dryer device in the transverse direction and/or the printing substrate transport direction, can be embodied as keys of a keypad 55, which is provided, e.g. on the control console. In an embodiment that is preferred here, however, user interface 55 is embodied as a touch-sensitive screen 55, for example as what is known as a touch screen 55, or what is known as a touch panel 55, with the required actuation. The stated control elements 71; 72; 73; 74; 76; 77; 78; 81; 82; 83, or at least a subgroup thereof, that relate to the parameterization of the dryer device in the transverse direction are embodied, e.g. as touch sensitive fields 71; 72; 73; 74; 76; 77; 78; 81; 82; 83 with programming relating to the respective positioning function, thus in this case, e.g. for defining and/or modifying specifications relating to the number and/or lateral position and/or width of groups $\mathbf{38}_k$ and/or of the required tracks $t_i$ and/or of the copies 57 provided side by side on printing substrate 02, or specifications relating to the number and/or position and/or length of the active phases $P_{ON}$ and/or of the copies 57 provided one behind the other on printing substrate 02. A combined embodiment of control elements 71; 72; 73; 74; 76; 77; 78; 81; 82; 83 may also be provided, with control elements 71; 72; 73; 74; 76; 77; 78; 81; 82; 83 configured both in terms of hardware and software.

In principle, the control elements 71; 72; 73; 74; 76; 77; 78; 81; 82; 83 embodied as touch-sensitive fields can be provided as fields of the same control panel 84; 85, e.g. an input mask 84; 85 or screen mask 84; 85, or can be distributed among a plurality of control panels 84; 85; 86, e.g. input mask, 84; 85; 86 or screen masks 84; 85; 86, e.g. grouped thematically with respect to their association with related positioning functions.

Figure 21:
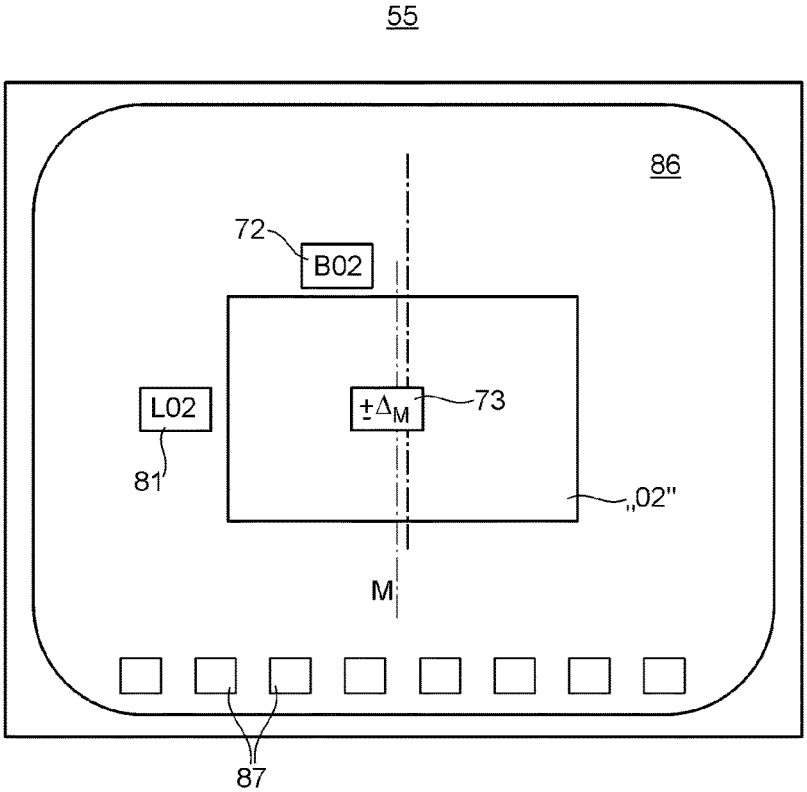
FIG. 21 a schematic diagram of a control panel relating to dimensions and/or position.

For example, one or more control elements 72; 73; 81 that relate to specifications that are required for configuring the dryer device, for example specifications regarding printing substrate dimensions and/or regarding the printing substrate position, and that also are and/or will be factored, e.g. into adjustment or control functions or processes other than the configuration of the dryer device, can be provided in one or more other input or screen masks 86 (see, e.g. FIG. 21). These specifications—provided, for example, in this or another correlation for the production run in question, in the relevant input or screen mask 86—are factored into the configuration of the dryer device.

Control elements 71; 72; 73; 74; 76; 77; 78; 81; 82; 83 for the configuration or parameterization of the dryer device in the transverse direction and/or the longitudinal direction are operatively indirectly or directly connected in terms of signal transmission—irrespective of the hardware or software embodiment of said elements—to the control system 37, in particular to the aforementioned control means 48 thereof, which switches the dryer on and off at least once per cycle Z in spaced groups $\mathbf{38}_k$, and/or the group or groups $\mathbf{38}_k$. In this case, either the specifications regarding the relevant parameters—e.g. specifications regarding the number and/or lateral position and/or width of groups $\mathbf{38}_k$ and/or of tracks $t_i$ and/or of copies 57 provided side by side, and/or the specifications regarding the number and/or position and/or length of the active phases $P_{ON}$ and/or of the copies 57 provided one behind the other on printing substrate 02—are supplied directly as production-related data P as described above via the signal connection to control system 37 and/or control means 48 and are processed there, or information I(P) relating to the configuration in the transverse and/or longitudinal direction, which has been obtained in advance by computer-assisted processing of the production-related data P generated here from the specifications regarding the parameters, are supplied to control system 37—as illustrated e.g. schematically.

Figure 20:
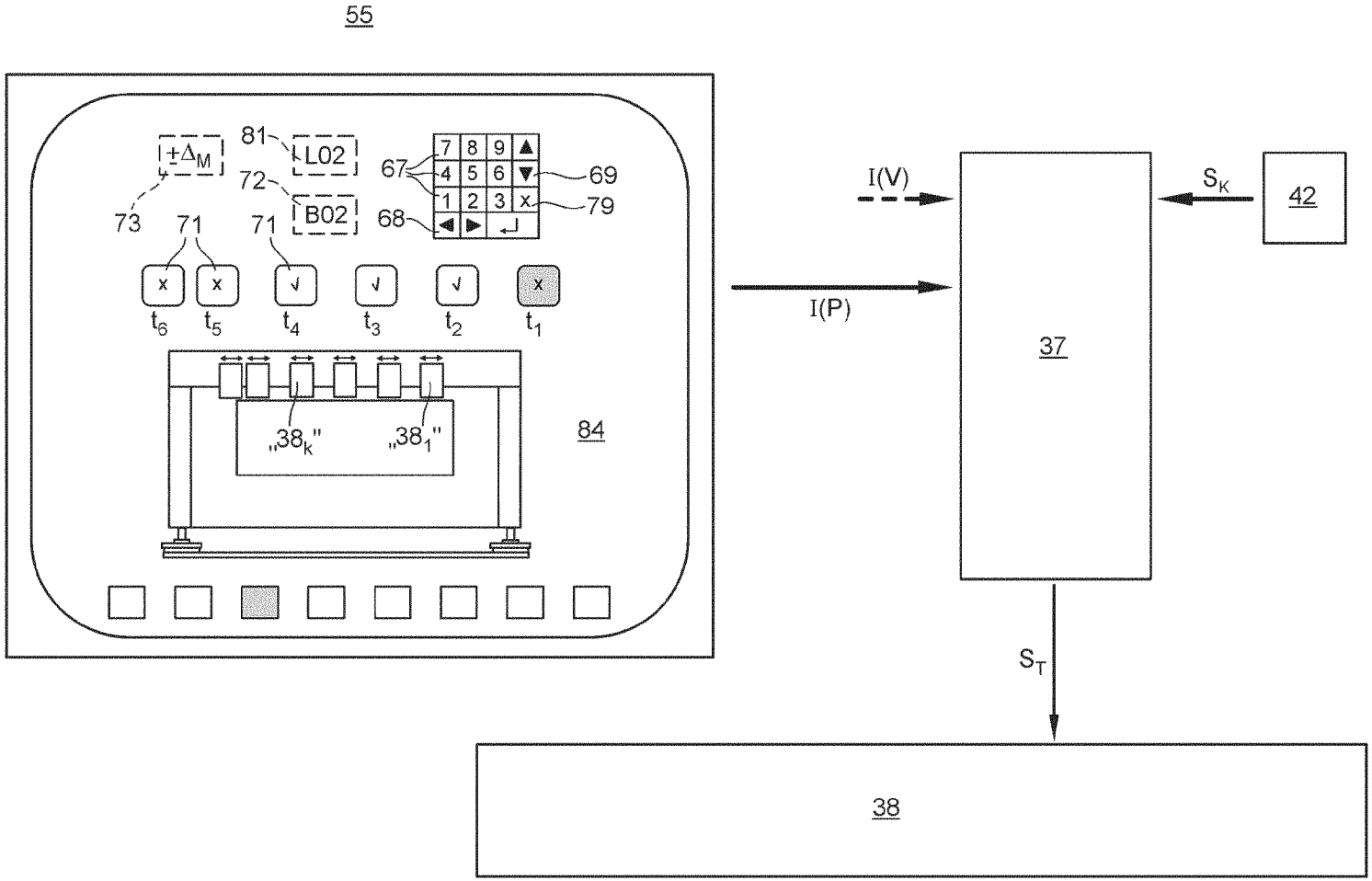
FIG. 20 a schematic diagram showing the actuation and configuration of the dryer using a user interface in a first embodiment.

In a first example of the configuration of the dryer device using a user interface 55 (see, e.g. FIG. 20), the aforementioned lateral positioning of dryer elements $\mathbf{38}_k$ or groups $\mathbf{38}_k$—in particular fixed in terms of width—, which are embodied, e.g. in the form of dryer heads according to the first embodiment of the multi-part drying means 38 or are defined as groups $\mathbf{38}_k$ according to the second embodiment thereof, can be carried out directly by means of suitably configured control elements 67; 68; 69; 71. For instance, a group $\mathbf{38}_k$ to be positioned can be selected via a control element 71 assigned to said group $\mathbf{38}_k$, and can be positionable and/or positioned laterally via control elements 68 that function as left or right buttons, and/or via control elements 57 embodied as keys of an alphanumeric keypad. In addition, dryer elements $\mathbf{38}_k$ that are not required for an operation can be deactivatable by selection and subsequent deactivation via an appropriately configured control element 79, for example, or conversely, the required dryer elements $\mathbf{38}_k$ can be activatable by a correspondingly reversed configuration of control element 79. In the embodiment as an at least partially touch-sensitive user interface 55, those control elements that are required for positioning can be contained in the same input or screen mask 84.

In a simple variant, the dryer device can be configured in the direction of transport over printing substrate length L02 or over a variable correlated therewith as a parameter. In this way, the length of the active phase $P_{ON}$, which is contained in the sequence and corresponds to printing substrate length L02 and which is based on a cycle Z, is defined. In that case, a control element 81 that represents, e.g. the parameter of printing substrate length L02 can be selected, and the size thereof can be adjusted or varied, e.g. via control elements 69 that function as plus or minus buttons, and/or via control elements 67 that are configured as keys of an alphanumeric keypad.

The control elements relating to the specifications regarding printing substrate length L02 can be included in the same or in a different input or screen mask 84; 86. Press operators can switch back and forth between different input or screen masks 84; 86 via, e.g. control elements 87 that function as buttons.

In this case, the the dryer device is configured, for example, by positioning dryer elements $\mathbf{38}_k$ or groups $\mathbf{38}_k$, as viewed transversely to the direction of transport, via manually operated control elements 67; 68; 69; 71. Where appropriate, the dryer elements $\mathbf{38}_k$ or groups $\mathbf{38}_k$ to be activated for a production run can be designated using a larger number of control elements 67; 68; 69; 71. This can be carried out positively by selecting the dryer element to be activated, or negatively by selecting the inactive dryer element $\mathbf{38}_k$. A dryer element $\mathbf{38}_k$ or a group $\mathbf{38}_k$ is thereby positioned, e.g. by selecting the dryer element $\mathbf{38}_k$ to be adjusted and the subsequent positioning either by inputting a specific position using keys of an alphanumeric keypad or using buttons 68 that adjust the position toward one side or the other.

Figure 22:
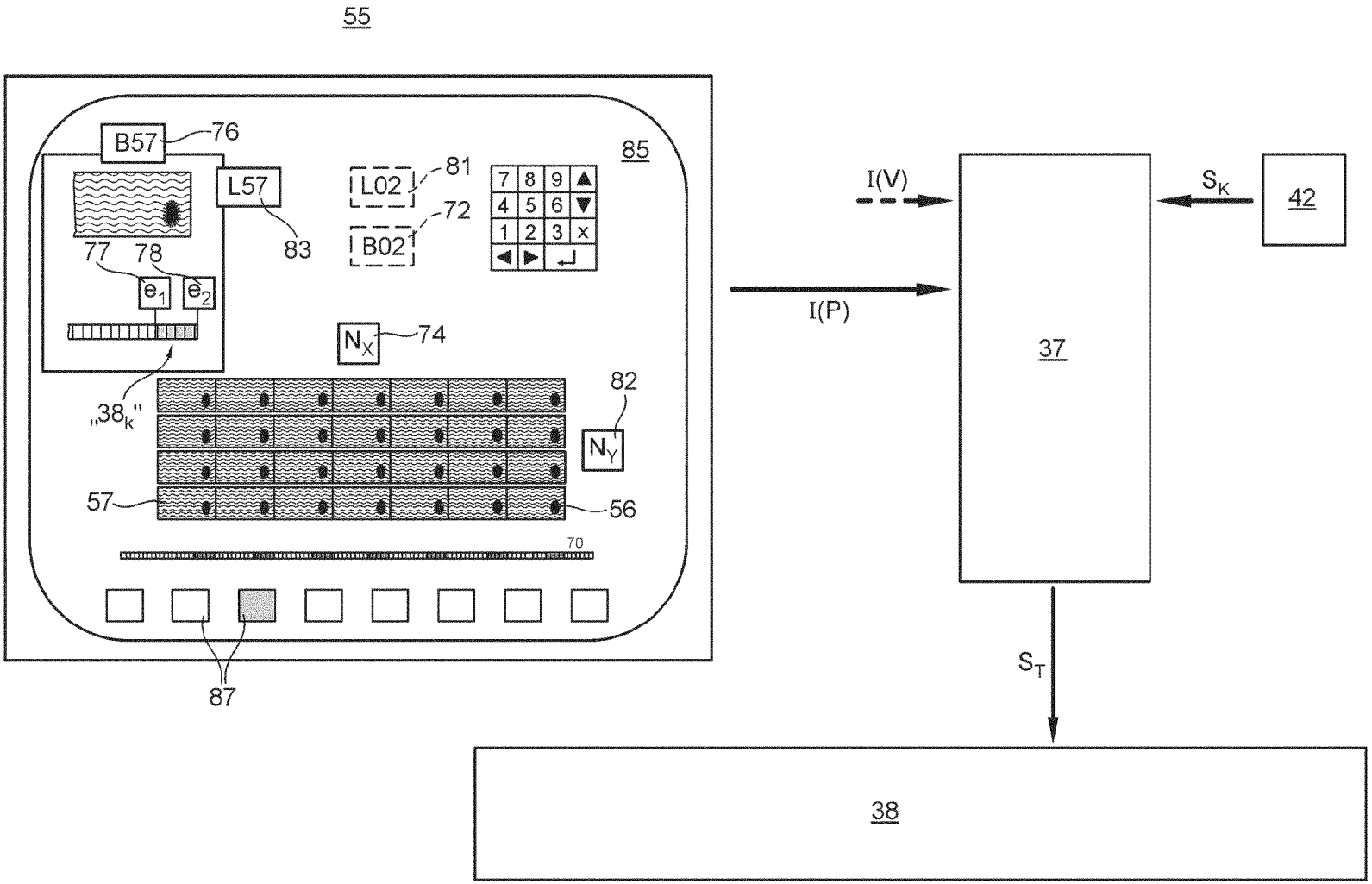
FIG. 22 a schematic diagram illustrating the actuation and configuration of the dryer using a user interface in a second embodiment.

In a second example of the configuration of the dryer device using a user interface 55 (see, e.g. FIG. 22), dryer elements $\mathbf{38}_k$ or groups $\mathbf{38}_k$ are formed according to the second embodiment of drying means 38 or dryer 14; 16; 36. In a first variant, this configuration in the transverse direction can likewise be carried out, in principle, directly via appropriately configured control elements 67; 68; 69; 71 for all of dryer elements $\mathbf{38}_k$ or groups $\mathbf{38}_k$, for example as in the first example, however in addition to the lateral position, the width of dryer elements $\mathbf{38}_k$ or groups $\mathbf{38}_k$ can be defined, e.g. via additional control elements not shown in FIG. 20. Groups $\mathbf{38}_k$ of radiation sources $\mathbf{38}_{k,i}$ arranged side by side are then formed according to the specifications regarding position and width, and during operation are switched on and off, e.g. in the aforementioned manner, simultaneously and/or collectively. If user interface 55 is embodied as touch-sensitive, groups $\mathbf{38}_k$ could alternatively be formed by activating individual radiation sources $\mathbf{38}_{k,i}$ or radiation segments from the set of all radiation sources $\mathbf{38}_{k,i}$ or radiation segments that are shown side by side in a screen mask. This can be used, e.g. in cases of lower resolution, i.e. with a smaller total number in the transverse direction, or in cases in which each of radiation sources $\mathbf{38}_{k,i}$ or radiation segments has a greater width.

Particularly in the case of greater resolution and/or reduced adjustment effort, however, a variant is advantageous in which the lateral position and width of a group $\mathbf{38}_k$ or track $t_i$, or where applicable even a plurality of groups $\mathbf{38}_k$ or tracks $t_i$, is defined on the basis of only one copy 57, and based on this definition, which is based on one copy, and the position and width of all the required groups $\mathbf{38}_k$ or tracks $t_i$ is determined using information relating to the number and position of copies 57 arranged side by side on printing substrate 02. In that case, the information relating to the number and position of copies 57 arranged side by side on printing substrate 02 can be available or provided in a variety of ways. For example, specifications regarding the number $N_x$ and the width B57 of copies 57 to be arranged side by side laterally on printing substrate 02, or the width B02 of the printing substrate 02 that receives the $N_x$ copies 57 side by side can be used for this purpose. For the specifications, e.g. appropriately configured control elements 74; 76; 72 can be provided. If the printing substrate 02 to be acted on and/or the overall print image is not symmetrical with respect to the transverse extension of dryer 38 and/or with respect to press center M, a specification regarding the corresponding lateral offset $\Delta_M$ can be provided via, e.g. an additional control element 73.

The definition of the width and position of a group $\mathbf{38}_k$ or track $t_i$ that is to be activated based on one copy 57 can be implemented by the specific activation of individual radiation sources $\mathbf{38}_{k,i}$ or radiation segments. In the case of a touch-sensitive screen 55, this can be a direct selection of radiation sources $\mathbf{38}_{k,i}$ or radiation segments, represented true-to-scale in the transverse direction in an image of a copy 57. In the case of a touch-sensitive screen 55, selection can be made by touch. Alternatively, however, it is also possible for the definition of the group $\mathbf{38}_k$ or track $t_i$ based on copy 57 to be carried out by defining the two ends, i.e. the radiation sources $\mathbf{38}_{k,i}$ or radiation segments that delimit the group $\mathbf{38}_k$ or track $t_i$ at both ends. In a first variant, this can again be carried out by touching the relevant boundary radiation sources $\mathbf{38}_{k,i}$, or radiation segments. In another variant, radiation sources $\mathbf{38}_{k,i}$ or radiation segments—e.g. as boundary radiation sources $e_1$; $e_2$ or boundary radiation segments—can be via appropriately configured control elements 77; 78; 67; 68, for example, by selecting the control element 77; 78 that relates to the parameter to be defined, e.g. the control element 77; 78 that relates to the right edge or the left edge of the group $\mathbf{38}_k$ or track $t_i$ to be formed, and the definition thereof can be by either inputting a specific position, e.g. using keys of an alphanumeric keypad, or using buttons 68 that adjust the position toward one side or the other.

In the second example of the configuration of the dryer device, in a simple variant, the dryer device can be configured in the direction of transport over only the printing substrate length L02 or over a variable that is correlated therewith. For this purpose, a control element 81 that represents, e.g. the parameter of printing substrate length L02 can be selected, and the size thereof can be adjusted or varied, e.g. via control elements 69 that function as plus or minus buttons, and/or via control elements 67 that are configured as keys of an alphanumeric keypad. As described above, the control elements relating to the specifications regarding printing substrate length L02 can be included in the same or in a different input or screen mask 85; 86.

In a refinement, it is possible for the configuration of the dryer device in the direction of transport to permit the definition of a plurality of active phases $P_{ON}$ per cycle Z, in particular for each printing substrate length L02. For example, the dryer device can be configured in the longitudinal direction such that at least one active phase $P_{ON}$ is provided for each of the copies 57 arranged one behind the other along a printing substrate length L02.

In a first variant, this configuration in the longitudinal direction can be carried out directly, in principle, using appropriately configured control elements 67; 68; 69; 71 for all of the active phases $P_{ON}$ of cycle Z, wherein for each of the phases $P_{ON}$, the position thereof in the direction of transport and the width thereof would need to be specifically definable using corresponding control elements. In the case of a user interface 55 embodied as touch-sensitive, the formation of phases $P_{ON}$ could alternatively be defined by selecting or defining individual longitudinal sections from a total length of a printing substrate sheet 02 shown in a screen mask.

For reduced adjustment effort, however, a variant is advantageous in which the position in the direction of transport or the longitudinal direction and the width of a phase $P_{ON}$ or, where applicable, even of a plurality of phases $P_{ON}$ is defined on the basis of only one copy 57, and on the basis of this definition, which is based on one copy 57, and using information relating to the number and the position of copies 57 arranged one behind the other on printing substrate 02, the position and length of all the active phases $P_{ON}$ is determined. In that case, the information relating to the number and position of copies 57 arranged one behind the other on printing substrate 02 can be available or provided in a variety of ways. For example, specifications regarding the number $N_Y$ and the length L57 of the copies 57 to be arranged one behind the other on printing substrate 02, or the length L02 of printing substrate 02 that receives the $N_Y$ copies 57 one behind the other can be used for this purpose. For the specifications, e.g. appropriately configured control elements 74; 76; 72 can be provided. If the printing substrate 02 to be acted on and/or the overall print image is not symmetrical with respect to the transverse extension of drying means 38 and/or with respect to press center M, a specification regarding the corresponding lateral offset $\Delta_M$ can additionally be provided via, e.g. an additional control element 73.

The definition of the length and position of a phase $P_{ON}$ based on one copy 57 can be carried out, in principle, via a concrete specification of the individual phases $P_{ON}$. In the case of a touch-sensitive screen 55, this can be a direct selection of sections of a strip shown true-to-scale in the longitudinal direction in an image of a copy 57. In the case of a touch-sensitive screen 55, the definition can be made by touch. Alternatively, however, it is also possible for the definition of the phase $P_{ON}$ based on copy 57 to be carried out by defining the two ends of the active phase $P_{ON}$. In a first variant, this can again be carried out by touching corresponding points on the aforementioned strip. In another variant, the boundaries of the active phase $P_{ON}$ can be via appropriately configured control elements, for example by selecting a control element, not specifically shown here, that relates to the parameter to be defined, e.g. the control element that relates to the leading or the trailing end of the active phase $P_{ON}$ to be defined, and the definition of said boundaries by either inputting a specific relative position, e.g. using keys of an alphanumeric keypad, or using buttons 68 that adjust the position toward one side or the other.

Figure 23:
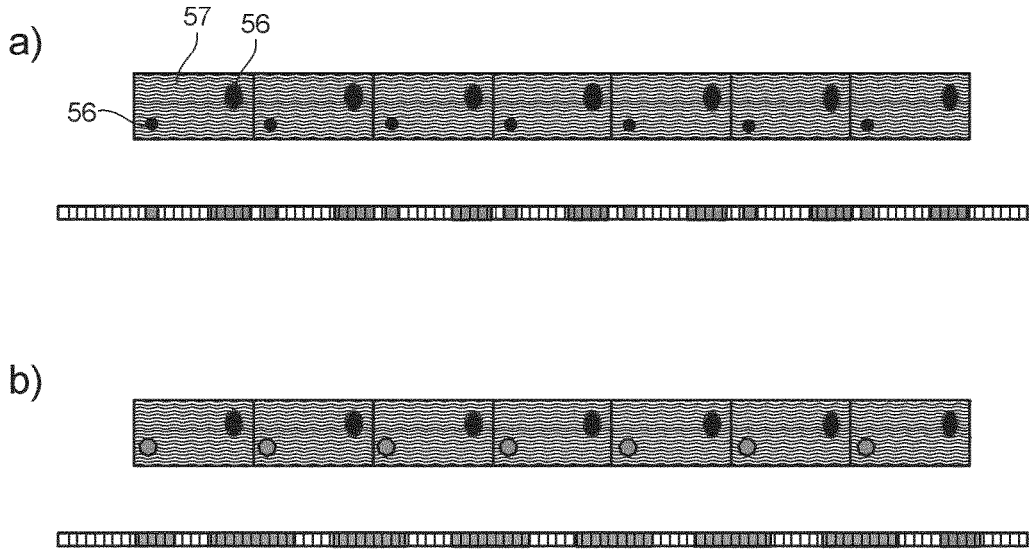
FIG. 23 schematically depicted examples of the position of image elements and correspondingly configured dryer elements or groups of radiation sources or single-row or multi-row radiation segments.
Figure 24:
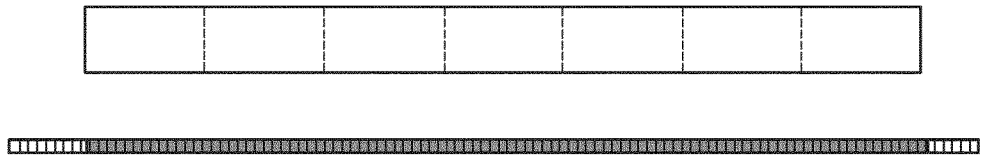
FIG. 24 a schematically depicted example of the position of the printing substrate and the correspondingly configured dryer element.
Figure 26:
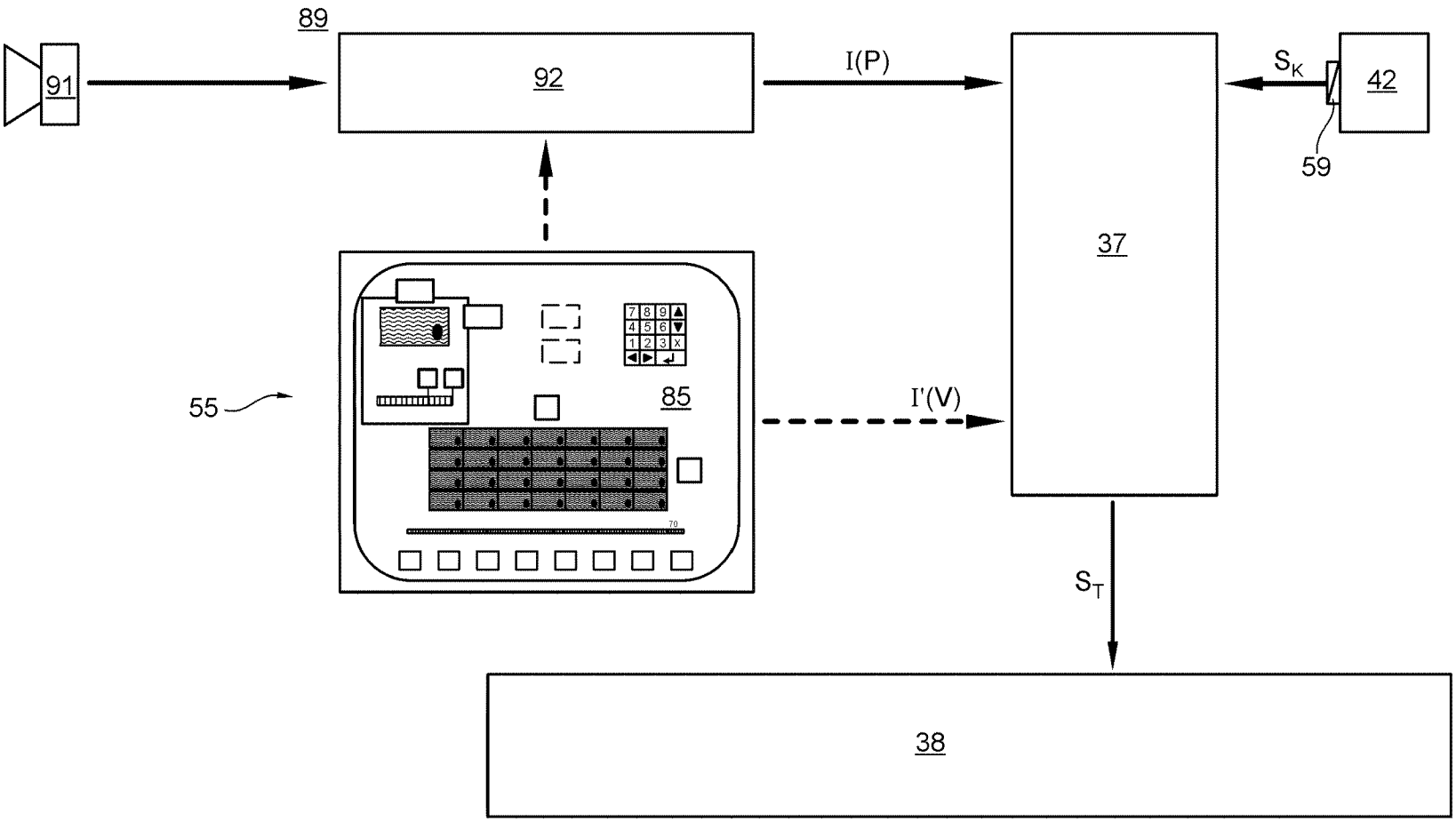
FIG. 26 a schematic diagram illustrating the actuation and configuration of the dryer using data supplied by a device for image detection and/or analysis.

Regarding the configuration in the transverse direction, it can be possible for one or more groups $\mathbf{38}_k$ to be formed for each copy 57. For example, if two or even more spaced-apart image elements 56 or image element groups per copy 57 are to be dried, in which case the spacing justifies a differentiation, for example, then two or even more groups $\mathbf{38}_k$ for drying the two or more image elements 56 or image element groups can be definable per copy (see, e.g. FIG. 23*a*). However, if two image elements 56 or image element groups are in close proximity to one another, it is possible for only one group $\mathbf{38}_k$ for drying the same to be defined. If image elements 56 or image element groups are to be dried in the area of the two lateral ends of the copies 57, the groups $\mathbf{38}_k$ can result in groups $\mathbf{38}_k$ through which adjacent ends are to pass (see, e.g. FIG. 23*b*).

Figure 25:
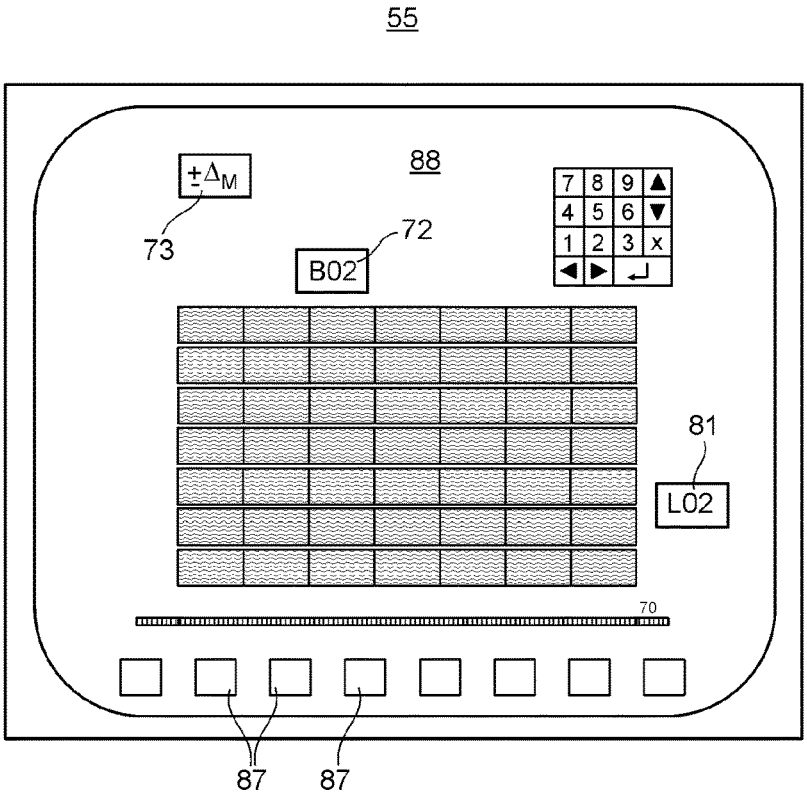
FIG. 25 a schematic diagram illustrating the actuation and configuration of the dryer using a user interface in a third embodiment.

In a third example of the configuration of the dryer device, which is, e.g. a variant of the second example, the above statements relating to the second example apply, with the exception that in this case, the number of dryer elements $\mathbf{38}_k$ or groups $\mathbf{38}_k$ to be formed is constant, and extends to only one group $\mathbf{38}_k$ or track $t_1$ of variable width to be formed, and the width of group $\mathbf{38}_k$ or track $t_1$ is based not on the number of copies and the width of one copy, but on the width B02 of the printing substrate 02. In a control panel 88 or screen mask 88 that is comparable to screen mask 85 (see, e.g. FIG. 25), the formation of dryer element $\mathbf{38}_k$ or group $\mathbf{38}_k$ is carried out preferably carried out directly via appropriately configured control elements 67; 68; 69; 71, wherein in addition to the width of dryer element $\mathbf{38}_k$ or of group $\mathbf{38}_k$, the lateral position thereof can also be defined. In that case, a group $\mathbf{38}_k$ of radiation sources $\mathbf{38}_{k,i}$ arranged side by side is then formed according to the specifications regarding position and width, and during operation said radiation sources are switched on and off, e.g. in the aforementioned manner, simultaneously and/or collectively. If user interface 55 is embodied as touch-sensitive, group $\mathbf{38}_k$ could alternatively be formed by activating individual radiation sources $\mathbf{38}_{k,i}$ or radiation segments from the full set of radiation sources $\mathbf{38}_{k,i}$ or radiation segments shown side by side in a screen mask, or by defining the edge elements in the manner described above in reference to an individual group. If the printing substrate 02 to be acted on and/or the overall print image is not symmetrical with respect to the transverse extension of dryer 38 and/or with respect to press center M, a specification regarding the corresponding lateral offset $\Delta_M$ can additionally be provided via, e.g. an additional control element 73.

In the third example of the configuration of the dryer device, the configuration of the dryer device in the direction of transport can be embodied according to the first variant of the second example, and can be carried out over only the printing substrate length L02 or a variable correlated therewith. For this purpose, a control element 81 that represents, e.g. the parameter of printing substrate length L02 can be selected, and the size thereof can be adjusted or varied, e.g. via control elements 69 that function as plus or minus buttons, and/or via control elements 67 that are configured as keys of an alphanumeric keypad. As described above, the control elements 72; 81; 73 relating to the specifications regarding printing substrate length 02 can be included in the same or in a different input or screen mask 85; 86; 88.

The embodiment variants for the configuration of the dryer device of the first and second examples of the first embodiment are preferably particularly advantageous in conjunction with a printing press, in particular a security printing press, or a printing unit 19; 23; 19'; 23' that comprises—e.g. in the manner described above—an imaging cylinder 18; 22; 18'; 22' having a plurality of image-producing printing elements 25; 25' or groups of image-producing printing elements 25; 25' on its periphery, which are arranged in a plurality of columns spaced equidistant from one another transversely to the direction of transport over a circumferential length that corresponds to the print image length L44, and in a plurality of rows spaced equidistant from one another across a cylinder width that corresponds to the print image width.

In contrast, the variants for the configuration of the dryer device of the third example of the first embodiment are preferably particularly advantageous in conjunction with a printing press, in particular a security printing press, or a printing unit 19"; 23" that prints onto a printing substrate—e.g. in the above-described manner—e.g. onto a first side and subsequently at least onto the second side, in succession in a planar fashion.

In a second embodiment of a device for configuring the dryer device, in addition to the at least one printing unit 19; 23; 19'; 23', at the print position 06; 07; 06'; 07' of which a print image having a print image length L44 can be printed onto each of the sections of printing substrate 02, in particular printing substrate sheets 02, passing through the print position 06; 07, in a cycle Z having a cycle length $L_Z$ which is fixed based on the printing substrate feed rate at the print position 06; 07; 06'; 07', and the dryer device having a dryer 14; 16; 36, situated downstream of print position 06; 07; 06'; 07' in the printing substrate path and comprising an integral or multi-part drying means 38, by means of which printing substrate 02 passing through the dryer 14; 16; 36 can be exposed to radiation for the purpose of drying the same, in at least one track $t_1$; $t_i$ that extends in the direction of transport of the printing substrate 02, and a control system 37 for controlling the operation of the dryer 14; 16; 36, the printing press also has, in the printing substrate path, a device 89 for image detection and/or analysis, which is connected in terms of signal transmission to control system 37, and by means of which data P regarding the position and/or dimensions of image elements 56 or image element groups that have been applied upstream to printing substrate 02 can be provided to control system 37. The provision of data P is also understood here as a provision of information I(P) that comprises and/or relates to such data P, and where applicable is prepared therefrom.

In that case, control system 37 preferably comprises computing and/or data processing means 48, which are embodied for configuring the dryer device, using the provided data P, with respect to the lateral position and/or width of at least one track $t_1$; $t_i$ to be acted on by dryer 14; 16; 36.

Drying means 38 of dryer 14; 16; 36 is preferably embodied in the above-described manner as having a plurality of radiation sources $\mathbf{38}_{k,i}$, in particular UV LEDs, in which case a relevant group $\mathbf{38}k$ can be formed variably from a plurality of beam or radiation sources $\mathbf{38}_{k,i}$.

This configuration embodiment is particularly advantageous in conjunction with a printing unit 19; 23; 19'; 23' contained in the printing press, the imaging cylinder 18; 22; 18'; 22' of which, e.g. in the aforementioned manner, has a plurality of image-producing printing elements 25; 25' or groups of image-producing printing elements 25; 25' on its periphery, which are arranged over a circumferential length that corresponds to print image length L44 in a plurality of columns spaced equidistant from one another transversely to the direction of transport, and across a cylinder width that corresponds to the print image width in a plurality of rows spaced equidistant from one another in the direction of transport.

In the configuration of the dryer device in, e.g. a printing press as described above, in particular a security printing press, that has at least one printing unit 19; 23; 19'; 23', at the print position 06; 07; 06'; 07' of which a print image, in particular precisely one integral or multi-part print image, having a print image length L44 can be printed onto each of the sections of a printing substrate 02, in particular printing substrate sheets 02, passing through the print position 06; 07, in a cycle Z having a cycle length $L_Z$ that is fixed based on the printing substrate feed rate at the print position 06; 07; 06'; 07', and wherein a dryer device has a dryer 14; 16; 36, situated downstream of print position 06; 07; 06'; 07' in the printing substrate path and comprising an integral or multi-part drying means 38, by means of which printing substrate 02 passing through the dryer 14; 16; 36 can be exposed to radiation for the purpose of drying the same, in at least one track $t_1$; $t_i$ that extends in the direction of transport of the printing substrate 02, and a control system 37 for controlling the operation of the dryer 14; 16; 36 is provided, for an ongoing or pending production run, the dryer device is configured with respect to the lateral position and/or width of the at least one track $t_1$; $t_i$ to be acted on by the dryer 14; 16; 36 in that said dryer device is adjusted and/or modified—for example, i.a.—using data P underlying or originating from a device 89 for image detection and/or analysis.

In the first variant for the origin of the data P it can be provided that information regarding the expected print pattern of the freshly printed points, e.g. image elements 57 or groups of image elements applied upstream, are forwarded to the device 89 for image detection and/or analysis, and the detection and analysis concentrates on these points. This information can then also be made available by the device 89 for image detection and/or analysis, in particular an inspection system 89, as data P or as information I(P) containing said data or appropriately processed, to the control system 37. The information regarding the expected print pattern at the freshly printed points can be forwarded, for example, from specifications at a user interface 55, as described above for direct operation of the dryer device. The data P or the information I(P) are transmitted here, for example, indirectly via the device 89 or the inspection system 89. A second user interface 55 specifically for the dryer device may be provided, in principle, but may also be dispensed with for reasons of cost.

Rather than inputting the specifications via a user interface 55 assigned solely to the dryer device, or only indirectly via a device 89 for image detection and/or analysis, the user interface 55 may be connected for signal communication to both the dryer device or the control system 37 thereof and the inspection system or the device 89 for image detection and/or analysis, for the provision in parallel of corresponding data P or information I(P). In that case, the user interface 55 can be configured in the manner described above, and can make the data regarding the image points to be considered available to the device 89 for image detection and/or analysis, and can make the data P or information I(P) for the tracks and/or track sections to be dried available to the dryer device. A user interface 55 of this type can then be provided at the control console or integrated therein.

In the second variant, such data P regarding the position and/or size of the are obtained upstream with image elements 57 or image element groups (in this case, e.g. applied security features), e.g. by means of device 89 for image detection and/or analysis, e.g. the print image is detected by an image detection device 91, e.g. camera 91, and is processed appropriately by means of an analysis device 92, e.g. camera software that is contained in the camera or in a separate DP means, to generate corresponding data P or information I(P) representing the position and/or size.

Irrespective of the origin of the data P or information I(P), as part of the configuration, the position and/or width of a dryer element $38_k$ that effectuates drying in the at least one track $t_1$; $t_i$ is preferably defined and/or modified using data P or information I(P).

Furthermore, in an advantageous refinement, at least one active phase $P_{ON}$, which is shorter than cycle length $L_Z$, is configured with respect to a position and/or length that is based on a cycle Z using data P underlying or originating from device 89.

The dryer device is configured, e.g. such that the printing substrate 02 passing through dryer 14; 16; 36 for the purpose of drying the same is exposed to radiation in a plurality of tracks $t_1$; $t_i$ that are spaced from one another. Tracks $t_1$; $t_i$ are configured laterally, e.g. using data P regarding the position and/or size of image elements 56 or image element groups that have been or will be applied to printing substrate 02 by printing unit 19; 23; 19'; 23', in particular in regular rows and columns.

In a first embodiment, the configuration of the dryer device and/or the operation thereof in the direction of transport are carried out such that, e.g. printing substrate 02 passing through dryer 14; 16; 36 for the purpose of drying the same is exposed to radiation for each cycle Z in only one phase $P_{ON}$, which is shorter than cycle Z. In that case, the configuration of a position and/or length of the phase $P_{ON}$ is carried out, for example, using specifications that represent a printing substrate length L02.

In a second embodiment of the configuration of the dryer device, which can be selected, e.g. as an alternative to the first embodiment, configuration is carried out, e.g. using data P underlying or originating from device 89, in such a way that printing substrate 02 passing through dryer 14; 16; 36 for the purpose of drying the same is exposed to radiation in a plurality of phases $P_{ON}$ of cycle Z that are interrupted by inactive phases $P_{OFF}$.

In an advantageous embodiment of the printing press and the dryer device, the data P or information I(P) come from an analysis device 92 that processes the images from an image detection device 91. In that case, the data P and/or information I(P) comprise, e.g. specifications regarding the position and/or size of image elements 56 or image element groups that have been applied upstream to printing substrate 02.

In particular, it is advantageous for the device 89 for image detection and/or analysis to be embodied as an inspection system 89. Said device is arranged in the printing substrate path downstream of printing unit 19; 23; 19'; 23', for example, and monitors the printing, i.e. the print image printed onto the printing substrate 02 upstream, for predefined quality characteristics. A system of this type is already configured, e.g. for the purpose of inspection and is furnished, e.g. with algorithms for identifying the image elements 56, in particular security elements, that have already been printed, and selectively focusing the analysis on said elements. For this purpose, for example, one or more printing substrate sections 02, in particular sheets 02, are printed on by the press and are analyzed with respect to the relevant image elements 56 by inspection system 89. During this phase, dryer 14; 16; 36 or drying means 38 is operated continuously over its entire length, for example, but more particularly over at least the printing substrate width B02. Only after verified data P or information I(P) concerning the position and/or dimensions of the image elements 56 or image element groups to be inspected and dried is available is dryer 14; 16; 36 or drying means 38 operated in tracks $t_1$; $t_i$ according to the configuration and/or in a clocked manner.

In terms of software or circuitry, a dryer 14; 16; 36 of the second embodiment—in particular to be configured in the above-described manner—can already have, e.g., a fixed or at least predefined number z of zones in the transverse direction, with $z \in \mathbb{N} \geq 2$, in particular ≥3, each of which comprises a fixed or at least predefined number s of radiation segments arranged side by side as described above (single-row or multi-row), with $s \in \mathbb{N} \geq 5$, in particular ≥8. In that case, the number z of zones corresponds, for example, to the number $N_x$ of copies 57 provided side by side for printing in a standard production run of the printing press, e.g. $z=N_x \geq 3$, for example $z=N_x=7$. The zones are thereby fixed or at least predefined with respect to their lateral position.

In a first embodiment—with average resolution—the zones each comprise, e.g. at least 5, preferably at least 8, for example 10 segments. For configuration, each radiation segment of the zone, for example, can be activated or deactivated directly on the representation of one or more zones (see above), for example, or can be selected using the aforementioned control elements, e.g. the corresponding radiation sources $\mathbf{38}_{k,i}$ can be activated by selection using one control bit in one data word per zone.

In a second embodiment—having, e.g. increased resolution—the zones each comprise, e.g. at least 50, preferably at least 80, for example 90 segments. In that case, the segments of the zone or even of the entire drying means are numbered consecutively, for example. For configuration, for example, the or each segment can be selected by specifying a right and a left boundary radiation segment (see above), for example the corresponding radiation sources $\mathbf{38}_{k,i}$ can be activated using a start address and an end address of one data word each per—e.g. required—zone.

Both of these embodiments are and/or can be operated in a clocked manner, for example in the manner described above. For this purpose, the segments that are selected during configuration are switched on and off in correlation with and/or synchronized with the press phase position and/or the printing substrate phase position.

The zones are configured in the manner described above via a user interface 55 included in a control console, e.g. by means of one or more appropriately configured screen masks 84; 85; 86; 88, or if an inspection system is provided in the printing press, alternatively from data relating thereto, which can optionally be corrected via a user interface 55.

In addition to this embodiment of configuration using the data P or information I(P) relating to or coming from device 89, an aforementioned user interface 55 can be provided, by means of which a manual adjustment and/or a manual correction can be carried out selectively or for the purpose of correction.

While preferred embodiments of a method for configuring a dryer device in a security printing press, and a security printing press, in accordance with the present invention, have been set forth fully and completely hereinabove, it would be apparent to one of skill in the art that changes could be made thereto without departing from the true spirit and scope of the present invention which is accordingly to be limited only by the appended claims.

The invention claimed is:

1. A method for configuring a dryer device in a security printing press including:

providing a security printing press having at least one printing unit for imprinting a printing substrate in one of a screen printing process and a letterpress process;

providing the security printing press having an image-producing cylinder and having one of a multiplicity of image-producing printing elements and groups of image-producing printing elements arranged in rows and columns on a periphery of the image-producing cylinder;

forming the image-producing printing elements having ink permeable regions on the image-producing cylinder for the screen printing process and which image-producing printing elements are formed by letterpress subjects for a letterpress process, and at the print position of which image-producing printing elements, sections of a printing substrate passing through the print position are imprinted, in a cycle having a fixed cycle length based upon a forward feed of the printing substrate at the print position;

providing one print image of one print image length for each section, and having ones of image elements and groups of image elements arranged side by side and one behind the other in a grid of multiple copies of the ones of image elements and groups of image elements;

forming the multiple copies using partial print images corresponding to ones of individual banknotes and security documents;

providing the dryer device having a dryer, located downstream of a print position of the image producing cylinder, in a printing substrate path and comprising one of an integral dryer and a multi-part dryer;

using the dryer to irradiate the printing substrate passing through the dryer for drying the printing substrate along at least one track extending in a direction of transport of the printing substrate along the printing substrate path;

configuring the dryer device for one of an ongoing and a pending production process such that the printing substrate passing through the dryer is irradiated for drying the printing substrate along a plurality of first tracks that are spaced from one another by second tracks which are not irradiated, according to an on/off switching sequence extending over one cycle length; and carrying out the on/off switching sequence in a configuration, with respect to one of a lateral position and a width of the plurality of first tracks to be irradiated by the dryer by one of using one of production-related data and information regarding a number of the multiple copies to be printed side by side on one printing substrate section, and using data provided by one of a device for image detection and analysis which device is part of the printing press, and using data supplied in parallel with such a device for one of image detection and analysis.

2. The method according to claim 1, further including providing one of a configuration having one of at least four tracks spaced from one another and with tracks spaced equidistant from one another and with tracks of a same track width, and a configuration with respect to one of a lateral position and a width of the tracks to be irradiated by the dryer and wherein the configuration is carried out based on a specification relating to one of a width of the copies to be printed side by side on the printing substrate in the relevant production run, and based on specifications relating to one of a lateral position and a width of an image element to be irradiated on a single copy.

3. The method according to claim 1, further including monitoring printing done by the security printing press for predefined quality characteristics in the printing substrate path downstream of the printing unit by using a device for one of image detection and analysis and embodied as an inspection system, and basing a configuration of the inspection system and a configuration of the dryer device upon the one of the production-related data and the information regarding the number of copies to be printed side by side on the one printing substrate section and upon the same specifications regarding one of a relative position and size of the image element on the single copy.

4. The method according to claim 1, further including, during the configuration, in addition to using the one of the production-related data and the information regarding the number of copies to be printed side by side on a printing substrate section, using one of production-related data and information regarding one of a size and a position of the copies.

5. The method according to claim 1, further including, in the configuration of the dryer device, determining one of a number and position and width of dryer elements that effect drying in the tracks and wherein spaced-apart groups of radiation sources to be activated according to the same sequence are one of defined and determined from a multiplicity of radiation sources provided side by side.

6. The method according to claim 1, further including configuring the dryer, with respect to one of its position and length, based upon one cycle, of at least one active phase, which is shorter than the cycle length.

7. The method according to claim 6, further including one of carrying out the configuration with respect to one of the cycle-based position and the length of the at least one active phase which is shorter than the cycle length using one of production-related data and information regarding one of the number and size and position of copies to be printed one behind the other onto a printing substrate section and using data that are one of provided by a device for one of image detection and analysis are supplied in parallel with such a device.

8. The method according to claim 7, further including carrying out a cycle-based configuration using a plurality of active phases, of a first phase length, spaced equidistant from one another.

9. The method according to claim 6, further including carrying out a cycle-based configuration with one of only one active phase and using specifications that represent one printing substrate length.

10. The method according to claim 1, further including one of obtaining one of data and information regarding one of the number and size and position of the copies and data that one of are and will be supplied to the device for one of image detection and analysis from press operators at a user interface and obtaining the one of the data and information regarding the one of the number and size and position of the copies from data imported from one of a production plan and input at a control console of the printing press.

11. The method according to claim 1, further including carrying out the configuration in the transport direction using one of specifications relating to one of the number and length of copies printed one behind the other on the printing substrate, and using specifications regarding one of the position in the transport direction and the length of an image element to be irradiated on a single copy.

12. A security printing press comprising:

at least one printing unit for printing onto a printing substrate in one of a screen printing process and a letterpress process;

an image-producing cylinder in the at least one printing unit and having one of a multiplicity of image-producing printing elements and groups of image-producing printing elements arranged in rows and columns on a periphery of the image-producing cylinder, which image-producing printing elements are formed by ones of ink permeable regions on the image-producing cylinder for the screen printing process and by letterpress subjects for the letterpress process, and at the print position of which image-producing cylinder, sections of the printing substrate passing through the print position can be imprinted, in a cycle that has a fixed cycle length based upon the forward feed of the printing substrate at the print position, with one print image of one print image length per section, and having one of image elements and groups of image elements arranged side by side and one behind the other in a grid of multiple copies;

a dryer device in the printing unit, the dryer device having a dryer, located downstream of the print position in a printing substrate path, the dryer comprising one of an integral drying means and multipart drying means, by which, a printing substrate passing through the dryer can be irradiated for drying the, imprinted sections of the printing substrate along at least one track extending in the transport direction of the printing substrate; and a control system to control an operation of the dryer, the control system being operatively connected for signal communication to one of control elements of a user interface and to a device for one of image detection and analysis, from which control system the dryer can be configured, with respect to the lateral position and the number of drying elements operated by the control system, according to an on/off switching sequence.

13. The security printing press according to claim 12, wherein the control system is connected for signal communication one of directly, in parallel with the device for one of image detection and analysis, and indirectly via a device for one of image detection and analysis, to the user interface comprising the control elements, which can be actuated, one of directly and indirectly by defining image regions to be detected, to one of determine and select one of a number and lateral position and width of dryer elements spaced from one another transversely to the transport direction of the printing substrate and to be activated according to the same sequence.

14. The security printing press according to claim 12, wherein the drying means of the dryer is formed by an arrangement, extending at least across a maximum printing substrate width of the printing substrate, of one of a multiplicity of radiation sources, arranged side by side, across the maximum printing substrate width, and a length-based number of at least 50 radiation sources per meter, and wherein the multiplicity of radiation sources can be variably formed, as groups, from a plurality of individual ones of beam and radiation sources of the drying means.

15. The security printing press according to claim 12, wherein the dryer is configured, with respect to one of position and length, based on one cycle of one or more active phases that are shorter than the cycle length, via one of the user interface connected to the control system and via the device for one of image detection and analysis which is connected to the control system.

16. The security printing press according to claim 12, wherein the at least one printing unit comprises the image-producing cylinder having one of a multiplicity of image-producing printing elements and groups of image-producing printing elements on a periphery of the image-producing cylinder, which image-producing elements are arranged over a circumferential length of the image-producing cylinder and corresponding to the print image length, in a plurality of columns spaced equidistant from one another transversely to the transport direction and over an image-producing cylinder width corresponding to the print image width in a plurality of rows spaced equidistant from one another in the transport direction, and further wherein downstream of the printing unit, an inspection system is provided for monitoring printing produced by the at least one printing unit for predefined quality characteristics.

* * * * *